US012702240B2

(12) United States Patent
Ventola

(10) Patent No.: US 12,702,240 B2
(45) Date of Patent: Aug. 11, 2026

(54) MULTI-MODE SENSORY TABLE

(71) Applicant: Skip Hop, Inc., New York, NY (US)

(72) Inventor: Vincent Ventola, Fort Lee, NJ (US)

(73) Assignee: Skip Hop, Inc., New York, NY (US)

( * ) Notice: Subject to any disclaimer, the term of this patent is extended or adjusted under 35 U.S.C. 154(b) by 75 days.

(21) Appl. No.: 18/770,156

(22) Filed: Jul. 11, 2024

(65) Prior Publication Data

US 2026/0013650 A1 Jan. 15, 2026

(51) Int. Cl.
*A47D 3/00* (2006.01)
*A47D 15/00* (2006.01)

(52) U.S. Cl.
CPC ..... *A47D 3/00* (2013.01); *A47D 15/00* (2013.01)

(58) Field of Classification Search
CPC ..... A47B 13/00; A47B 13/08; A47B 37/00; A47B 2200/0001; A47D 3/00; A47D 15/00
USPC ..... 108/25
See application file for complete search history.

(56) References Cited

U.S. PATENT DOCUMENTS 3,162,495 A * 12/1964 Swift ..... A47B 31/02 186/44
3,688,707 A * 9/1972 White ..... A47B 13/08 108/90
4,427,391 A * 1/1984 Berman ..... A47B 97/04 108/26
4,437,714 A * 3/1984 Struck ..... A47B 69/00 312/272
5,244,271 A * 9/1993 Hackwood ..... A47C 4/03 297/440.15
5,327,838 A * 7/1994 Beltman ..... A47B 25/00 108/26
6,349,654 B1 * 2/2002 Peters ..... A47D 3/00 108/26
7,510,479 B2 * 3/2009 Stengel ..... A63H 33/32 472/126
9,468,289 B2 * 10/2016 Sambonet ..... A47B 13/16
2002/0040667 A1 * 4/2002 Birsel ..... A47B 21/00 108/25
2007/0056482 A1 * 3/2007 Robinson ..... A47B 37/04 108/25
2012/0175369 A1 * 7/2012 Toro ..... A47B 37/00 220/256.1
2022/0117162 A1 * 4/2022 Pike ..... A47B 37/00

* cited by examiner

*Primary Examiner* — Daniel J Rohrhoff
(74) *Attorney, Agent, or Firm* — Greenberg Traurig, LLP

(57) ABSTRACT

A table includes a tabletop surface having an opening. The opening is configured to removably receive a bin. The table further includes a ledge within the opening. The ledge is configured to support a lip of the bin while the bin is within the opening. The table further includes a plurality of posts connected to the ledge and within the opening. Each of the plurality of posts are configured to fit into a respective opening in the lip of the bin to hold the bin in place within the opening. The plurality of posts are further configured to support a lid.

20 Claims, 128 Drawing Sheets

MULTI-MODE SENSORY TABLE

BACKGROUND

Infants and toddlers develop physically and mentally by interacting with their environment. Different types of toys and play stations have been designed that are configured to present children with different stimuli.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

A first example embodiment includes a table including a tabletop surface having an opening. The opening is configured to removably receive a bin. The table further includes a ledge within the opening. The ledge is configured to support a lip of the bin while the bin is within the opening. The table further includes a plurality of posts connected to the ledge and within the opening. Each of the plurality of posts are configured to fit into a respective opening in the lip of the bin to hold the bin in place within the opening. The plurality of posts are further configured to support a lid.

A second example embodiment includes sensory table kit including a table. The table includes a tabletop surface with an opening, a ledge within the opening, and a plurality of posts connected to the ledge and within the opening. The sensory table kit further includes a bin having a lip around an outside edge of the bin. The sensory table kit further includes a lid. The opening in the tabletop surface is configured to removably receive the bin. The ledge is configured to support the lip of the bin while the bin is within the opening. Each of the plurality of posts are configured to fit into a respective opening in the lip of the bin to hold the bin in place within the opening. The plurality of posts are further configured to support the lid. While the lid is placed to rest upon the plurality of posts, a top surface of the lid is generally aligned with the tabletop surface irrespective of whether the bin is placed within the opening.

A third example embodiment includes a sensory table kit including a table. The table includes a tabletop surface with a tabletop opening and a ledge within the opening. The ledge further forms a first bin opening and a second bin opening. The table further includes a first set of posts connected to the ledge, adjacent to the first bin opening, and located within the tabletop opening. The table further includes a second set of posts connected to the ledge, adjacent to the second bin opening, and located within the tabletop opening. The sensory table kit further includes a first bin including a first lip around a first outside edge of the first bin. The sensory table kit further includes a second bin including a second lip around a second outside edge of the second bin. The sensory table kit further includes a first lid and a second lid. The tabletop opening and the first bin opening together are configured to removably receive the first bin. The tabletop opening and the second bin opening together are configured to removably receive the second bin. The ledge is configured to support the first lip of the first bin while the first bin is within the tabletop opening and the first bin opening. The ledge is configured to support the second lip of the second bin while the second bin is within the tabletop opening and the second bin opening. The first set of posts are configured to fit into first respective lip openings of the first lip of the first bin to hold the first bin in place within the tabletop opening and the first bin opening. The second set of posts are configured to fit into second respective lip openings of the second lip of second first bin to hold the second bin in place within the tabletop opening and the second bin opening. The first of posts are further configured to support the first lid. The second of posts are further configured to support the second lid. While the first lid is placed to rest upon the first set of posts and the second lid is placed to rest upon the second set of posts, a first top surface of the first lid, a second top surface of the second lid, and the tabletop surface together generally form a level tabletop of the sensory table kit.

BRIEF DESCRIPTION OF THE DRAWINGS

Various embodiments of the present disclosure can be further explained with reference to the attached drawings, wherein like structures are referred to by like numerals throughout the several views. The drawings shown are not necessarily to scale, with emphasis instead generally being placed upon illustrating the principles of the present disclosure. Therefore, specific structural and functional details disclosed herein, including in the various drawings and figures, are not to be interpreted as limiting, but merely as a representative basis for teaching one skilled in the art to variously employ one or more illustrative embodiments.

FIG. 119 is a bottom plan view of the bunny scoop of FIG. 112.

FIG. 120 is a top perspective view of a turtle scoop of a sensory table kit.

FIG. 121 is a bottom perspective view of the turtle scoop of FIG. 120.

FIG. 122 is a front elevational view of the turtle scoop of FIG. 120.

FIG. 123 is a rear elevational view of the turtle scoop of FIG. 120.

FIG. 124 is a left elevational view of the turtle scoop of FIG. 120.

FIG. 125 is a right elevational view of the turtle scoop of FIG. 120.

FIG. 126 is a top plan view of the turtle scoop of FIG. 120.

FIG. 127 is a bottom plan view of the turtle scoop of FIG. 120.

FIG. 128 is a top perspective view of a snail scoop of a sensory table kit.

FIG. 129 is a bottom perspective view of the snail scoop of FIG. 128.

FIG. 130 is a front elevational view of the snail scoop of FIG. 128.

Figure 128:
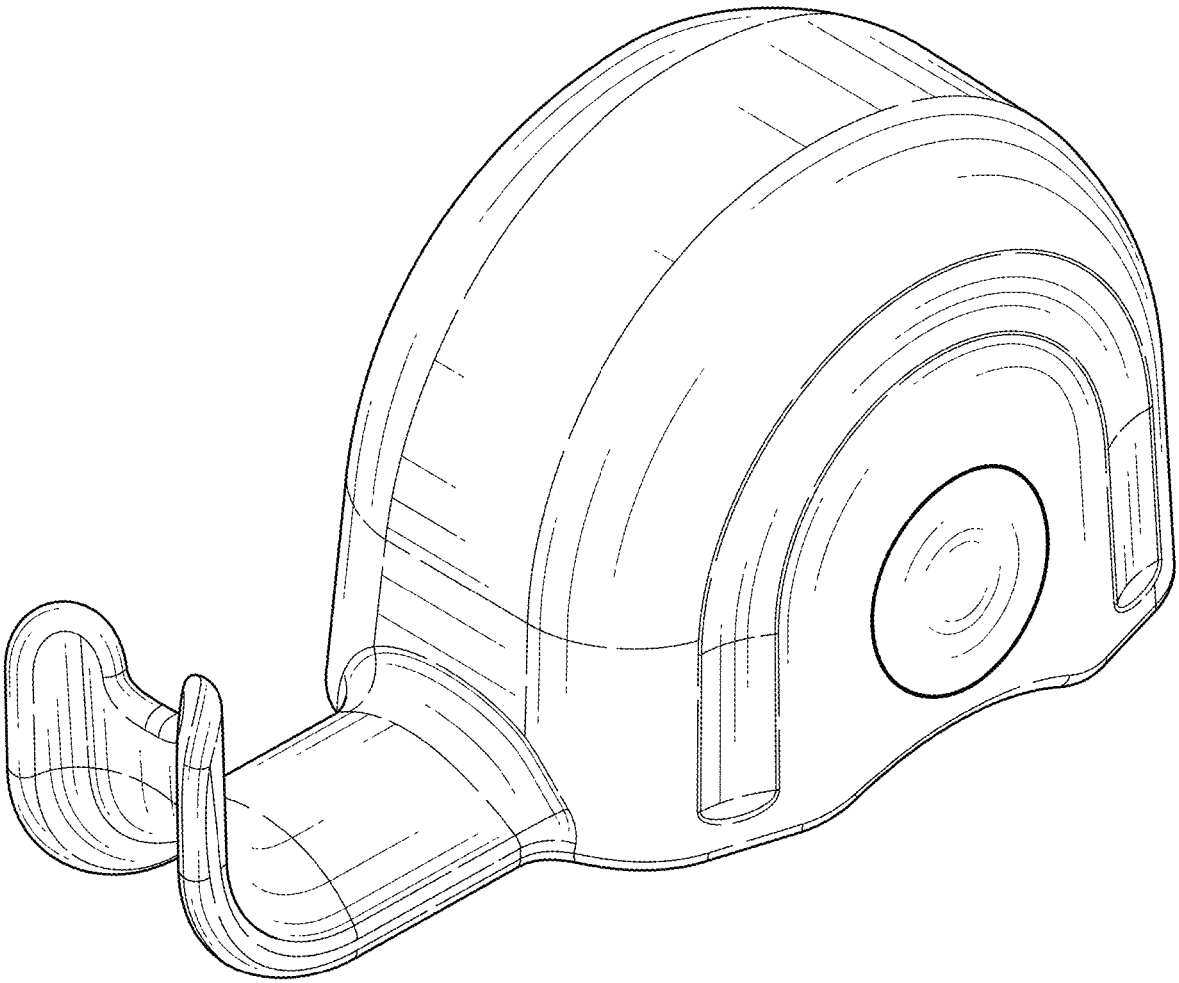
Figure 131:
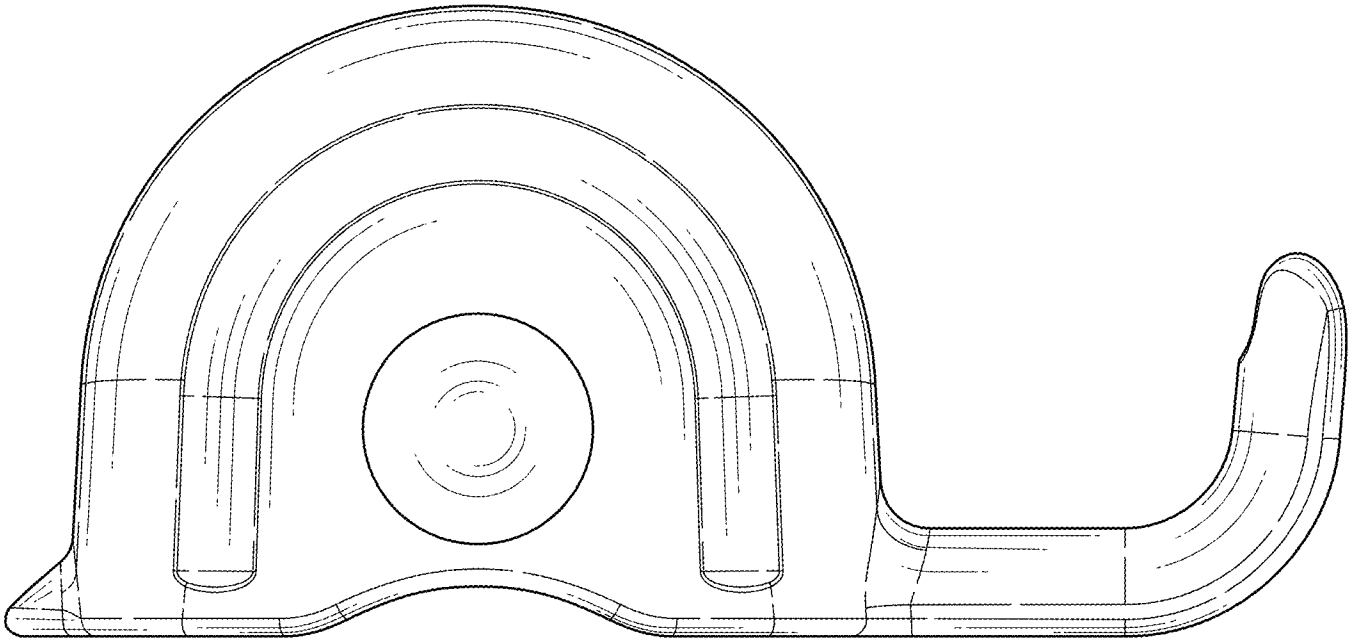

FIG. 131 is a rear elevational view of the snail scoop of FIG. 128.

Figure 132:
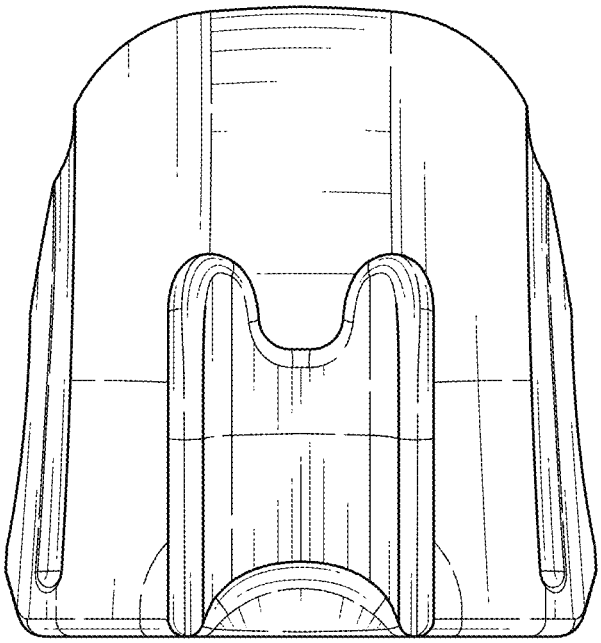

FIG. 132 is a left elevational view of the snail scoop of FIG. 128.

Figure 133:
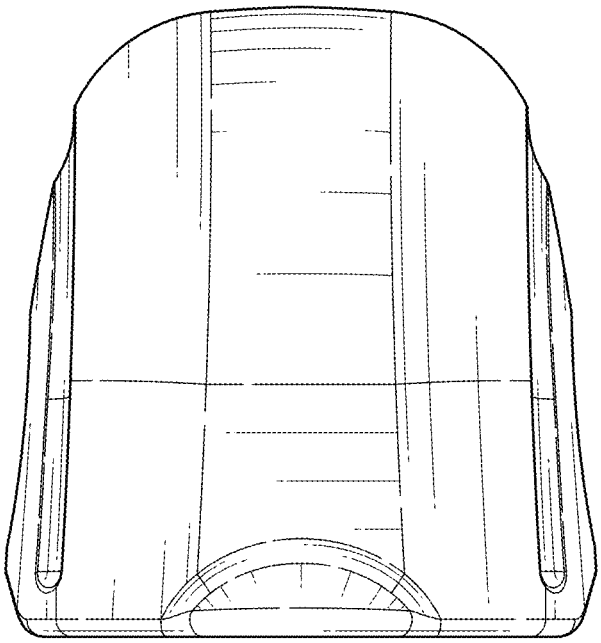

FIG. 133 is a right elevational view of the snail scoop of FIG. 128.

Figure 134:
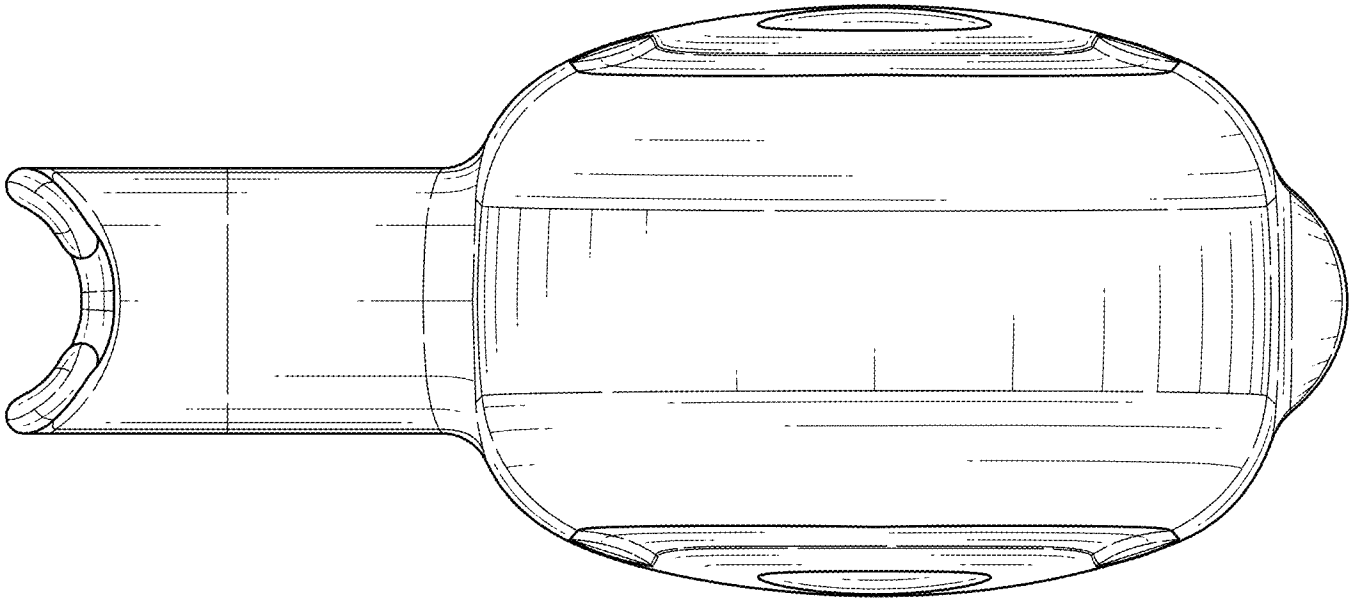

FIG. 134 is a top plan view of the snail scoop of FIG. 128.

Figure 135:
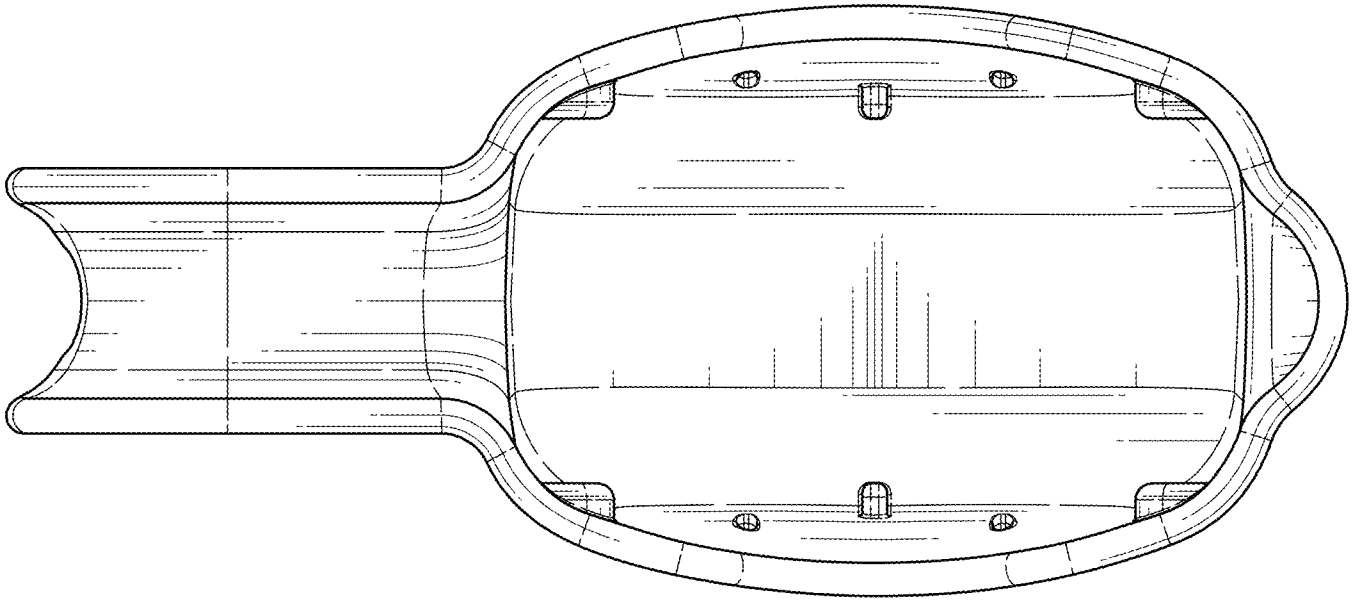

FIG. 135 is a bottom plan view of the snail scoop of FIG. 128.

Figure 136:
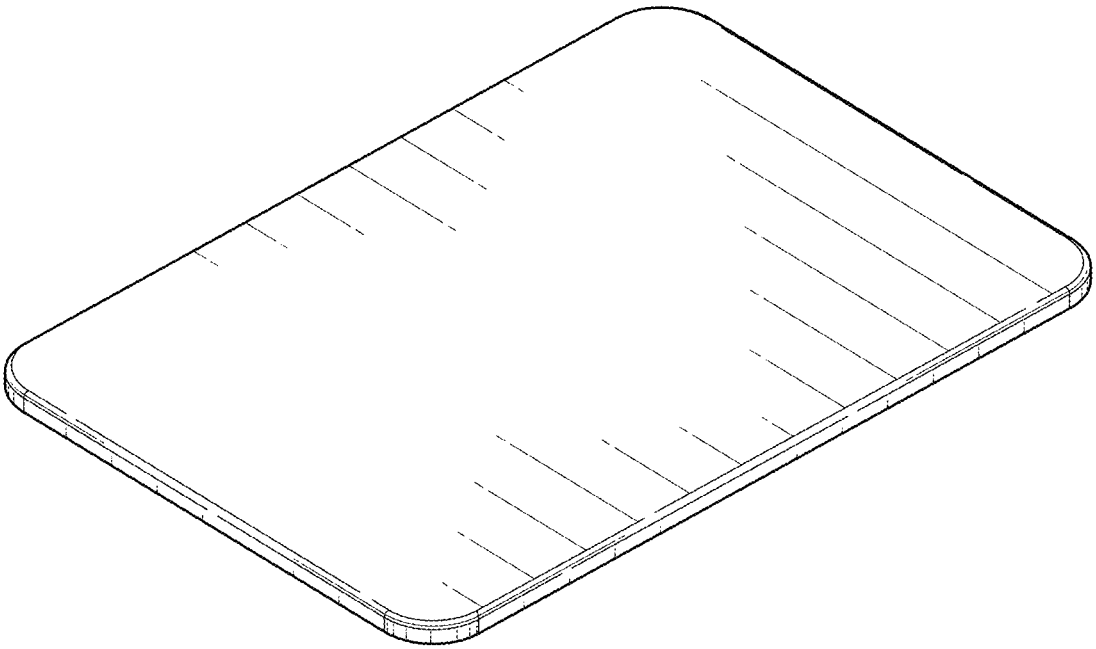

FIG. 136 is a top perspective view of a lid of a sensory table kit.

Figure 137:
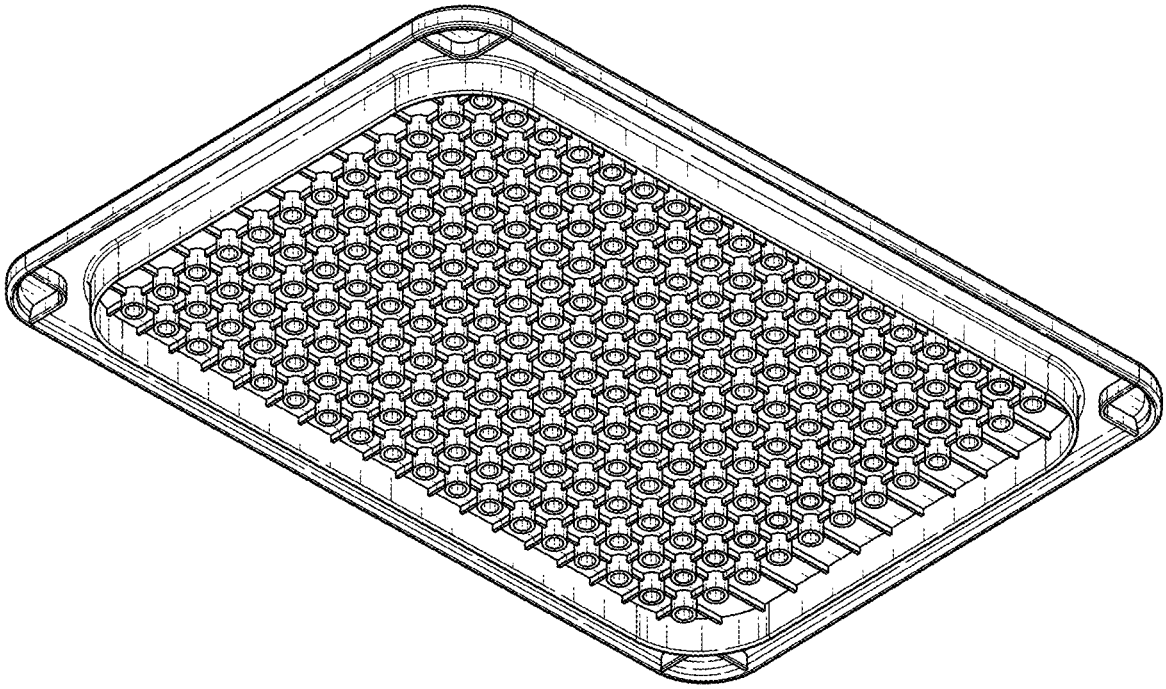

FIG. 137 is a bottom perspective view of the lid of FIG. 136.

Figure 138:
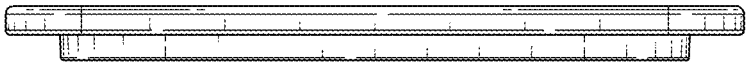

FIG. 138 is a front elevational view of the lid of FIG. 136.

Figure 139:
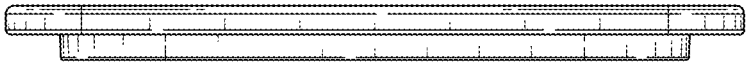

FIG. 139 is a rear elevational view of the lid of FIG. 136.

Figure 140:
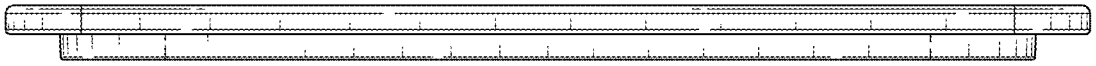

FIG. 140 is a left elevational view of the lid of FIG. 136.

Figure 141:
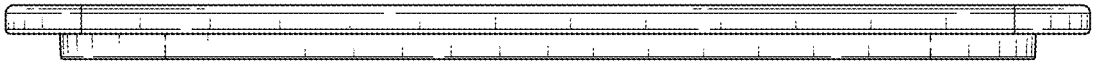

FIG. 141 is a right elevational view of the lid of FIG. 136.

Figure 142:
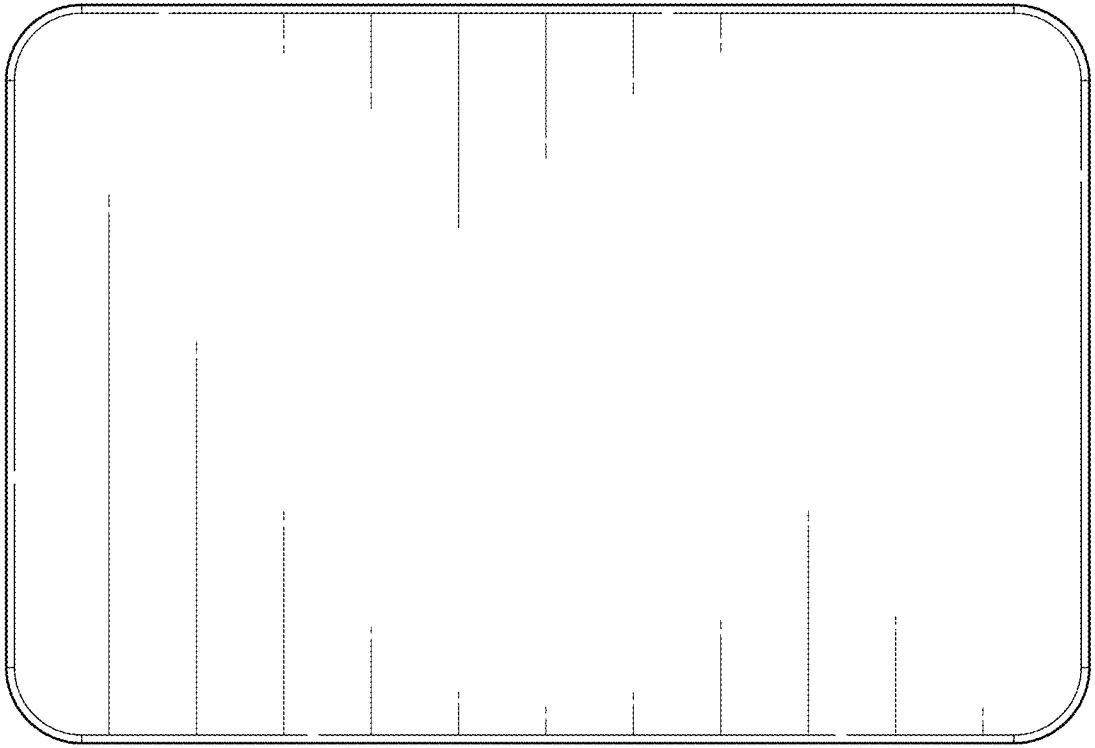

FIG. 142 is a top plan view of the lid of FIG. 136.

Figure 143:
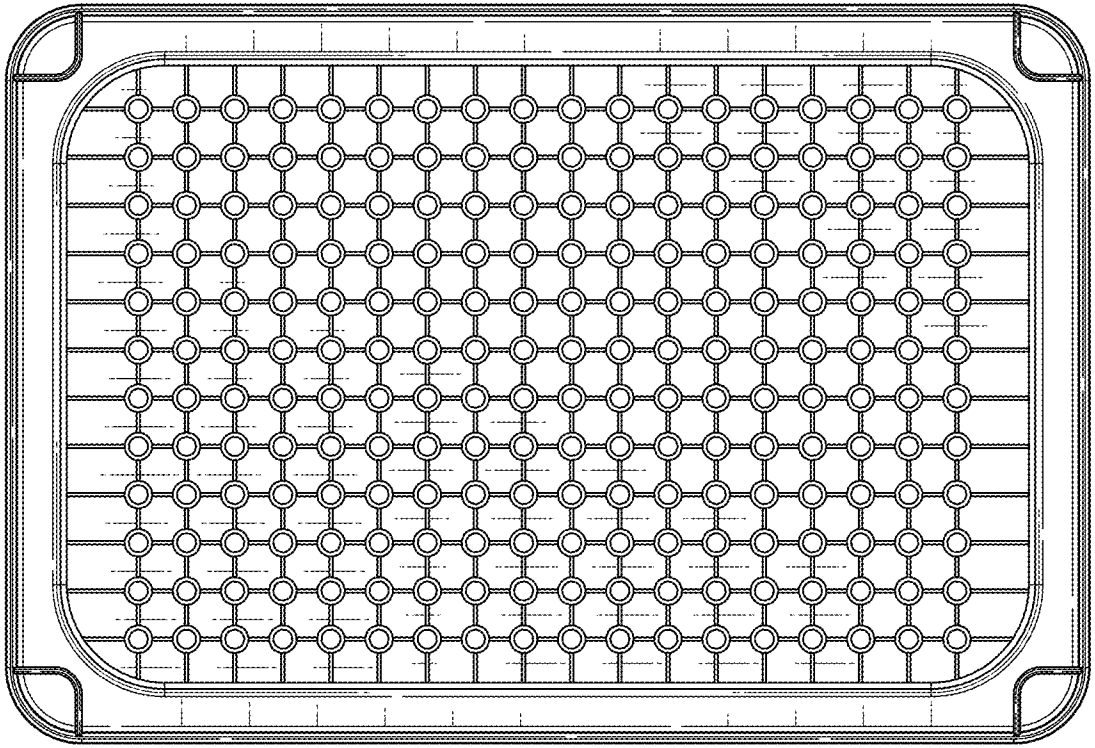

FIG. 143 is a bottom plan view of the lid of FIG. 136.

Figure 144:
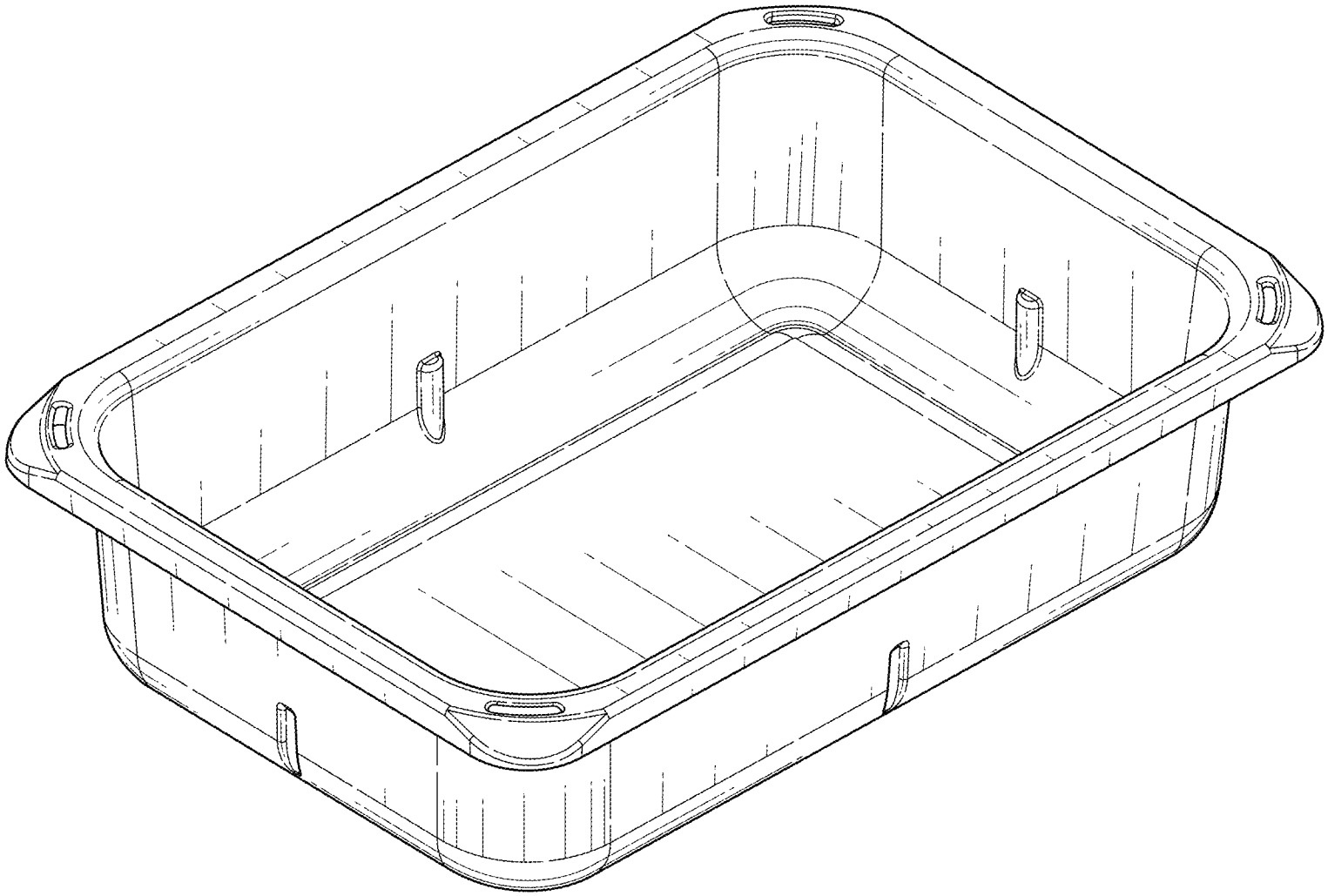

FIG. 144 is a top perspective view of a bin of a sensory table kit.

Figure 145:
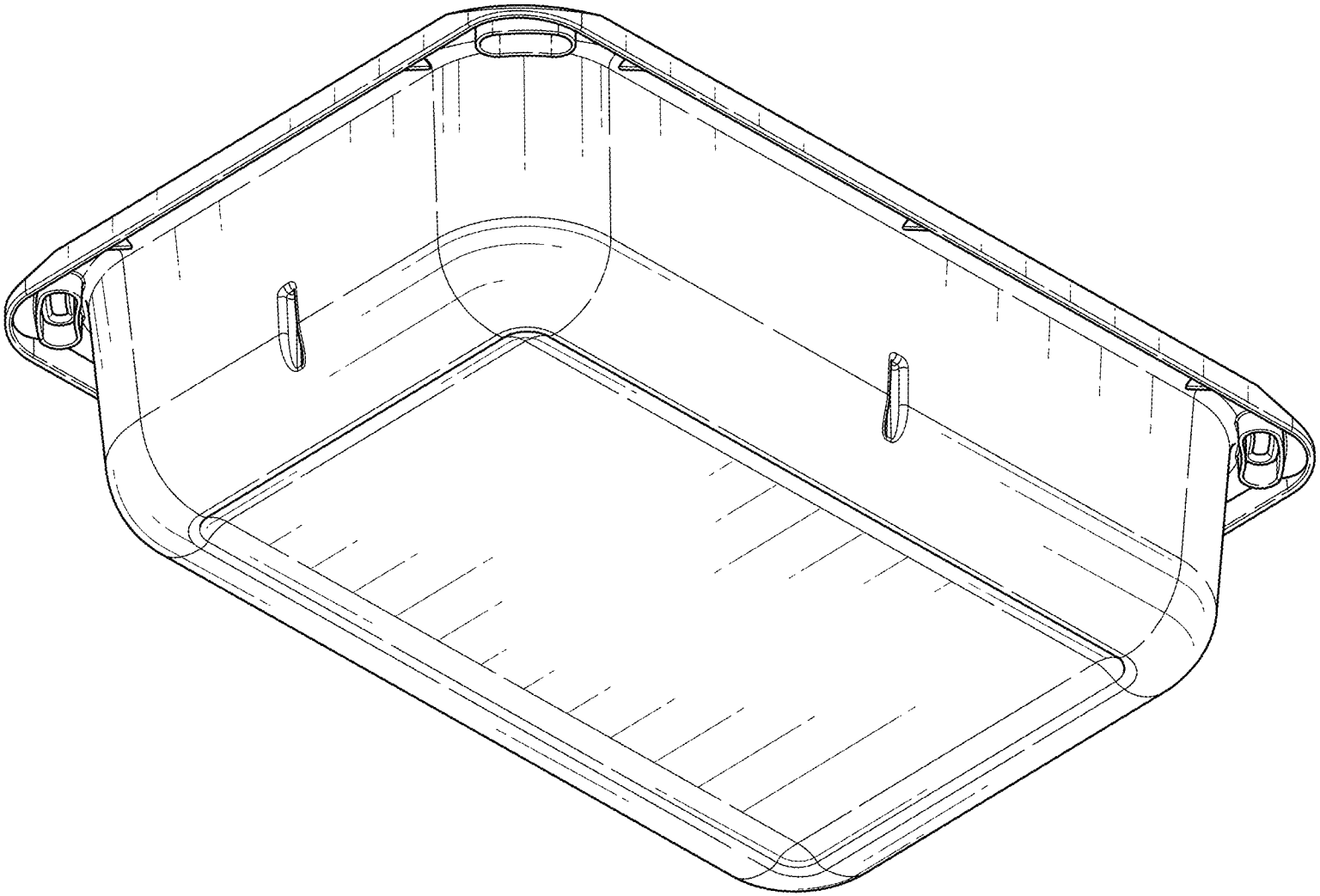

FIG. 145 is a bottom perspective view of the bin of FIG. 144.

Figure 146:
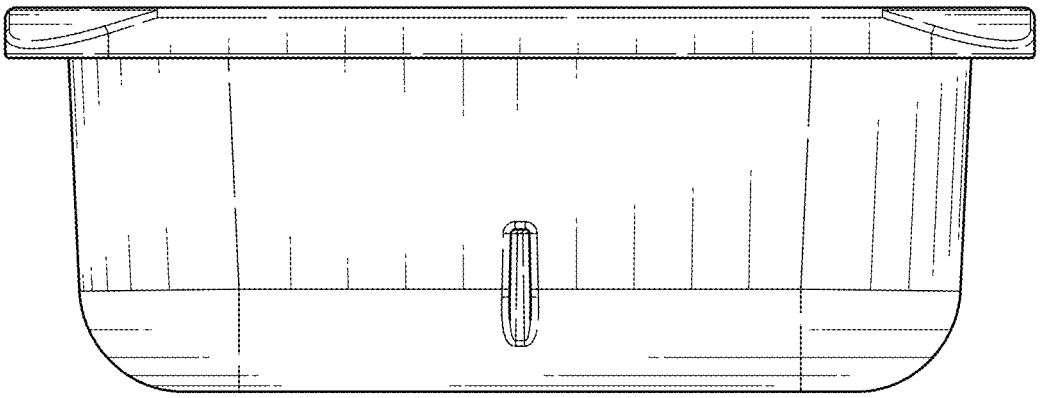

FIG. 146 is a front elevational view of the bin of FIG. 144.

Figure 147:
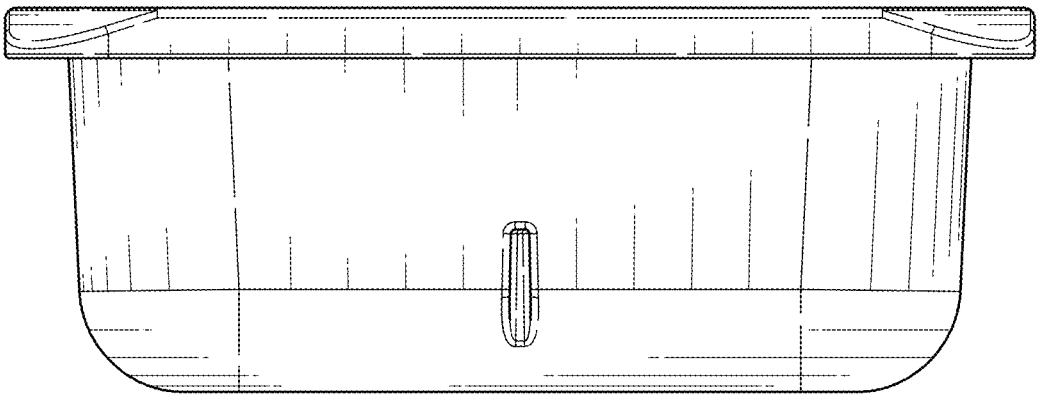

FIG. 147 is a rear elevational view of the bin of FIG. 144.

Figure 148:
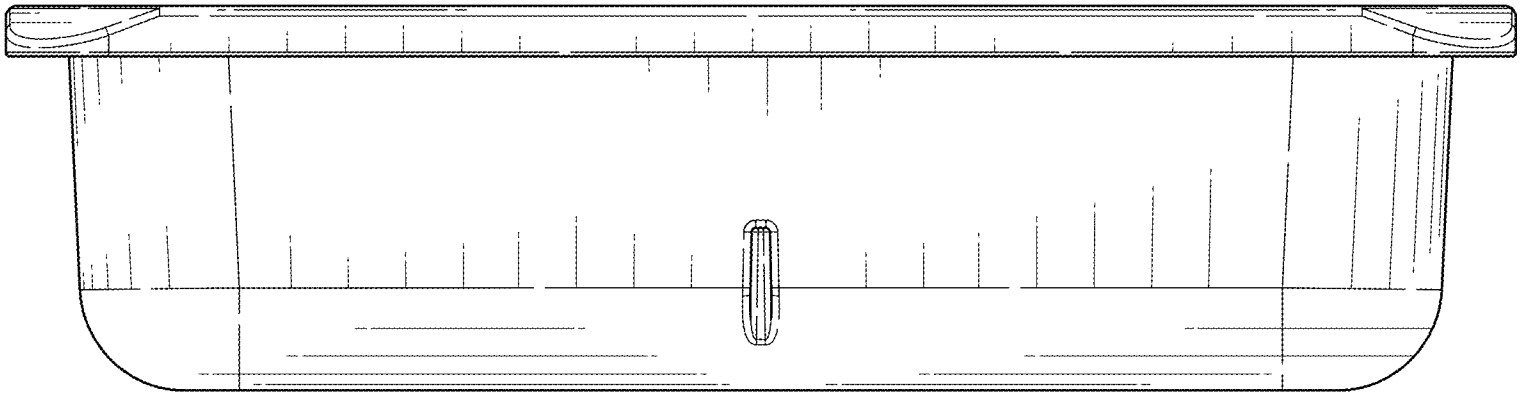

FIG. 148 is a left elevational view of the bin of FIG. 144.

Figure 149:
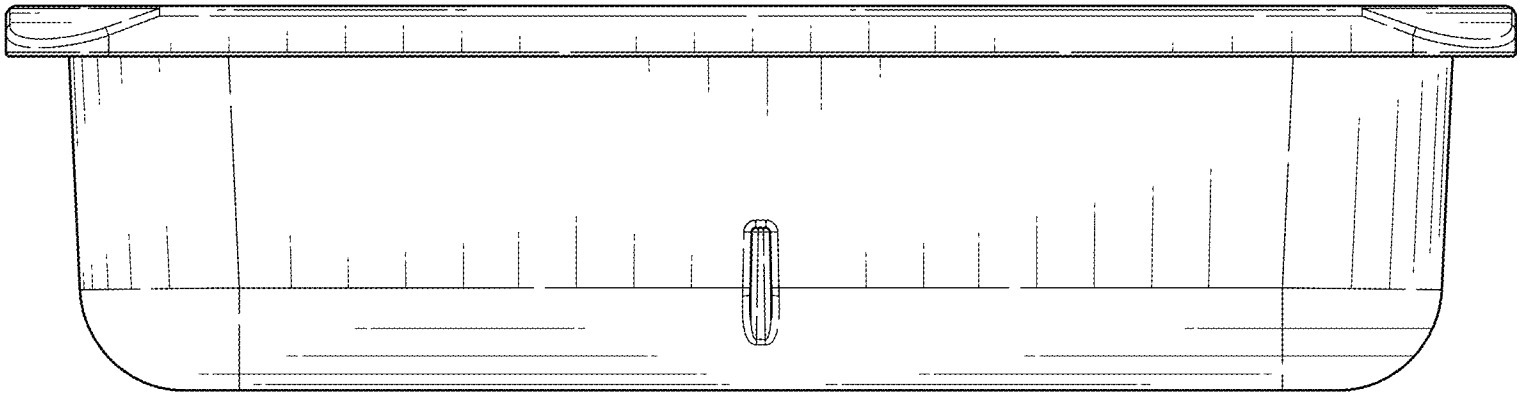

FIG. 149 is a right elevational view of the bin of FIG. 144.

Figure 150:
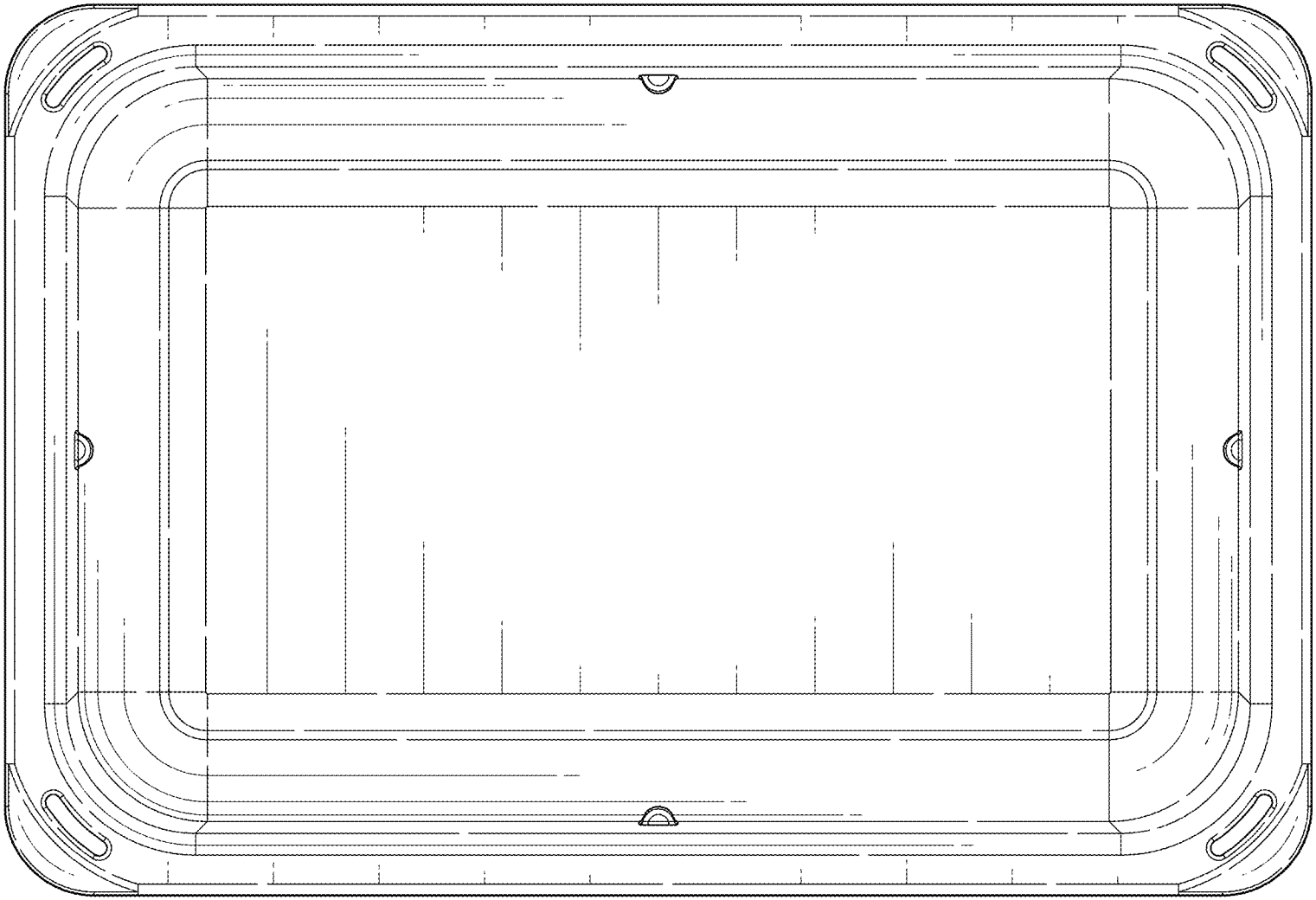

FIG. 150 is a top plan view of the bin of FIG. 144.

Figure 151:
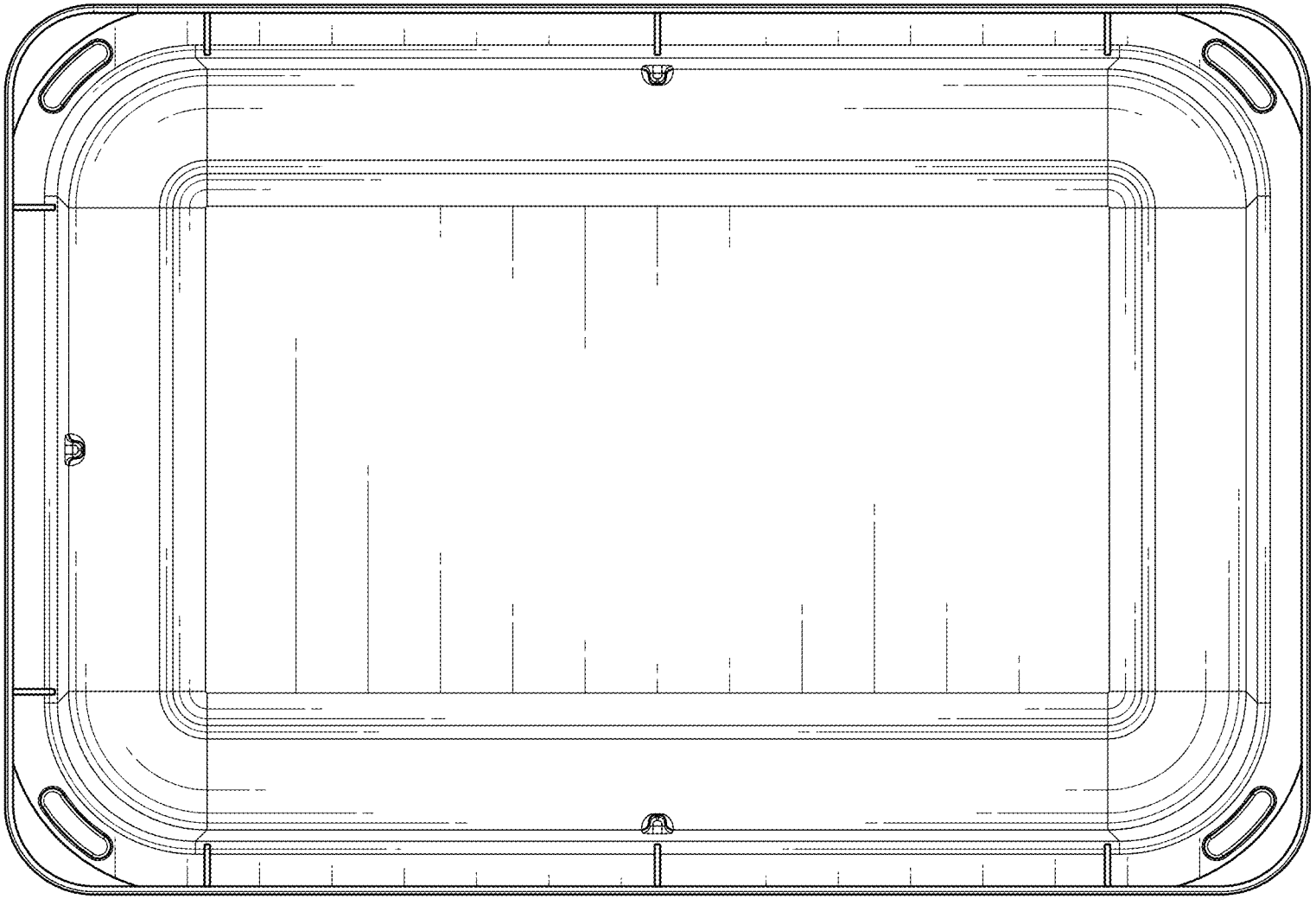

FIG. 151 is a bottom plan view of the bin of FIG. 144.

Figure 152:
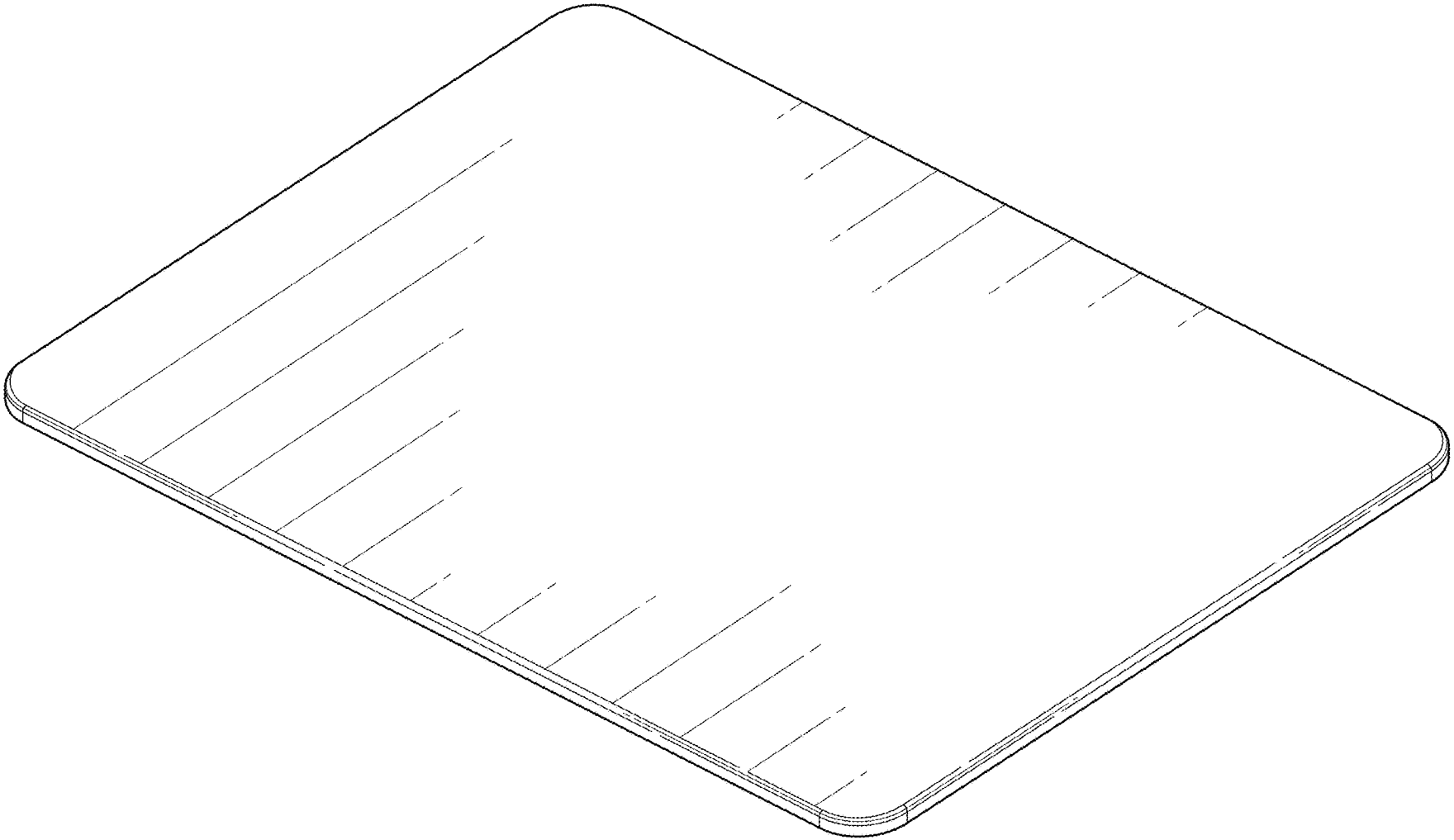

FIG. 152 is a top perspective view of a lid of a sensory table kit.

Figure 153:
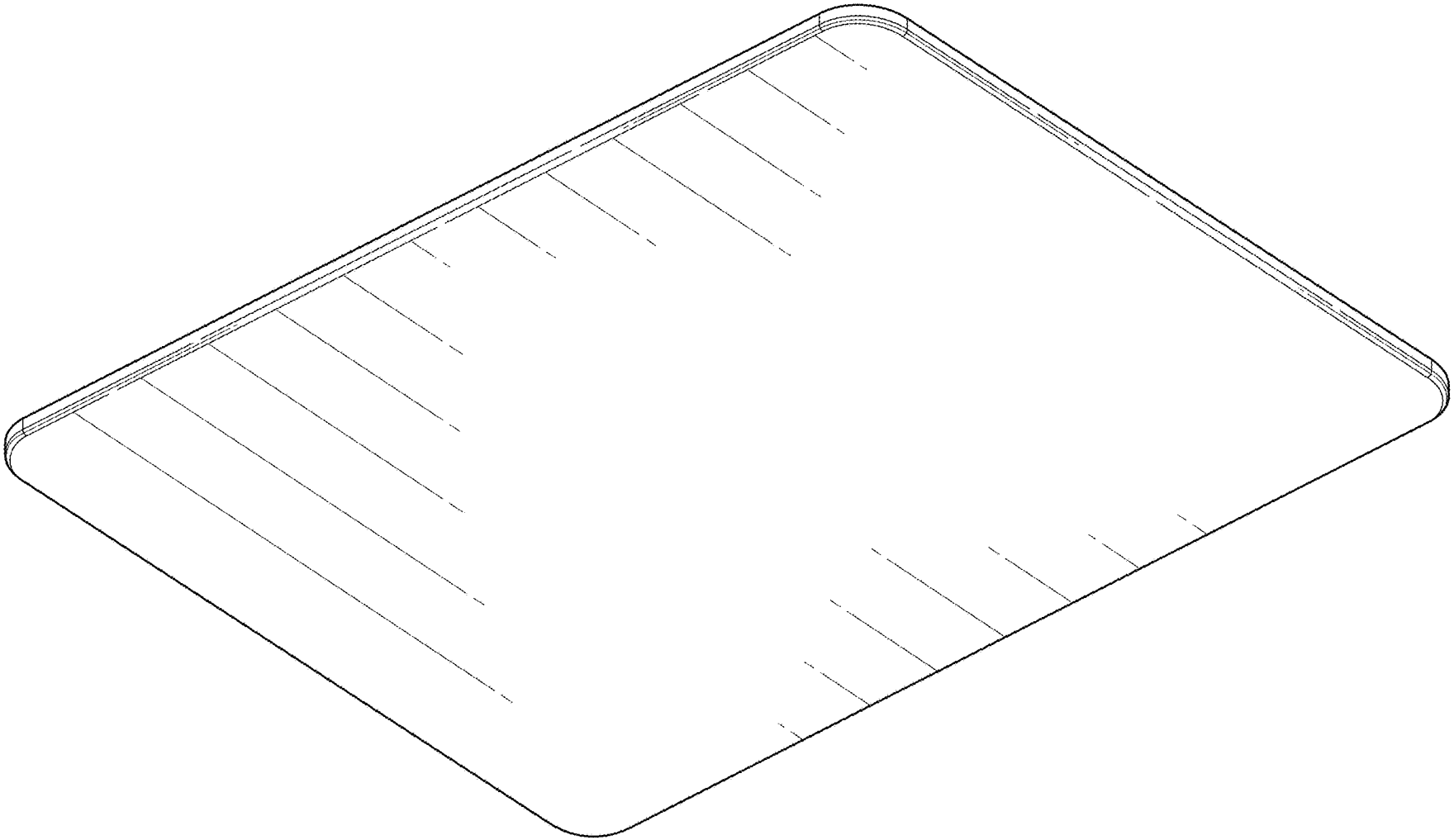

FIG. 153 is a bottom perspective view of the lid of FIG. 152.

Figure 112:
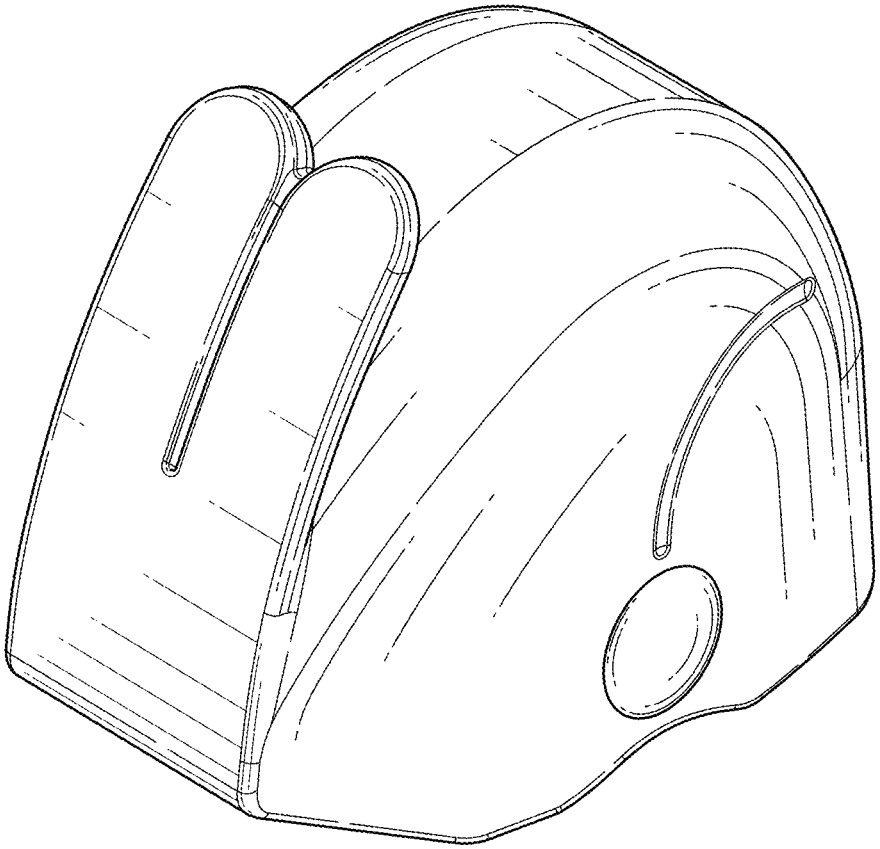
FIG. 112 is a top perspective view of a bunny scoop of a sensory table kit.
Figure 120:
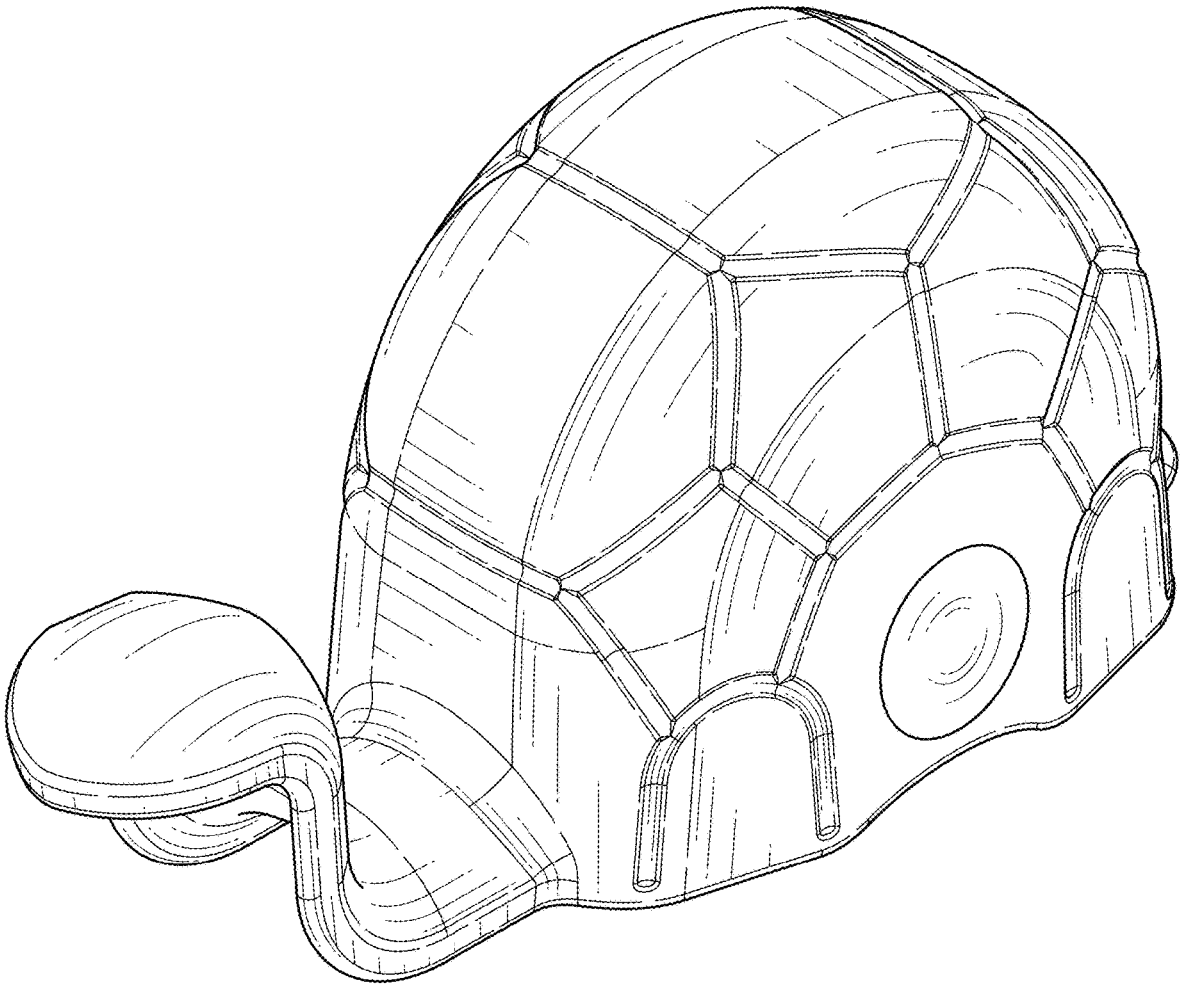
Figure 154:
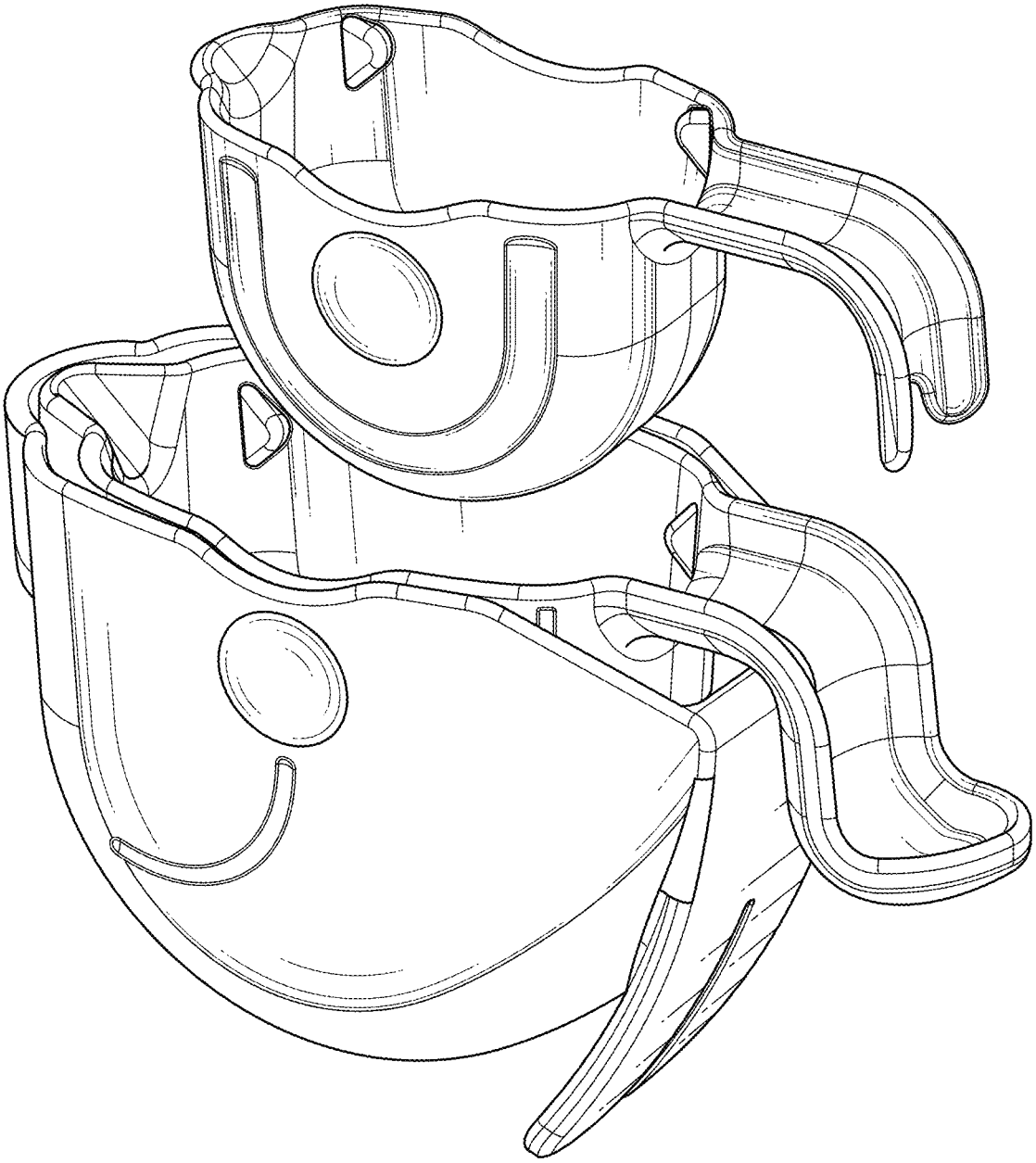

FIG. 154 is a perspective view of the bunny scoop of FIG. 112, the turtle scoop of FIG. 120, and the snail scoop of FIG. 128 stacking together.

Figure 70:
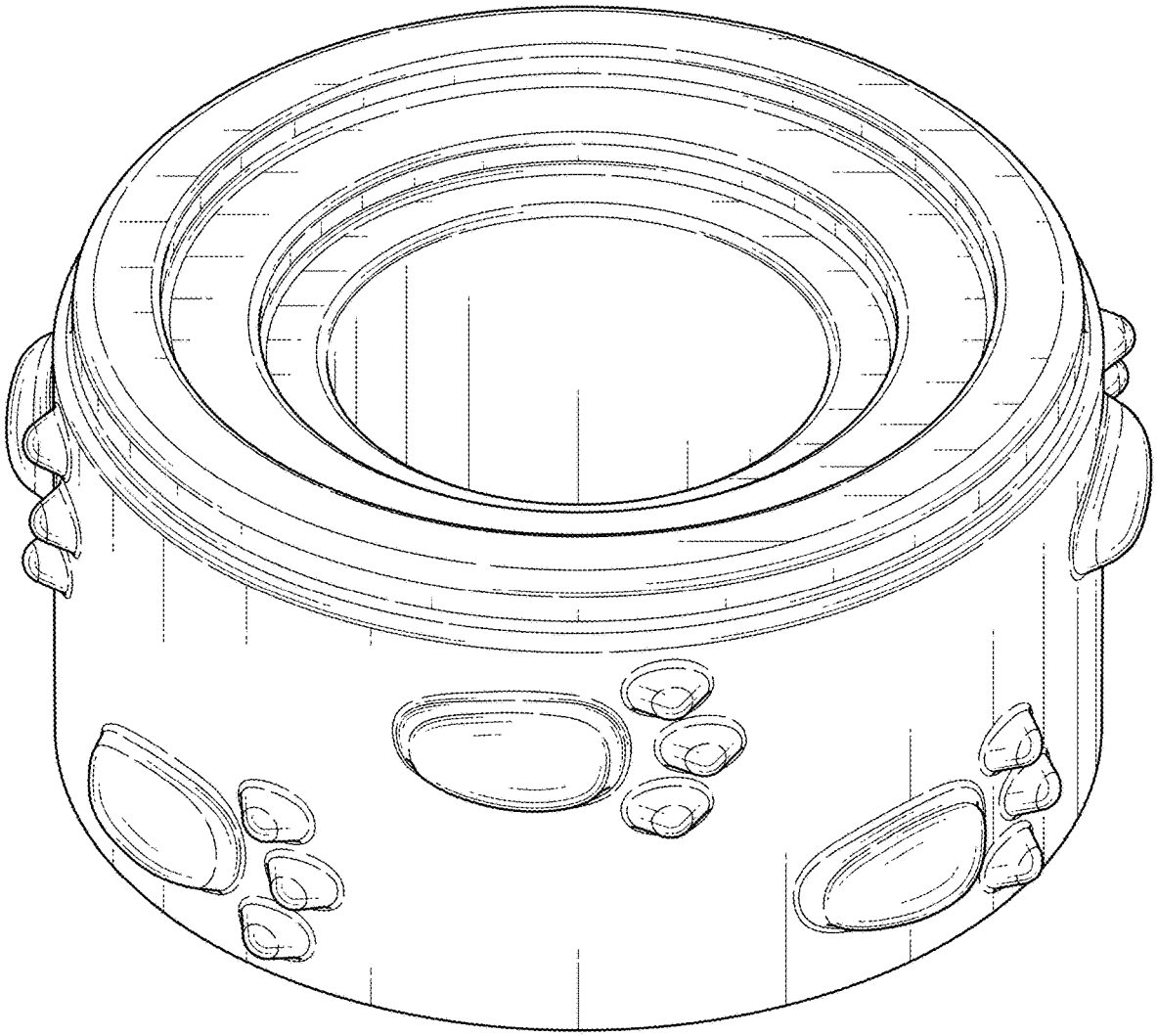
FIG. 70 is a perspective view of a large roller of a sensory table kit.
Figure 71:
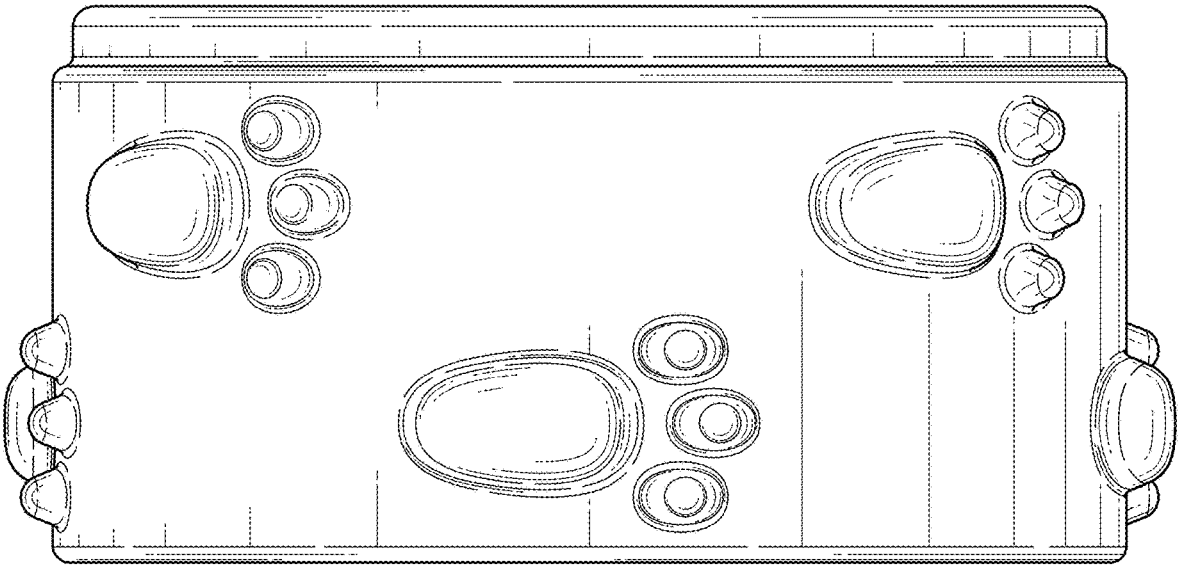
FIG. 71 is a front elevational view of the large roller of FIG. 70.
Figure 72:
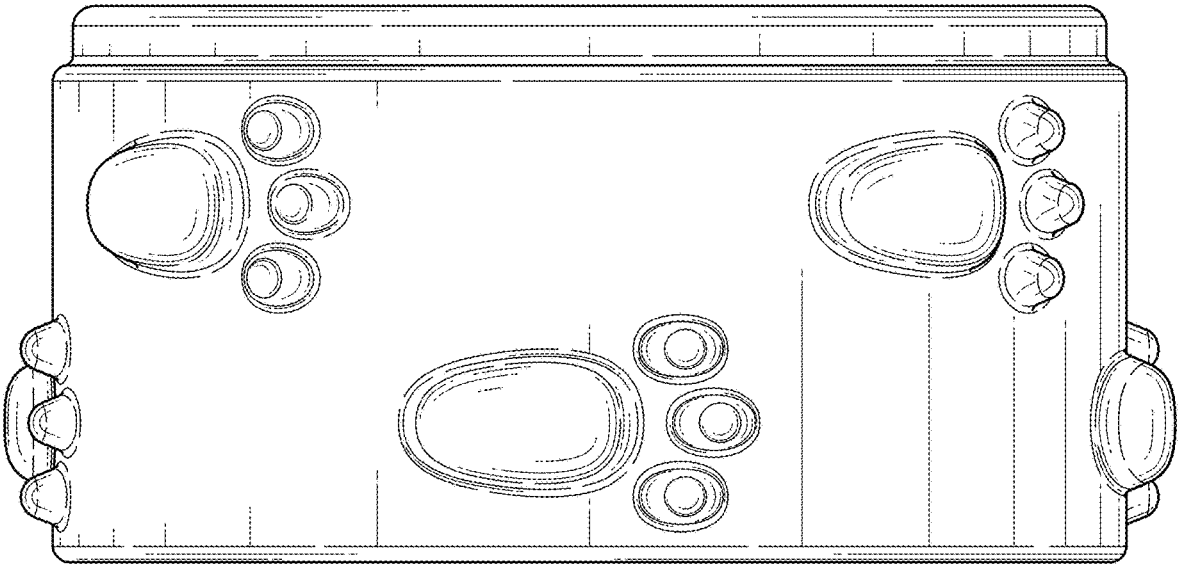
FIG. 72 is a rear elevational view of the large roller of FIG. 70.
Figure 73:
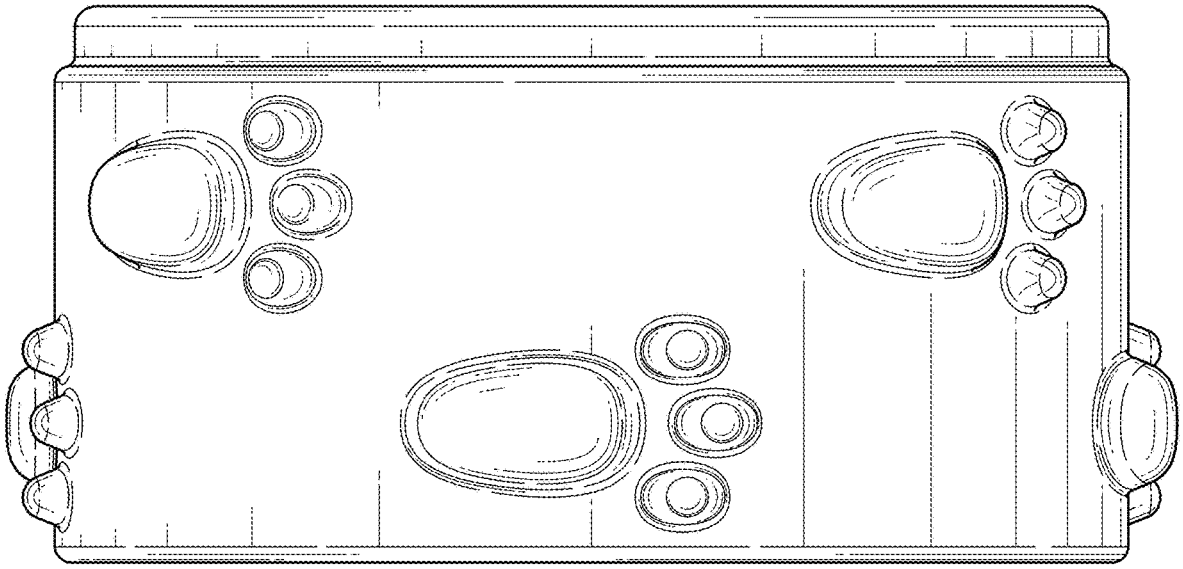
FIG. 73 is a left elevational view of the large roller of FIG. 70.
Figure 74:
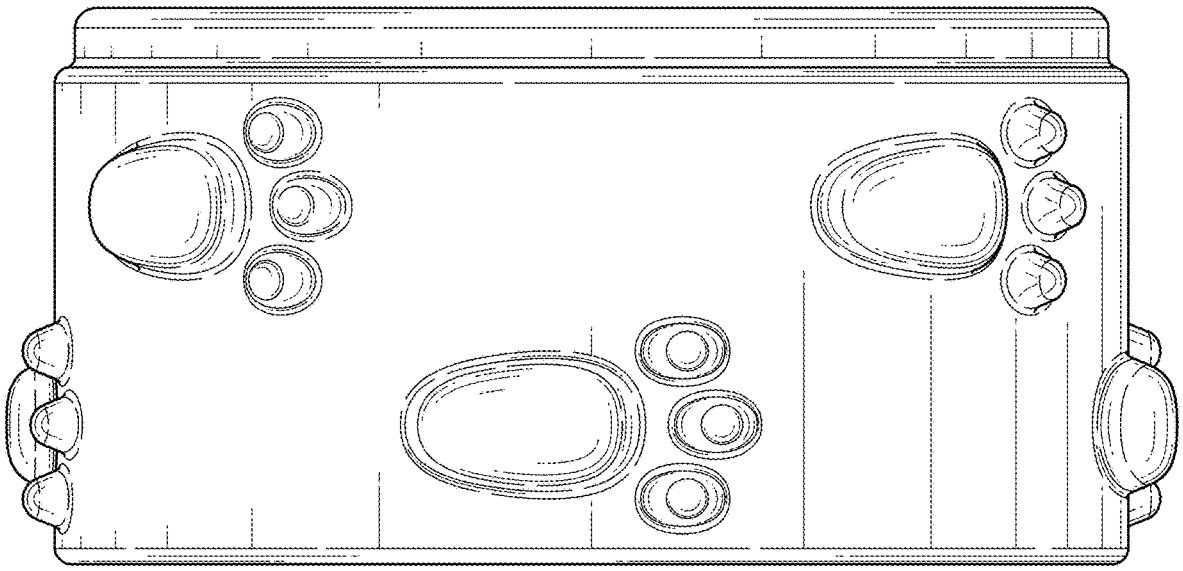
FIG. 74 is a right elevational view of the large roller of FIG. 70.
Figure 75:
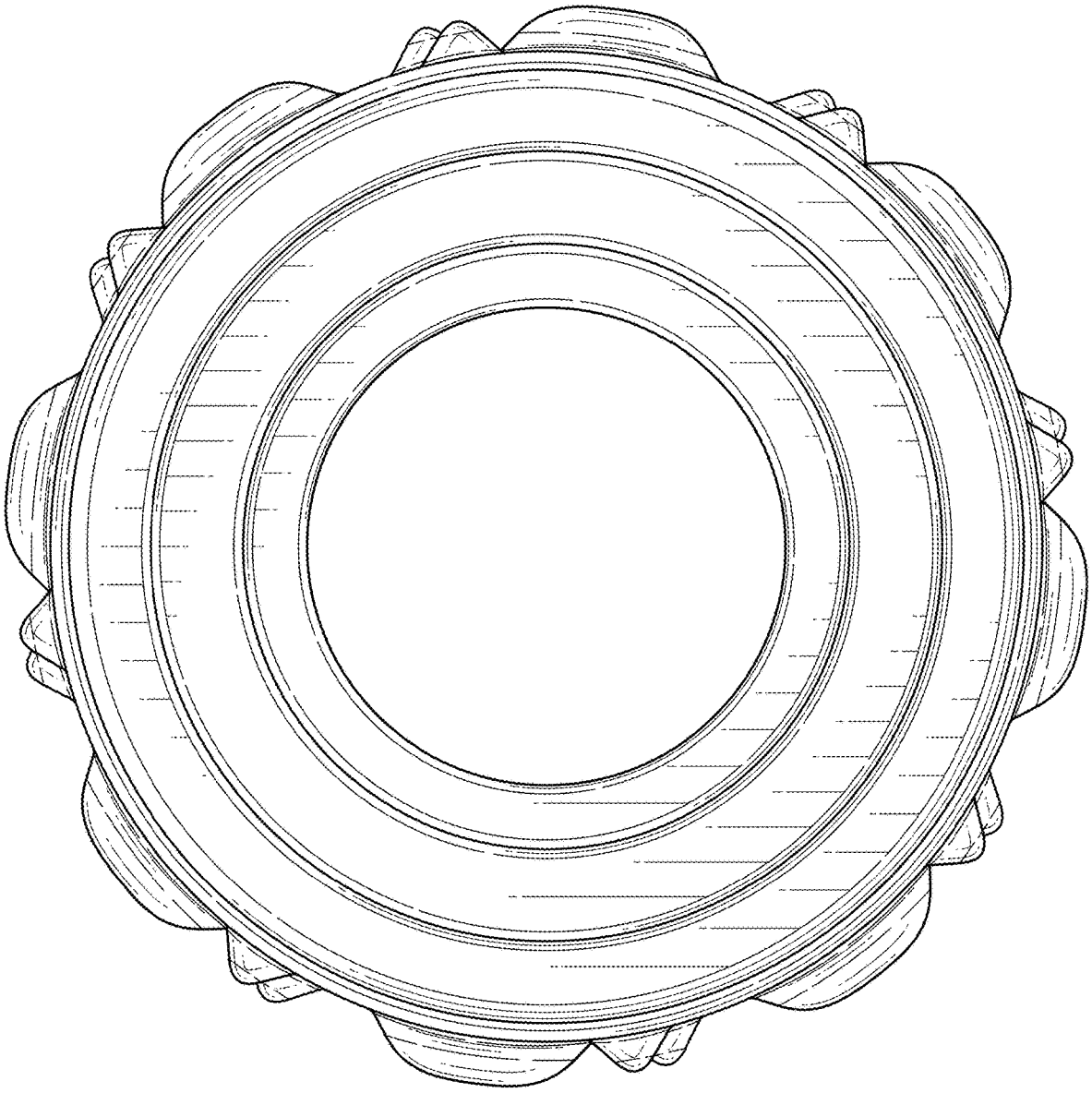
FIG. 75 is a top plan view of the large roller of FIG. 70.
Figure 76:
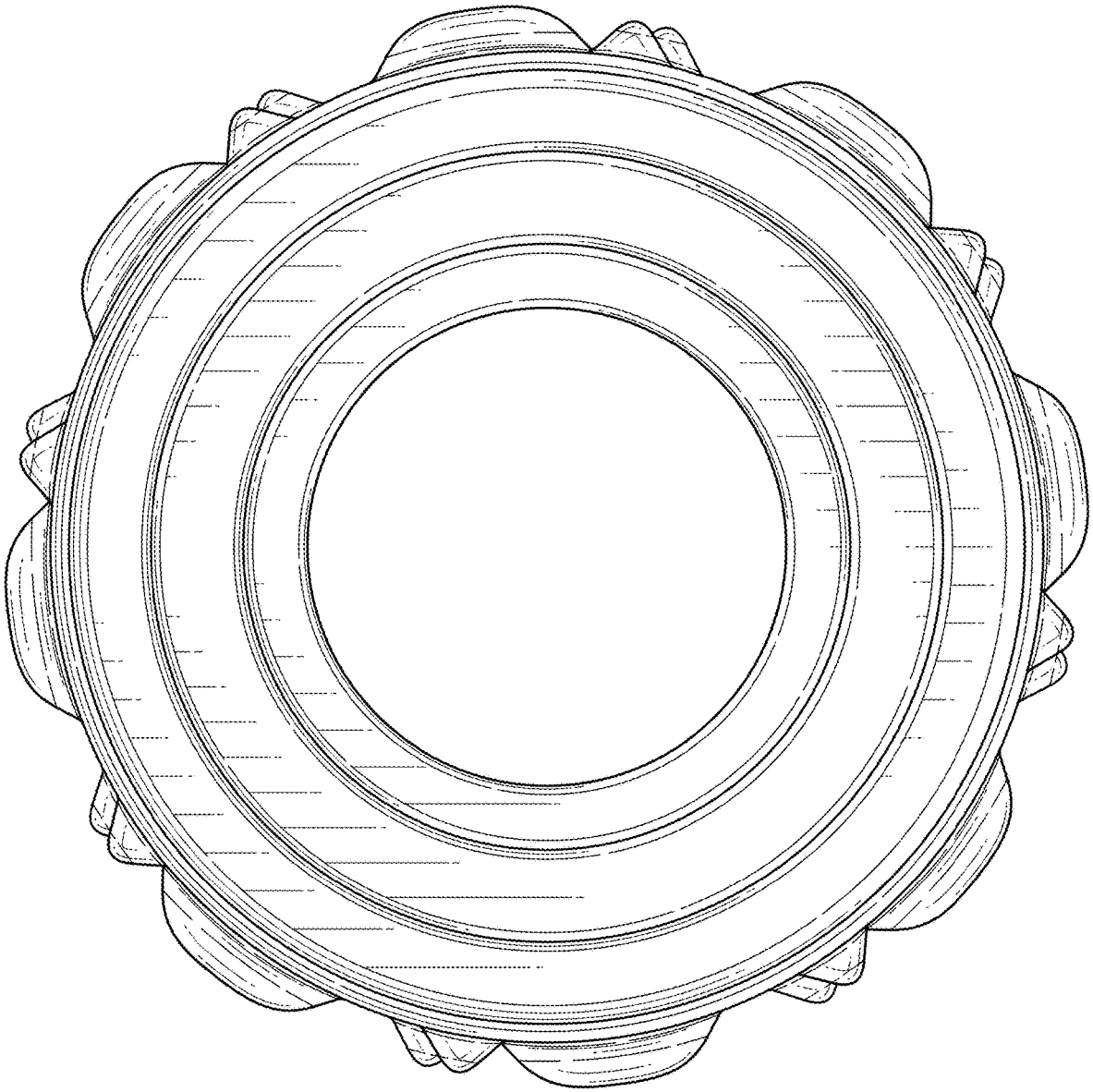
FIG. 76 is a bottom plan view of the large roller of FIG. 70.
Figure 155:
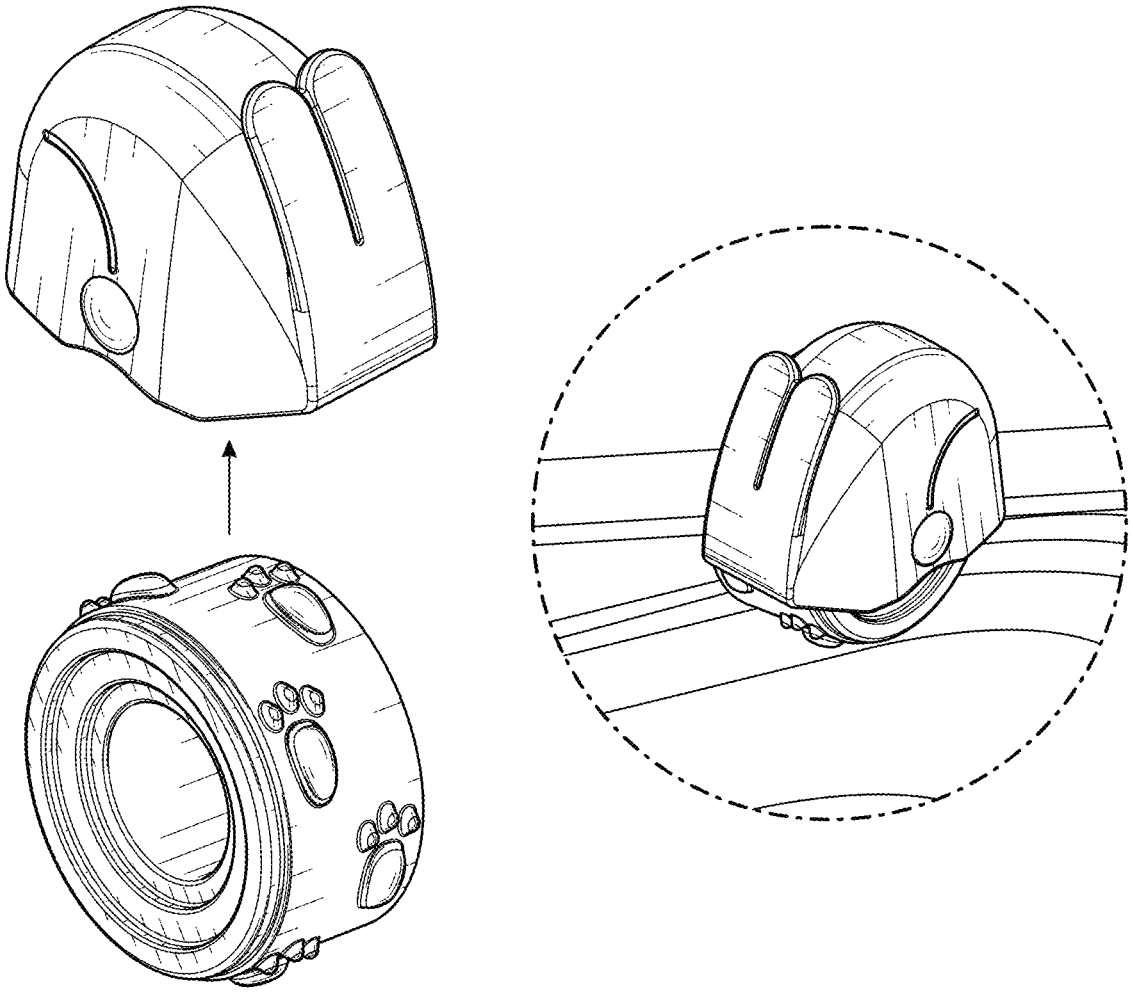

FIG. 155 is perspective view of the bunny scoop of FIG. 112 and the large roller of FIG. 70 stacking together.

Figure 48:
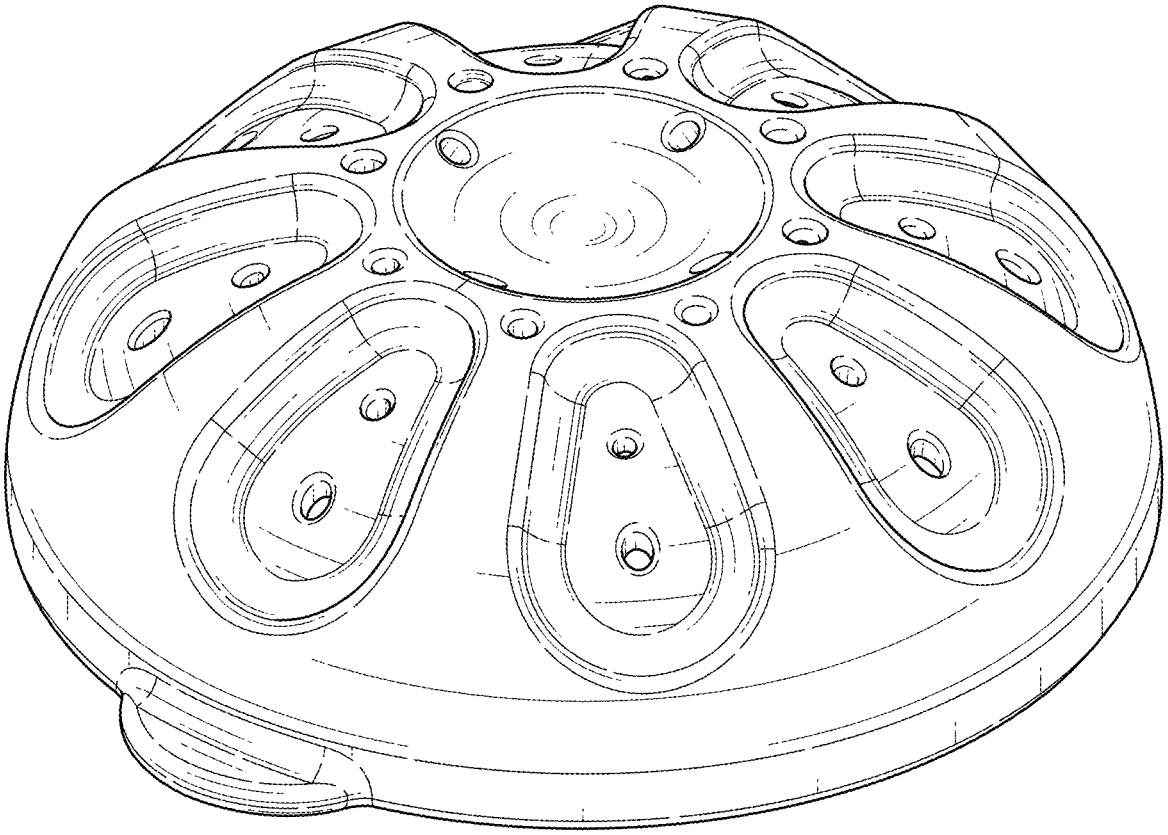
FIG. 48 is a top perspective view of a mushroom cap strainer of a sensory table kit.
Figure 56:
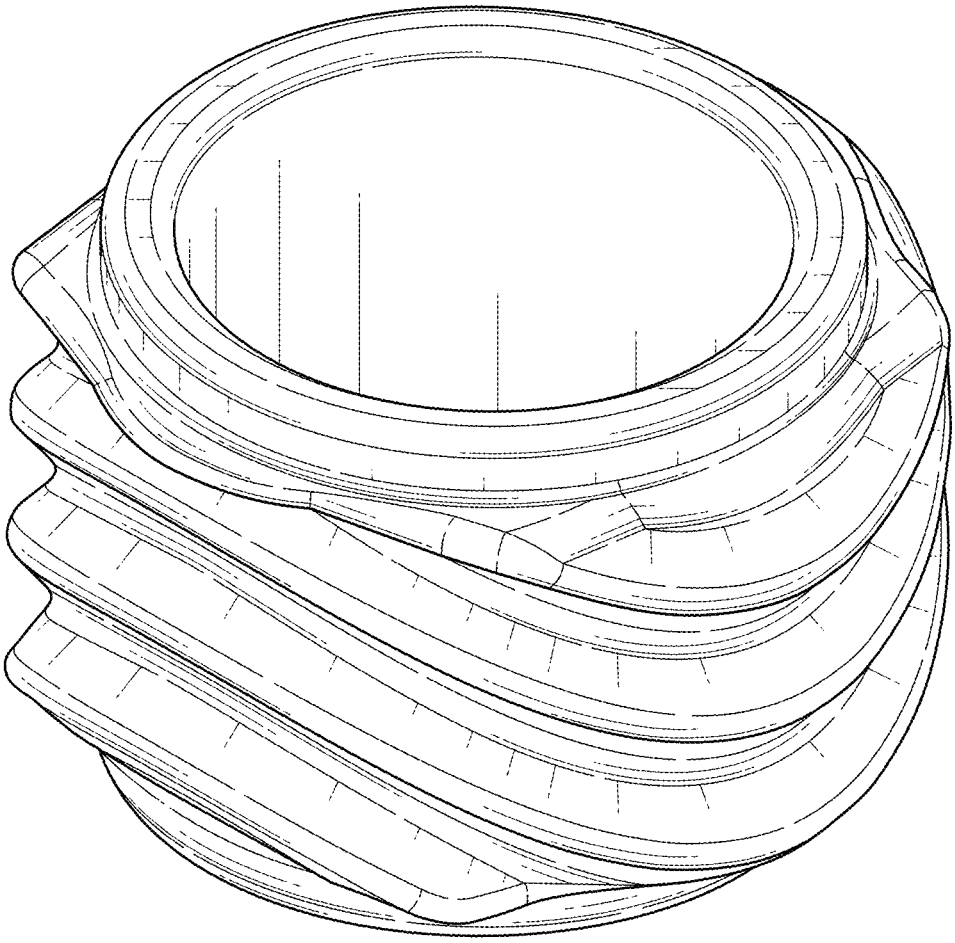
FIG. 56 is a perspective view of a small roller of a sensory table kit.
Figure 57:
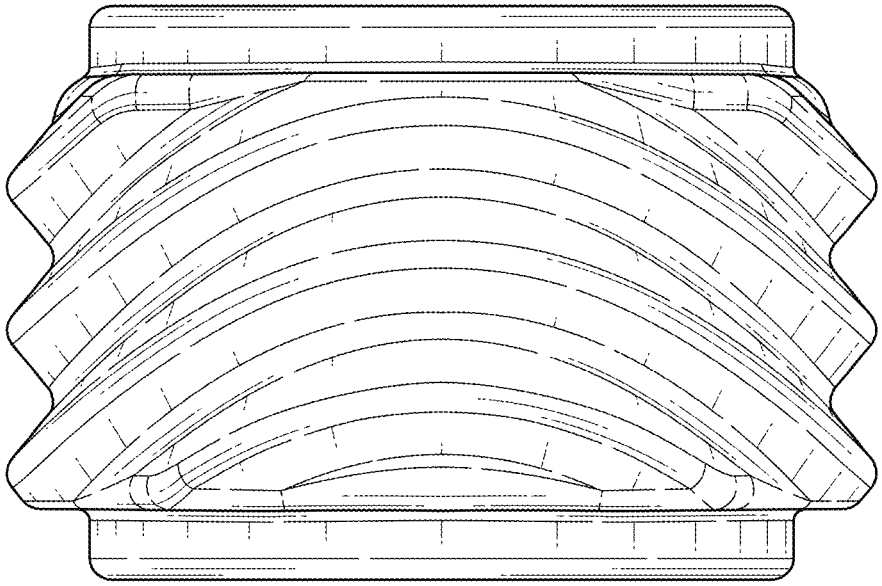
FIG. 57 is a front elevational view of the small roller of FIG. 56.
Figure 58:
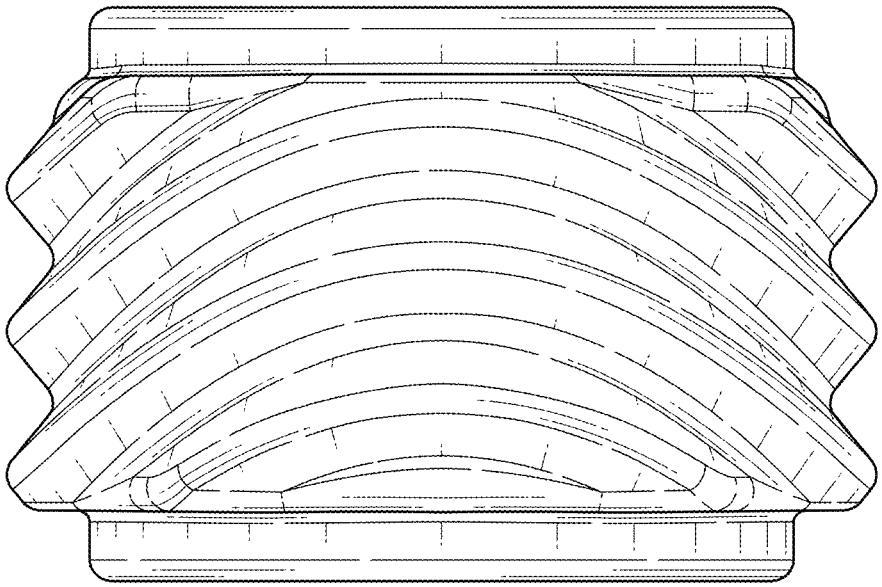
FIG. 58 is a rear elevational view of the small roller of FIG. 56.
Figure 59:
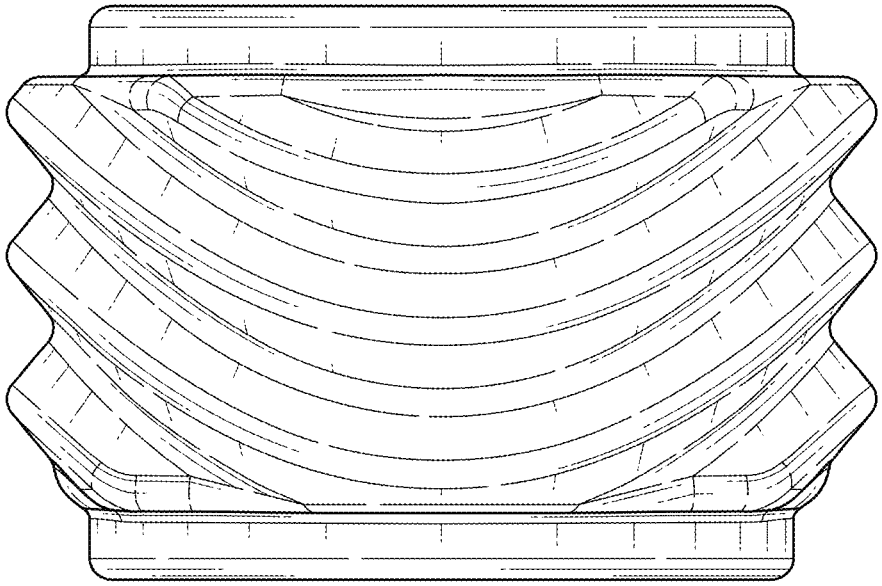
FIG. 59 is a left elevational view of the small roller of FIG. 56.
Figure 60:
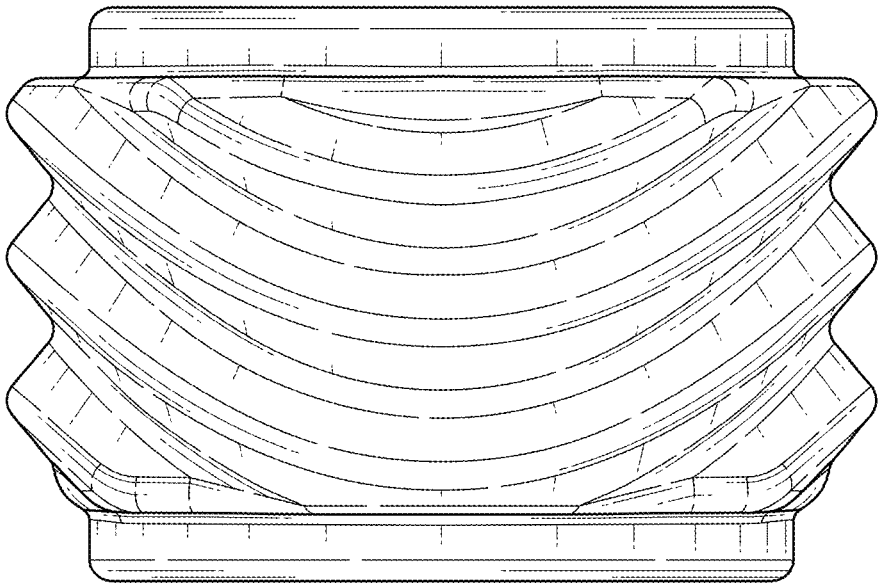
FIG. 60 is a right elevational view of the small roller of FIG. 56.
Figure 61:
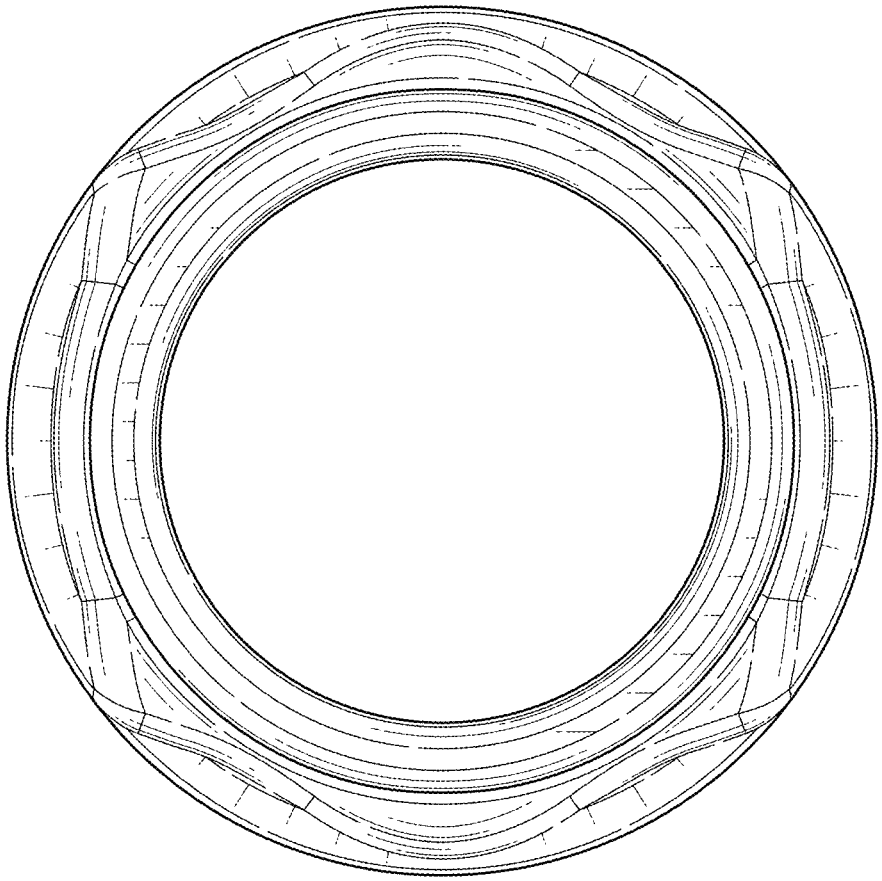
FIG. 61 is a top plan view of the small roller of FIG. 56.
Figure 62:
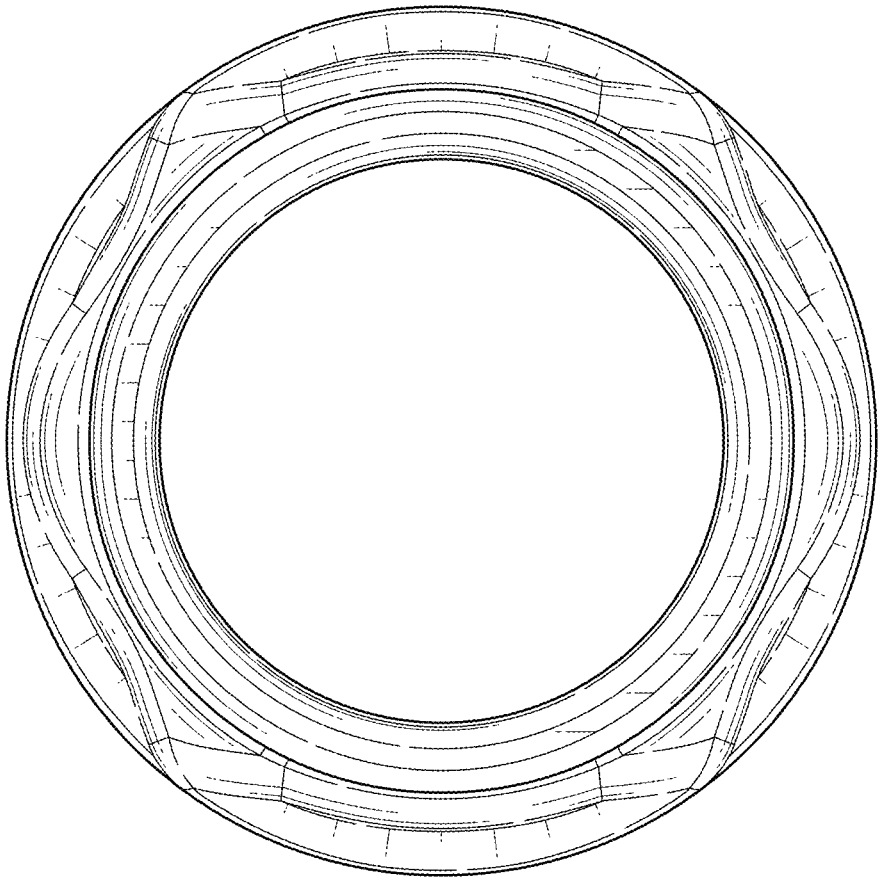
FIG. 62 is a bottom plan view of the small roller of FIG. 56.
Figure 63:
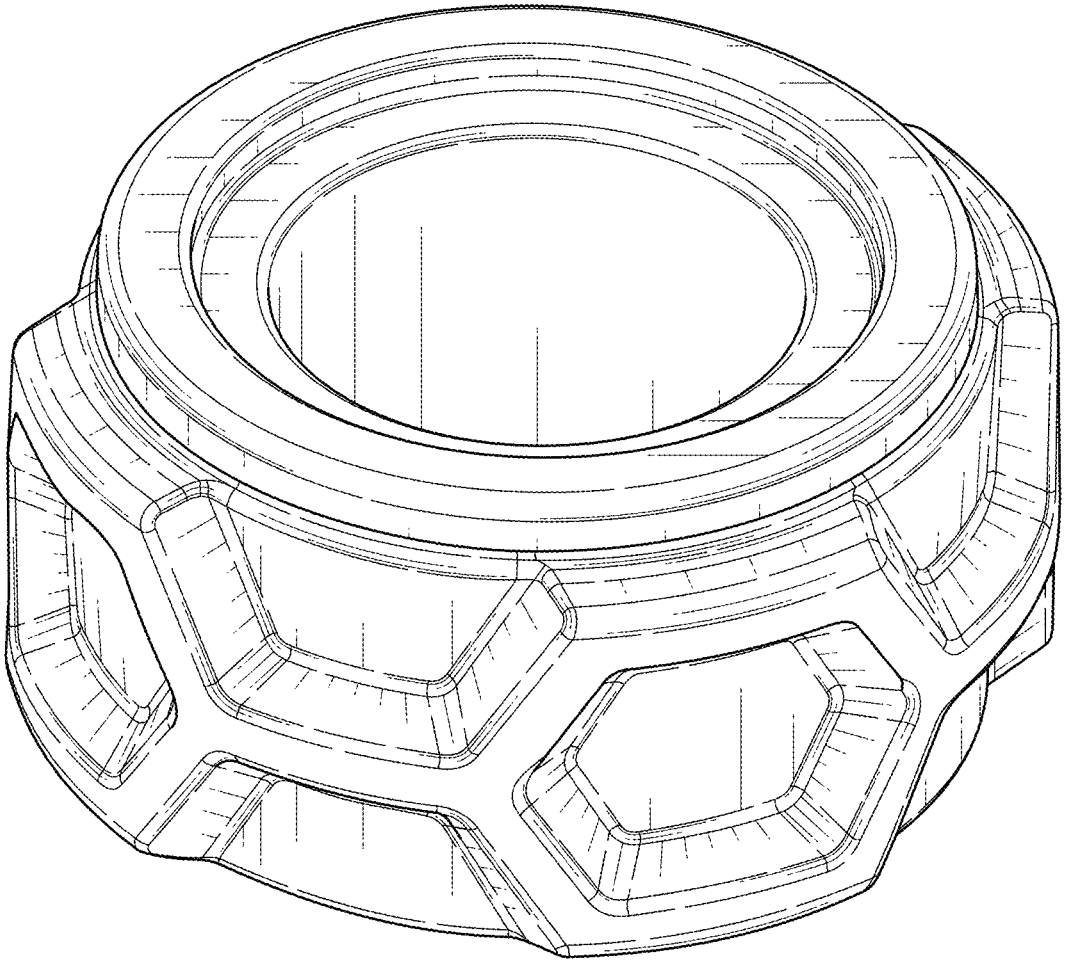
FIG. 63 is a perspective view of a medium roller of a sensory table kit.
Figure 64:
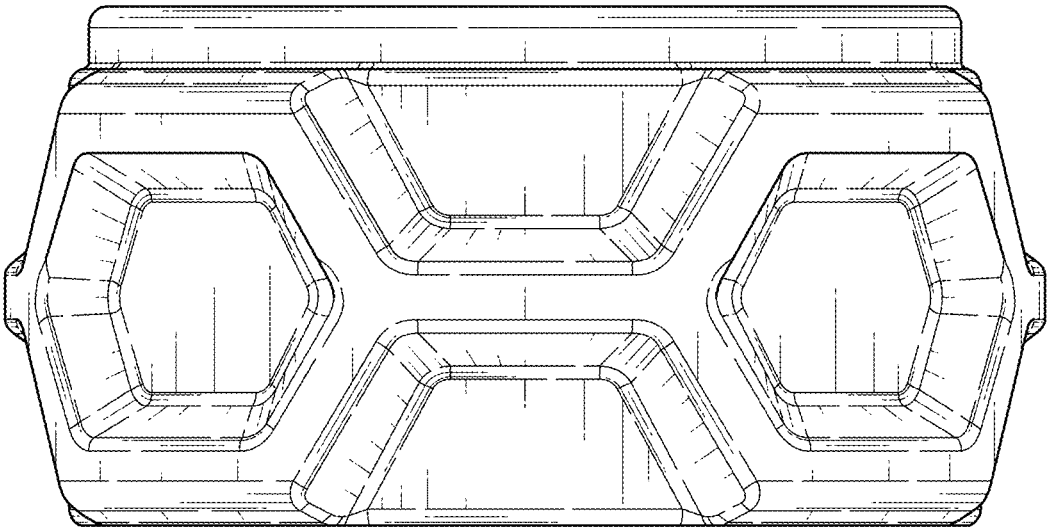
FIG. 64 is a front elevational view of the medium roller of FIG. 63.
Figure 65:
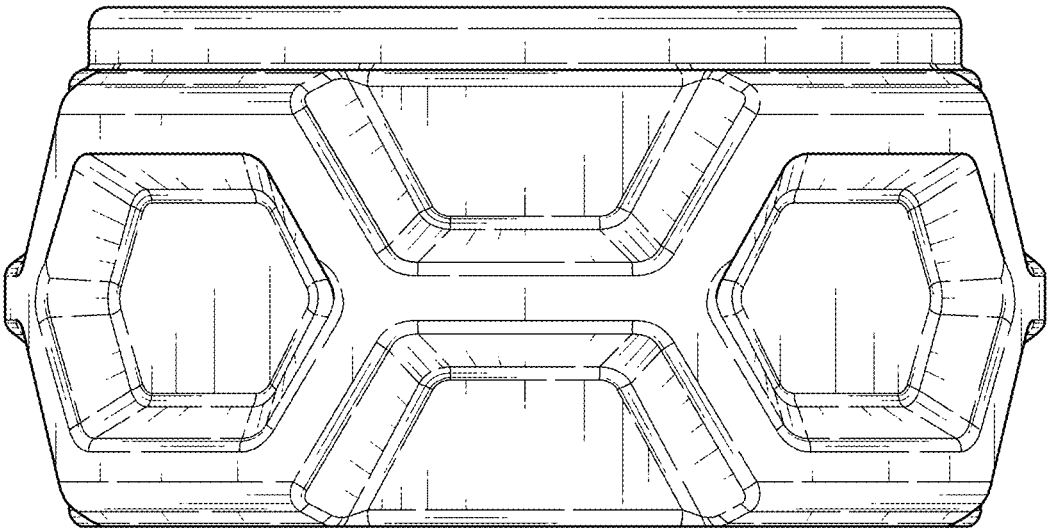
FIG. 65 is a rear elevational view of the medium roller of FIG. 63.
Figure 66:
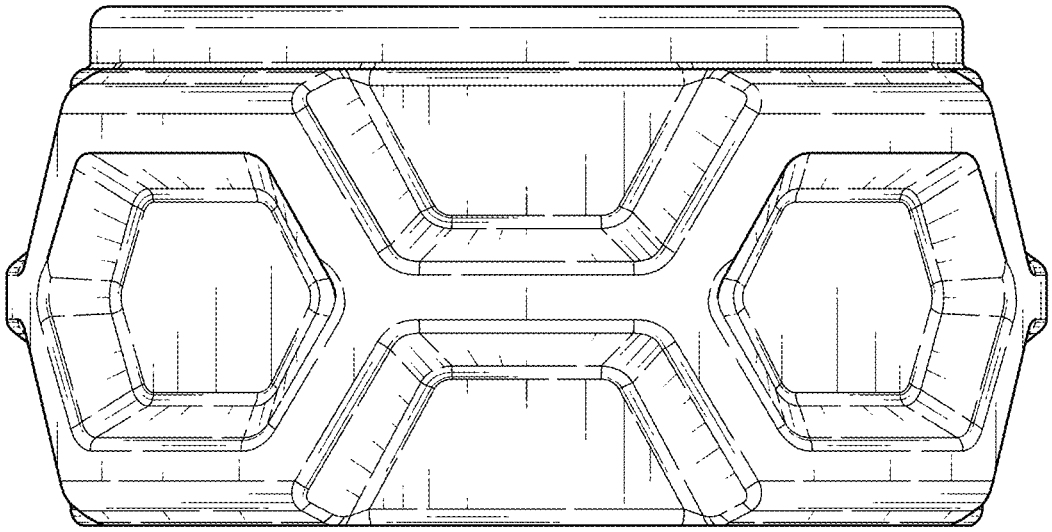
FIG. 66 is a left elevational view of the medium roller of FIG. 63.
Figure 67:
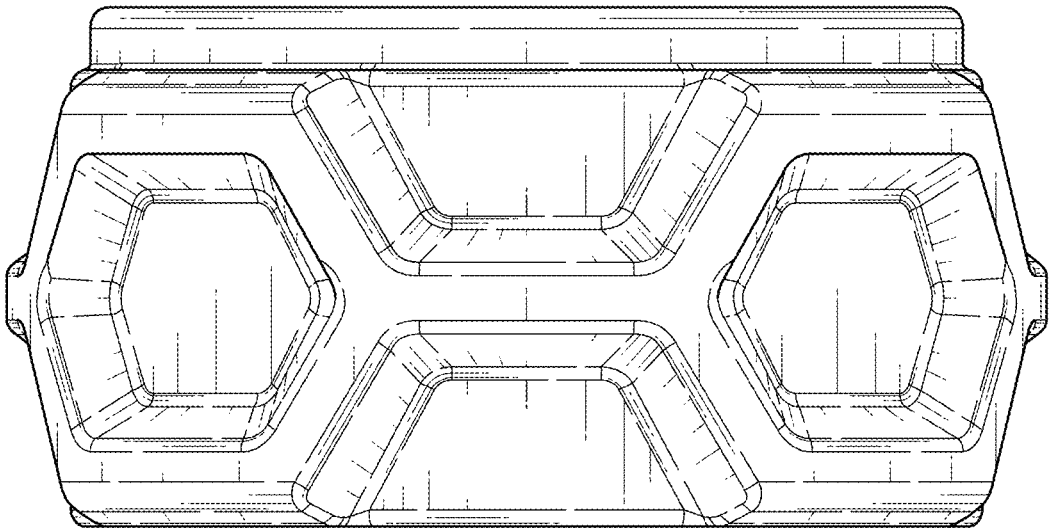
FIG. 67 is a right elevational view of the medium roller of FIG. 63.
Figure 68:
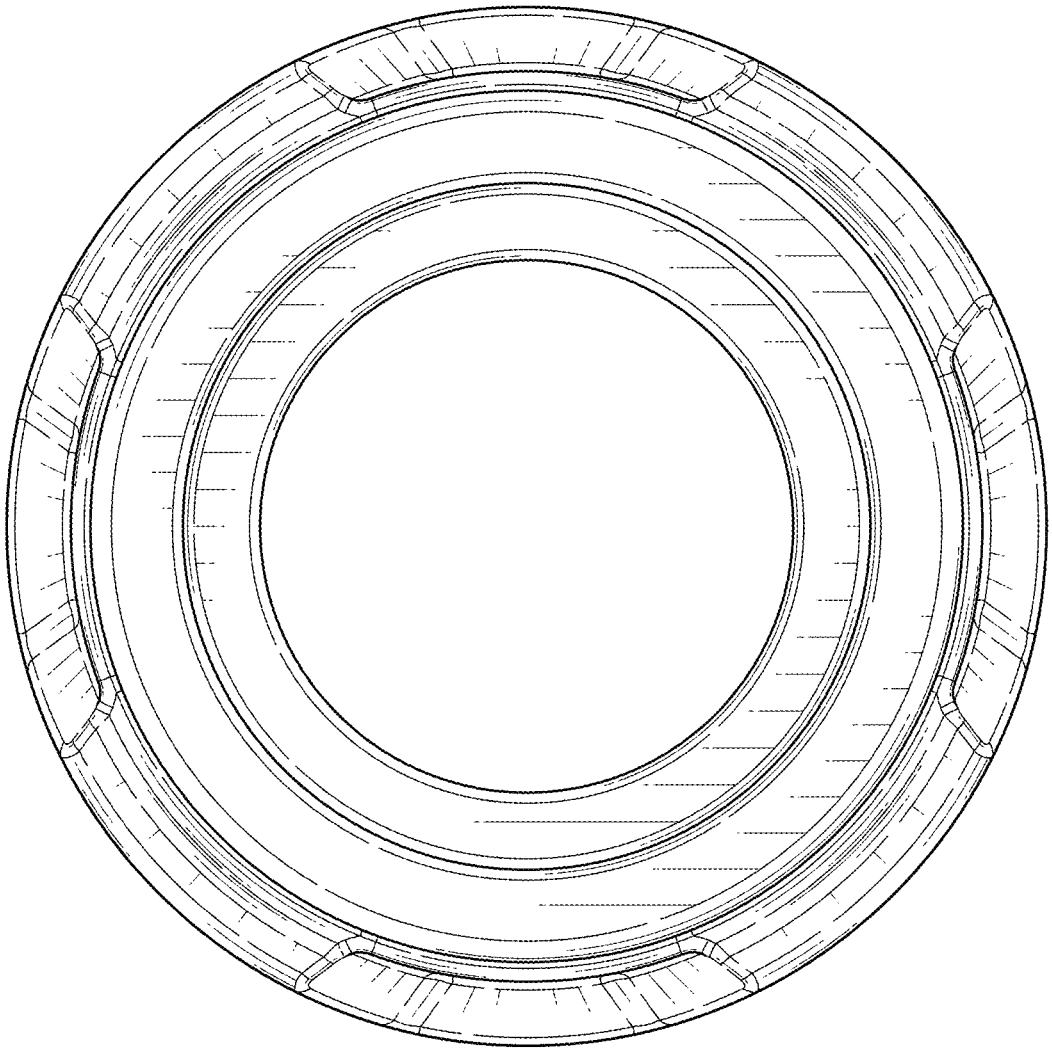
FIG. 68 is a top plan view of the medium roller of FIG. 63.
Figure 69:
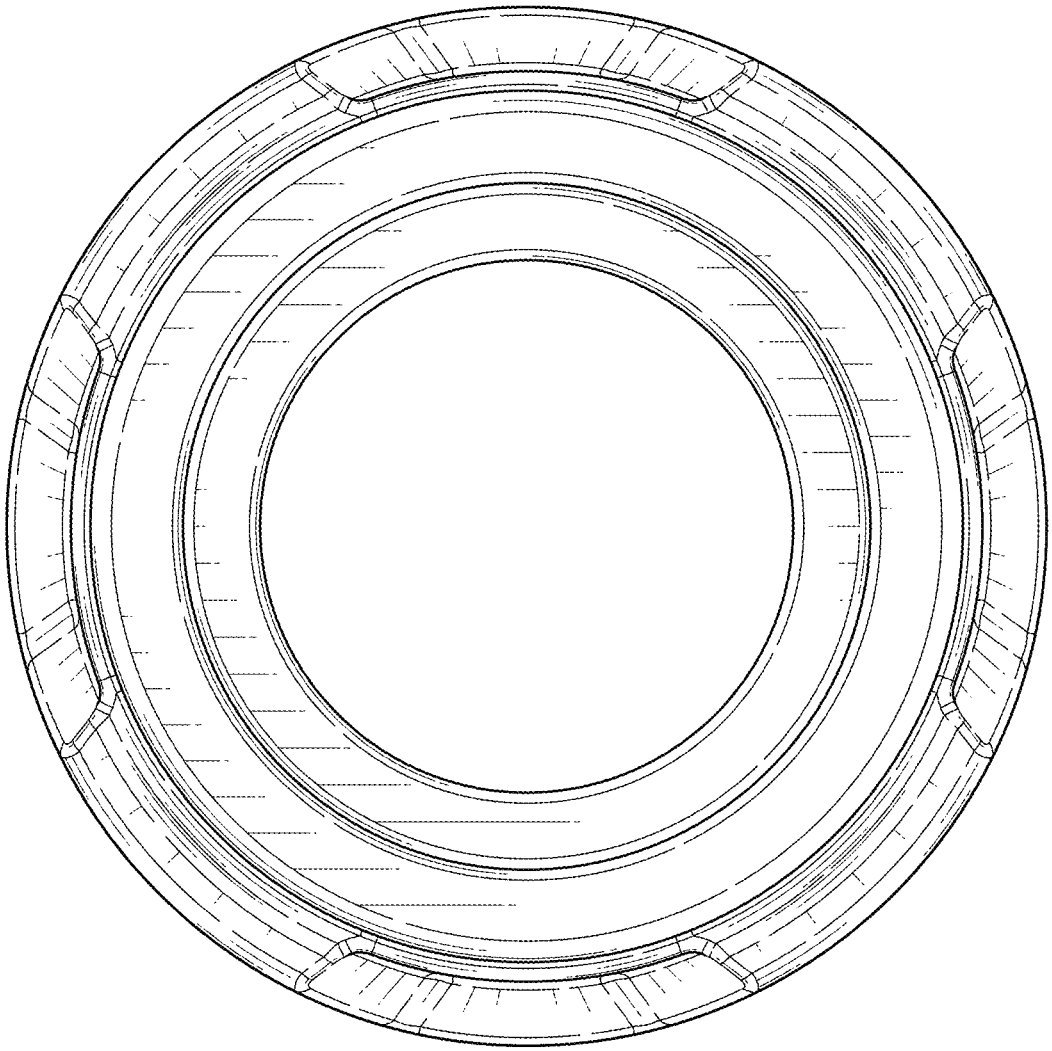
FIG. 69 is a bottom plan view of the medium roller of FIG. 63.
Figure 156:
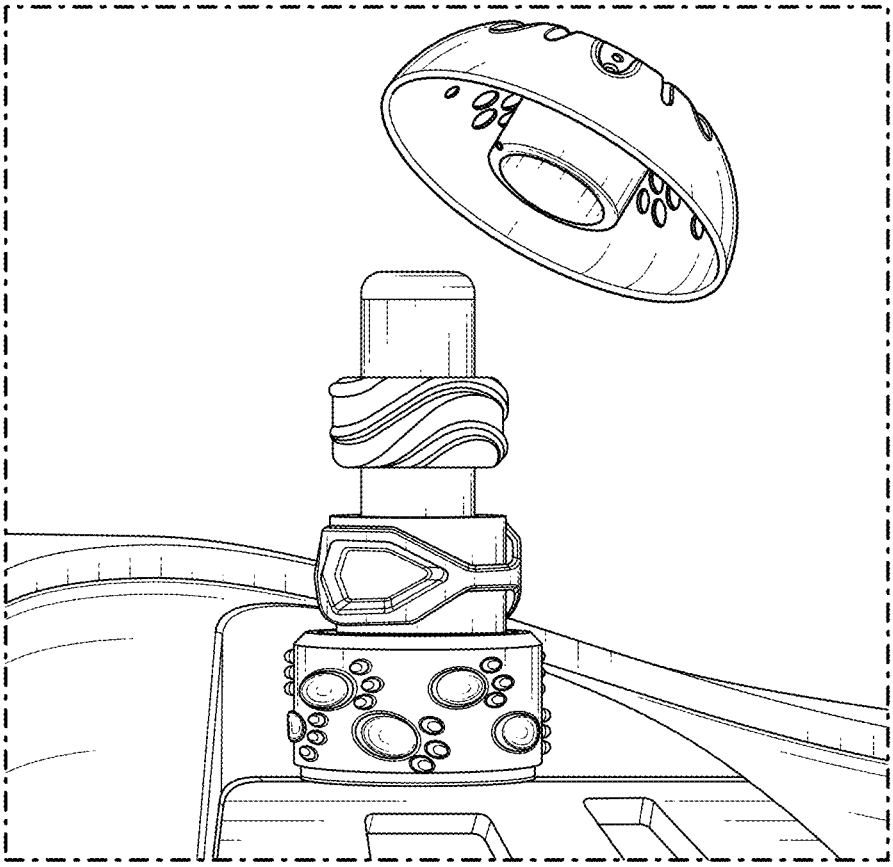

FIG. 156 is a perspective view of the small roller of FIG. 56, the medium roller of FIG. 63, the large roller of FIG. 70, and the mushroom cap strainer of FIG. 48 stacking together.

Figure 157:
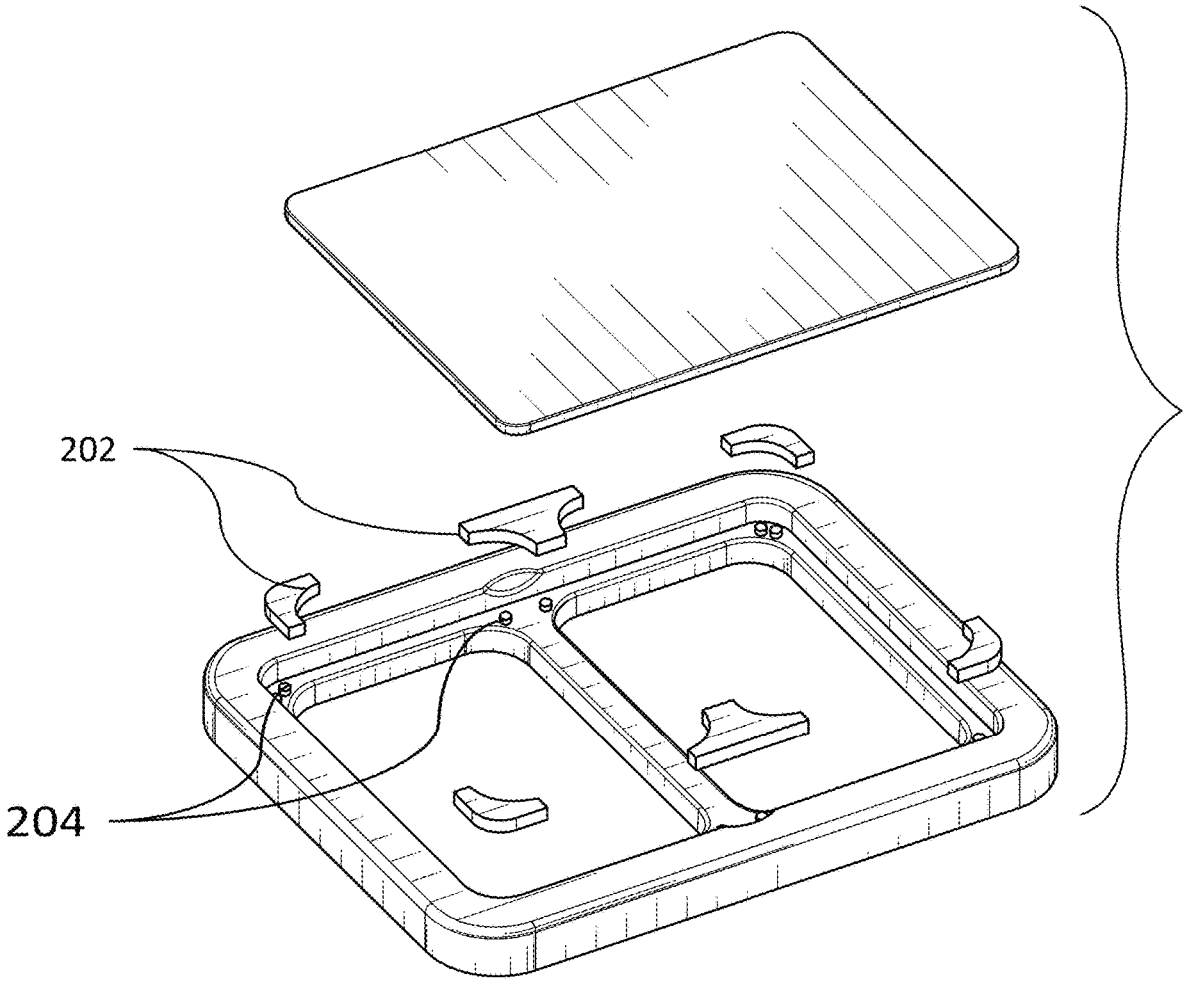

FIG. 157 is a partial top perspective view of a sensory table having inserts for positioning between a sensory table ledge and a lid.

Figure 158:
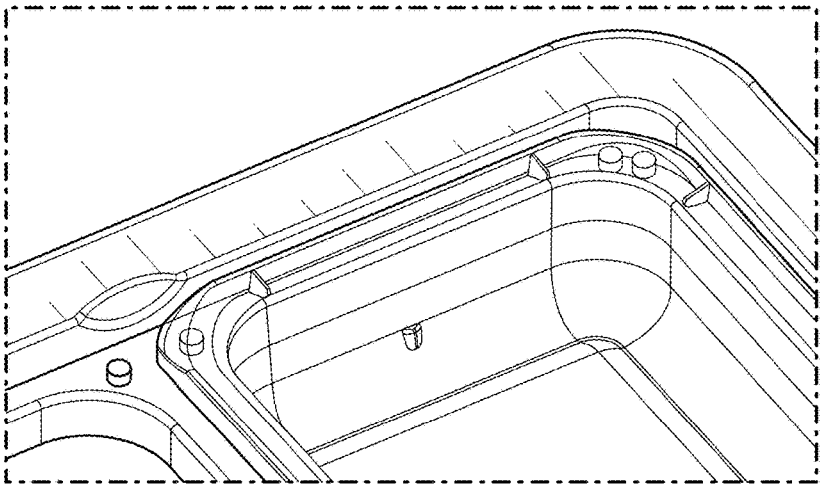

FIG. 158 is a partial top perspective view of a bin without passthrough openings fitting onto posts of a sensory table.

Figure 159:
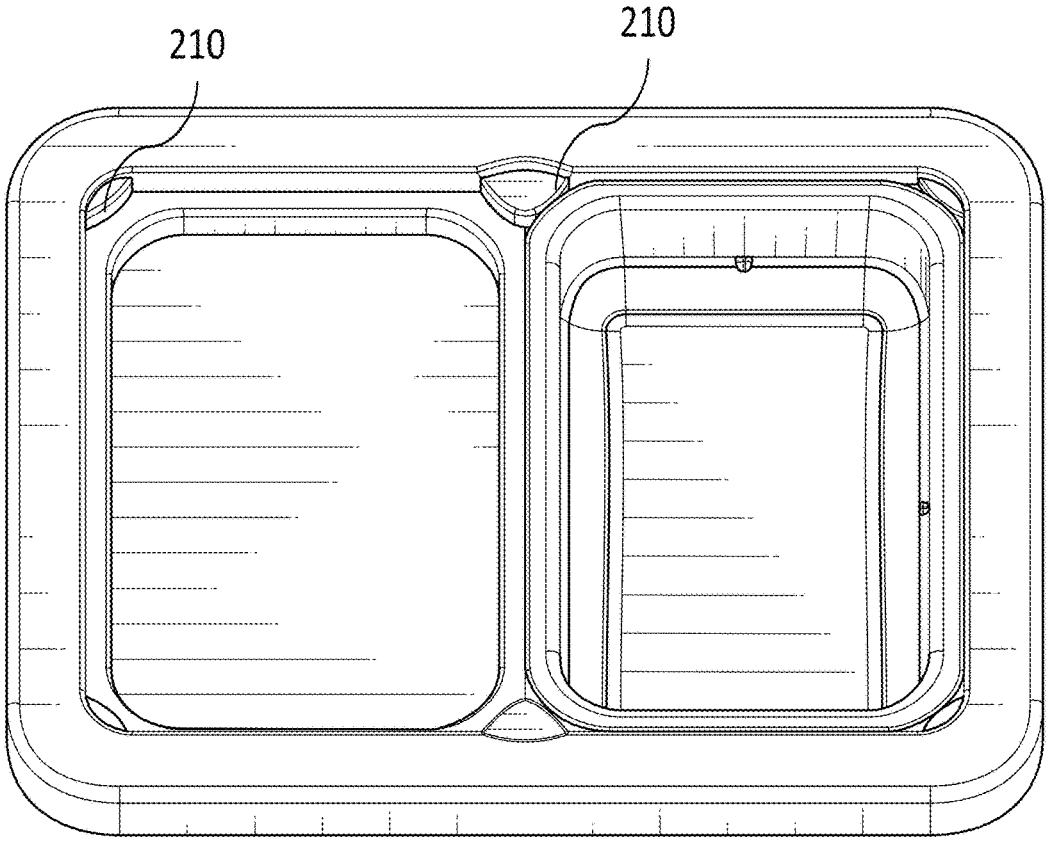

FIG. 159 is a top perspective view of a bin nesting within a sensory table ledge.

Figure 160:
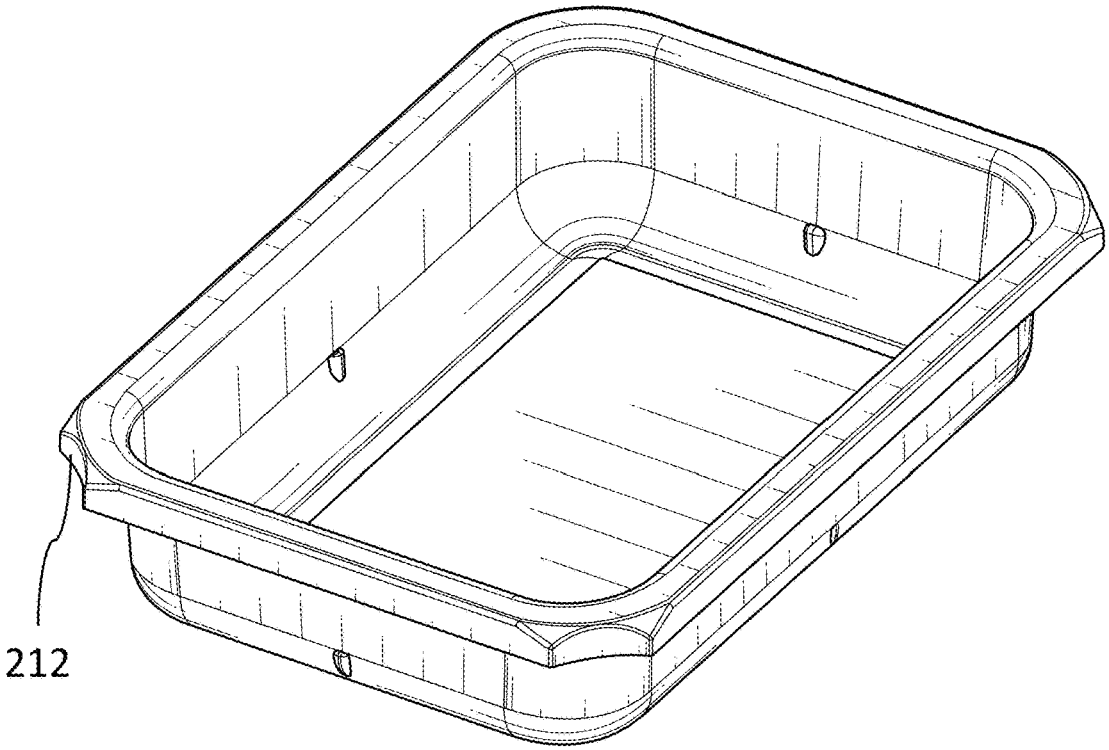

FIG. 160 is a top perspective view of the bin of FIG. 159.

Figure 161:
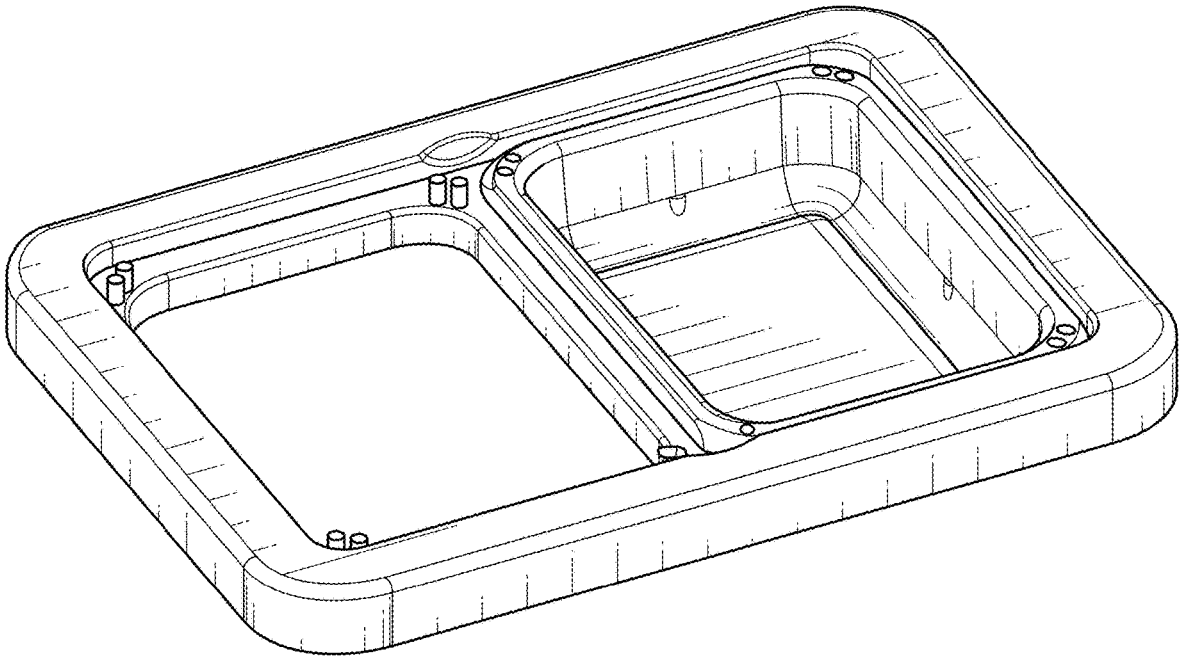

FIG. 161 is a top perspective view of a bin with multiple passthrough openings in each corner of the bin for multiple posts of a sensory table.

Figure 162:
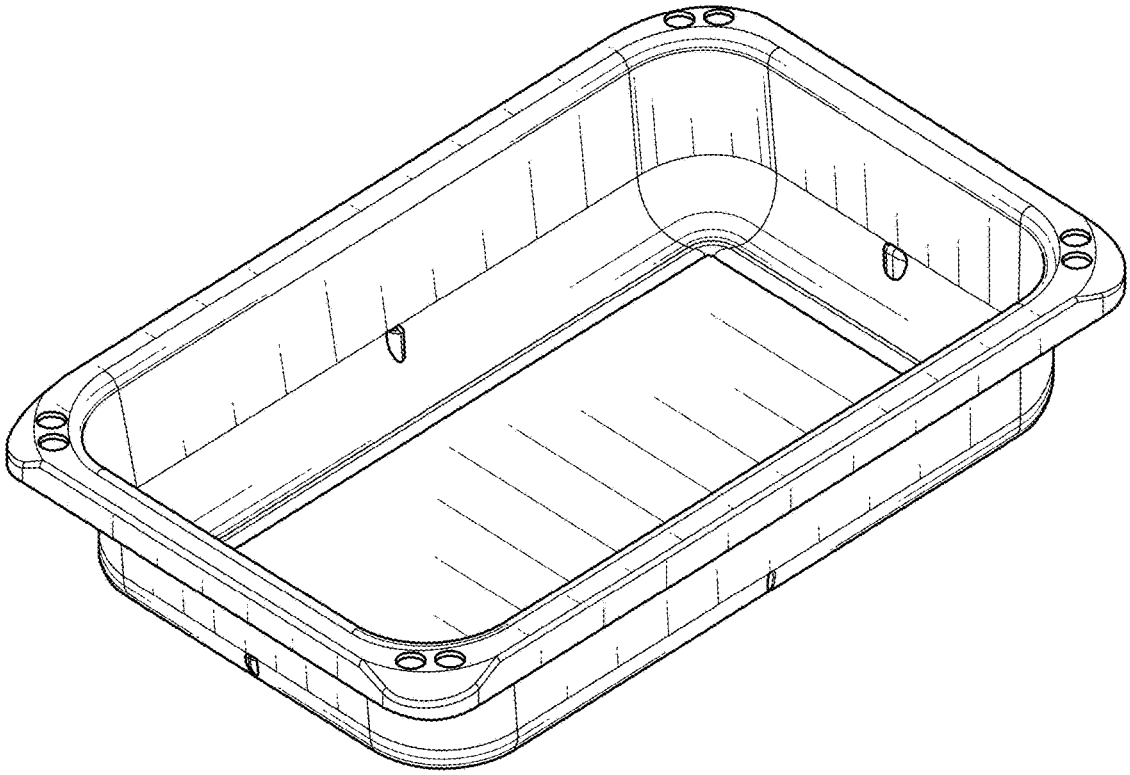

FIG. 162 is a top perspective view of the bin of FIG. 161.

DETAILED DESCRIPTION

Reference will now be made in detail to various embodiments, examples of which are illustrated in the accompanying drawings. While this disclosure includes certain embodiments, it will be understood the disclosure is not intended to limit the claims to these embodiments. On the contrary, the disclosure is intended to cover alternatives, modifications and equivalents, which may be included within the spirit and scope of the claims. Furthermore, in this detailed description, numerous specific details are set forth in order to provide a thorough understanding. However, one of ordinary skill in the art will appreciate that the subject matter of the present disclosure may be practiced without these specific details. In other instances, well known methods, procedures, and components have not been described in detail as not to unnecessarily obscure aspects of the present disclosure.

Various embodiments described herein relate to a sensory table and pieces thereof that may be included as a sensory table kit. A sensory table may be used in one mode as a table when one or more lids are placed in the table. When the one or more lids are removed, one or more removable bins may be exposed. The one or more bins may be capable of storing accessories, toys, or other items when the one or more bins or the accessories/toys are not in use (e.g., items may be stored in the bins under the tabletop lids while the lids are in place and the sensory table functions as a table). When the lids are removed, the toys/accessories may be played with by a child or other user in or outside of the one or more bins. The one or more bins may also be filled with any solid or liquid for a child to interact with, sense, and play with. For example, a bin may be filled with water, sand, etc. The toys or accessories included with the sensory table may further be used to interact with and play with the water, sand, and/or other medium placed in the one or more bins. Advantageously, the lids of the various embodiments described herein may further be in place for a table mode even if the bins are not placed in the sensory table. That is, the lids of various embodiments may be used to have the sensory table function in a table mode whether the bins are present or not. This may, for example, allow for the table to continue being used in table mode if the bins are being cleaned and not currently stowed in the sensory table.

As described herein, various embodiments of the sensory tables described herein may include a post or other feature that supports the lids whether or not the bins are present. Further, in various embodiments, those posts or other features that support the lid for a table mode may further interact with a corresponding feature of one or more bins to further secure the bins in place within the sensory table when the bins are present (e.g., when the user has not removed the bins from the sensory table). As such, the posts or other structural elements of the sensory table that supports the lid or lids may further serve an advantageous second purpose of also securing the bins in place within the sensory table.

Figure 1:
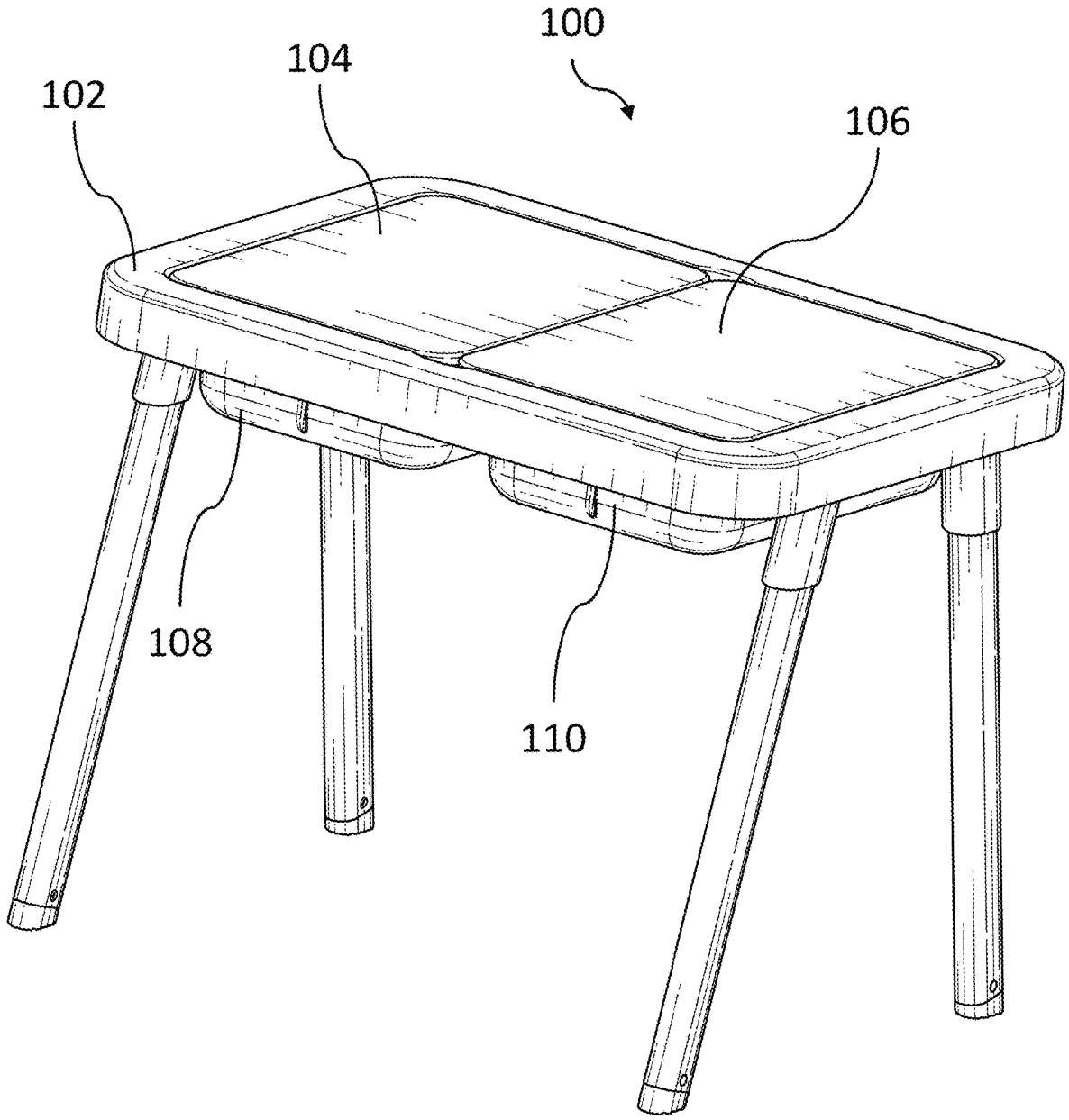
FIG. 1 is a top perspective view of a sensory table having two bins and two lids.
Figure 2:
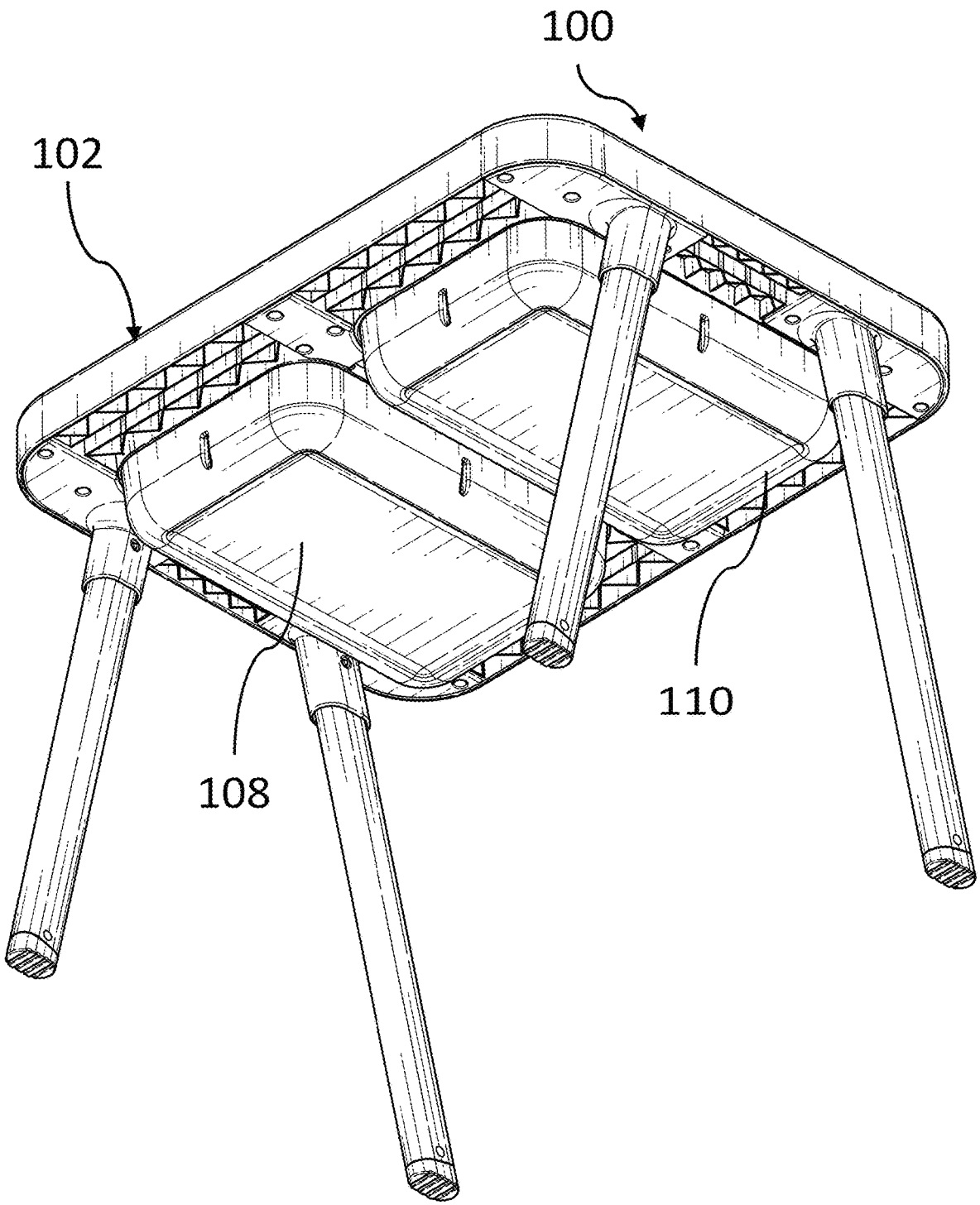
FIG. 2 is a bottom perspective view of the sensory table of FIG. 1.
Figure 3:
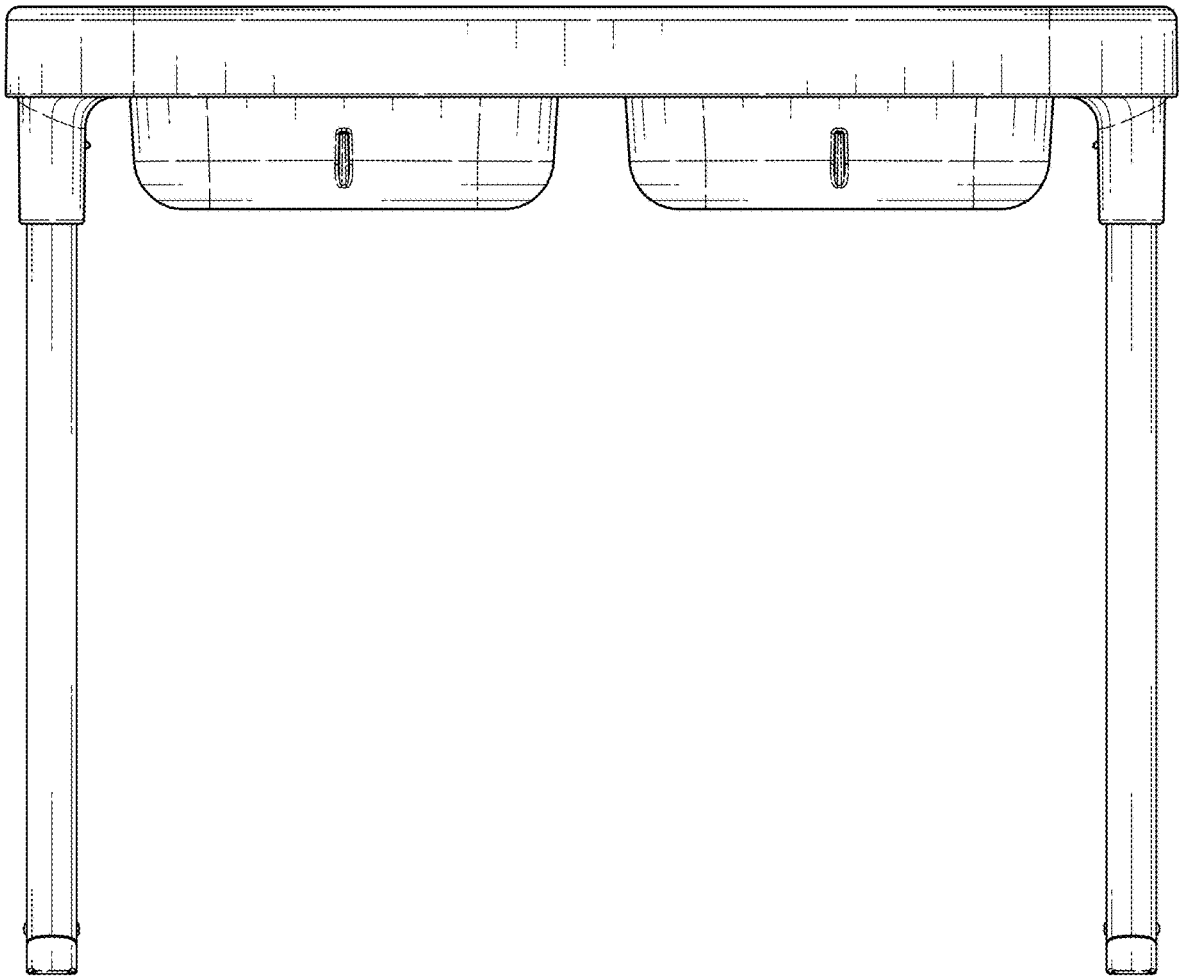
FIG. 3 is a front elevational view of the sensory table of FIG. 1.
Figure 4:
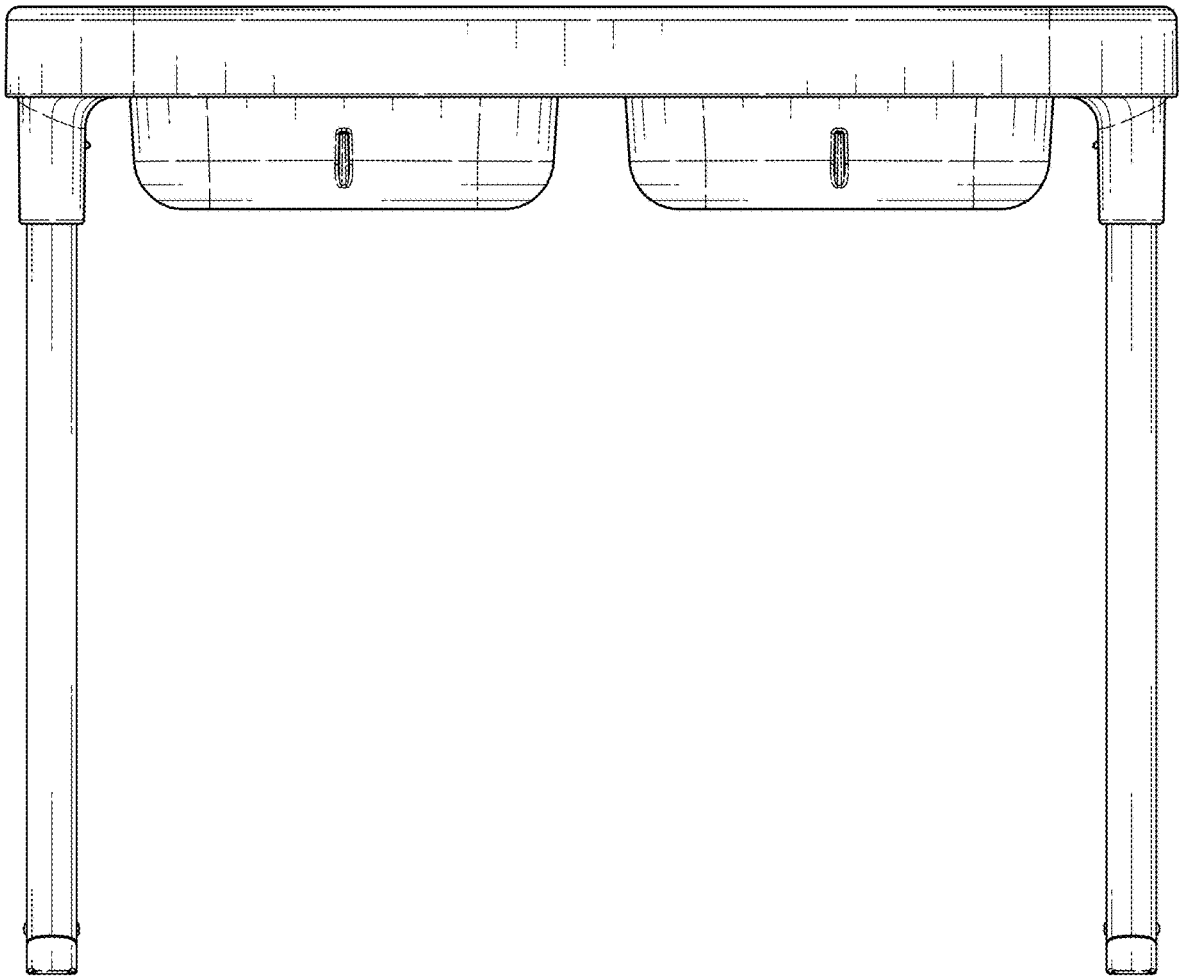
FIG. 4 is a rear elevational view of the sensory table of FIG. 1.
Figure 5:
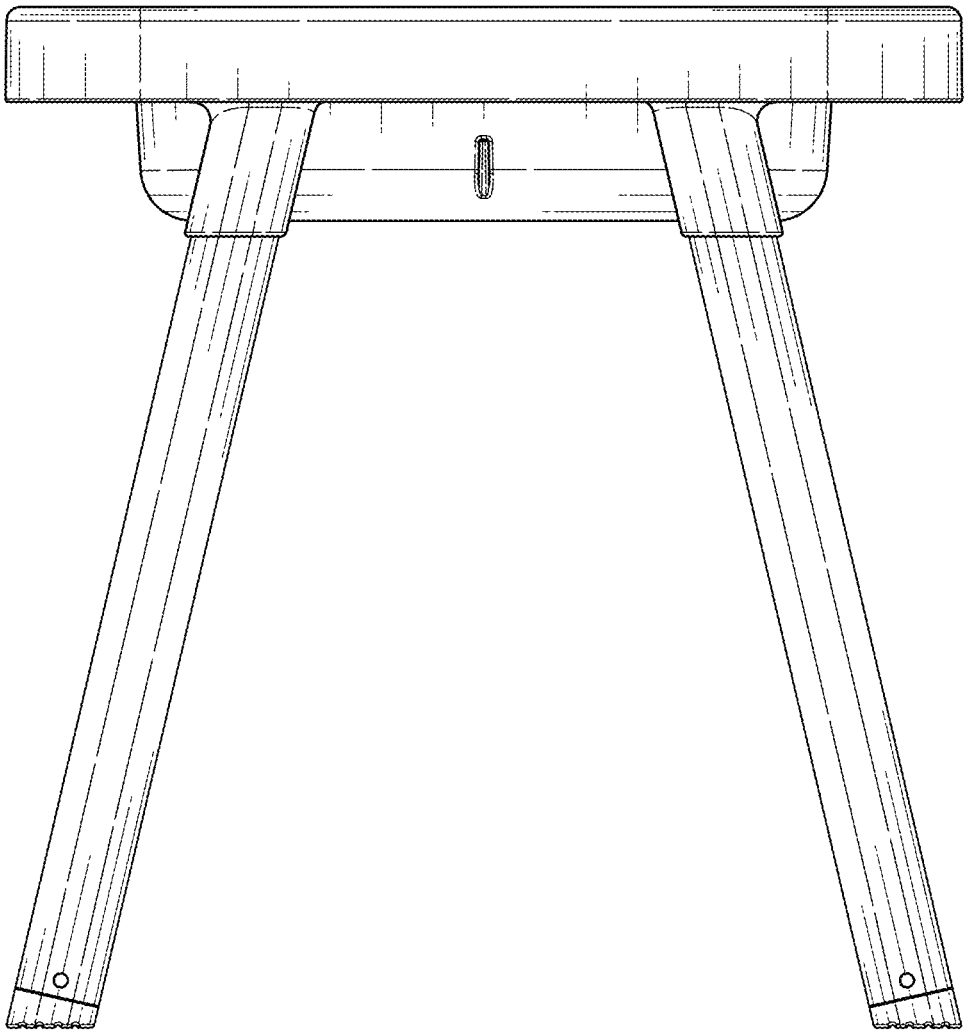
FIG. 5 is a left elevational view of the sensory table of FIG. 1.
Figure 6:
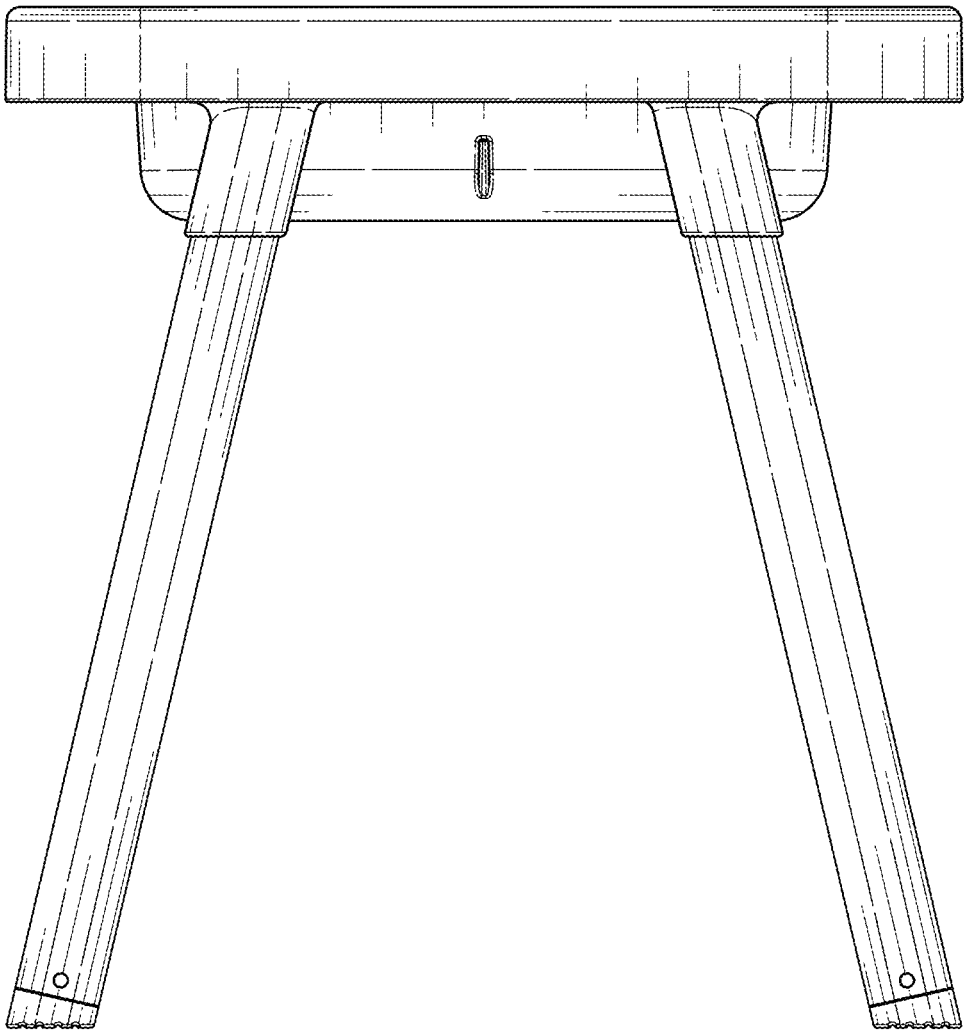
FIG. 6 is a right elevational view of the sensory table of FIG. 1.
Figure 7:
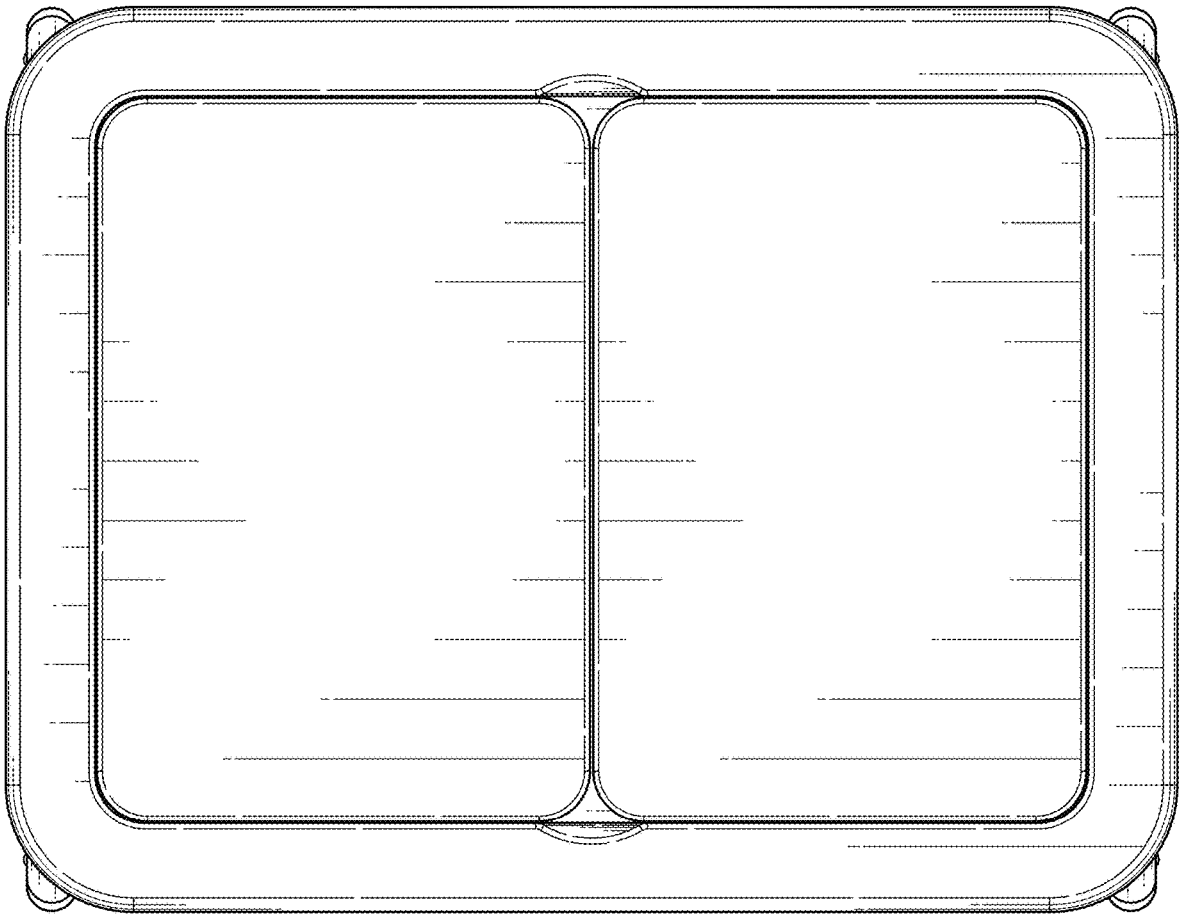
FIG. 7 is a top plan view of the sensory table of FIG. 1.
Figure 8:
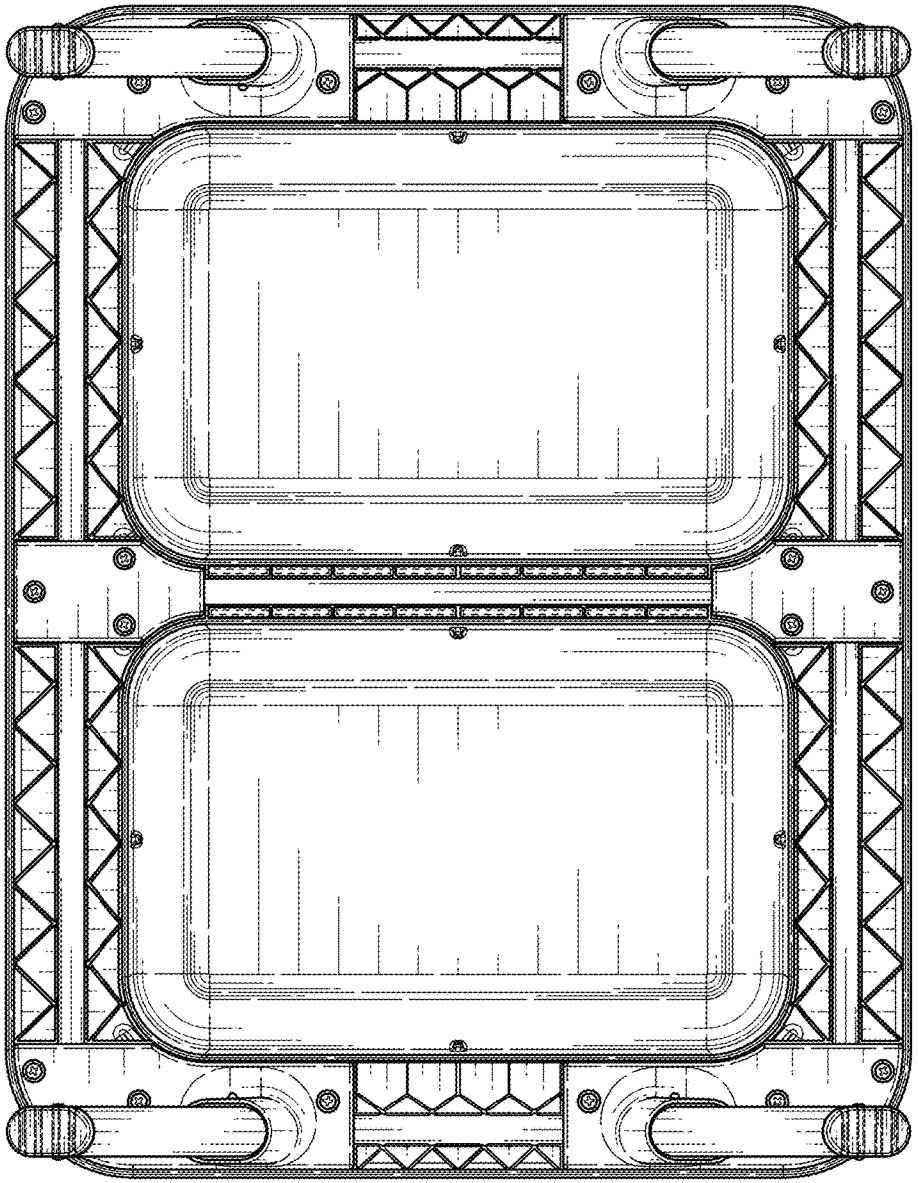
FIG. 8 is a bottom plan view of the sensory table of FIG. 1.

FIG. 1 is a top perspective view of a sensory table 100 having two bins and two lids. FIG. 2 is a bottom perspective view of the sensory table 100 of FIG. 1. FIGS. 3-8 show further views of the sensory table 100 of FIG. 1. The sensory table 100 may include a tabletop surface 102 that has an opening within it. In the opening, lids 104 and 106 are placed in the embodiment shown in FIGS. 1-8. In addition, the sensory table has bins 108 and 110 stored within the opening in the tabletop surface 102 of the sensory table 100.

Figure 9:
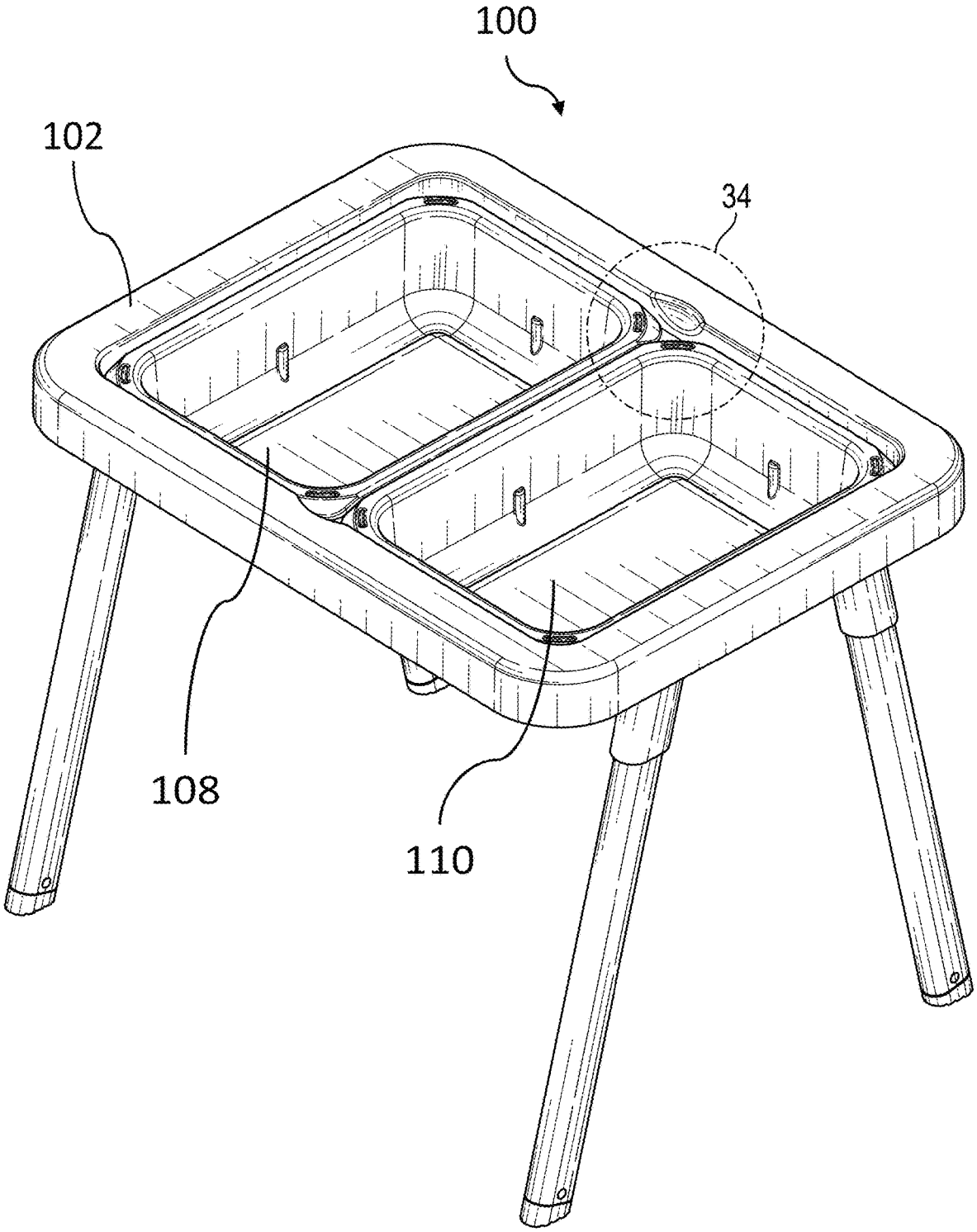
FIG. 9 is a top perspective view of a sensory table having two bins and no lids.
Figure 10:
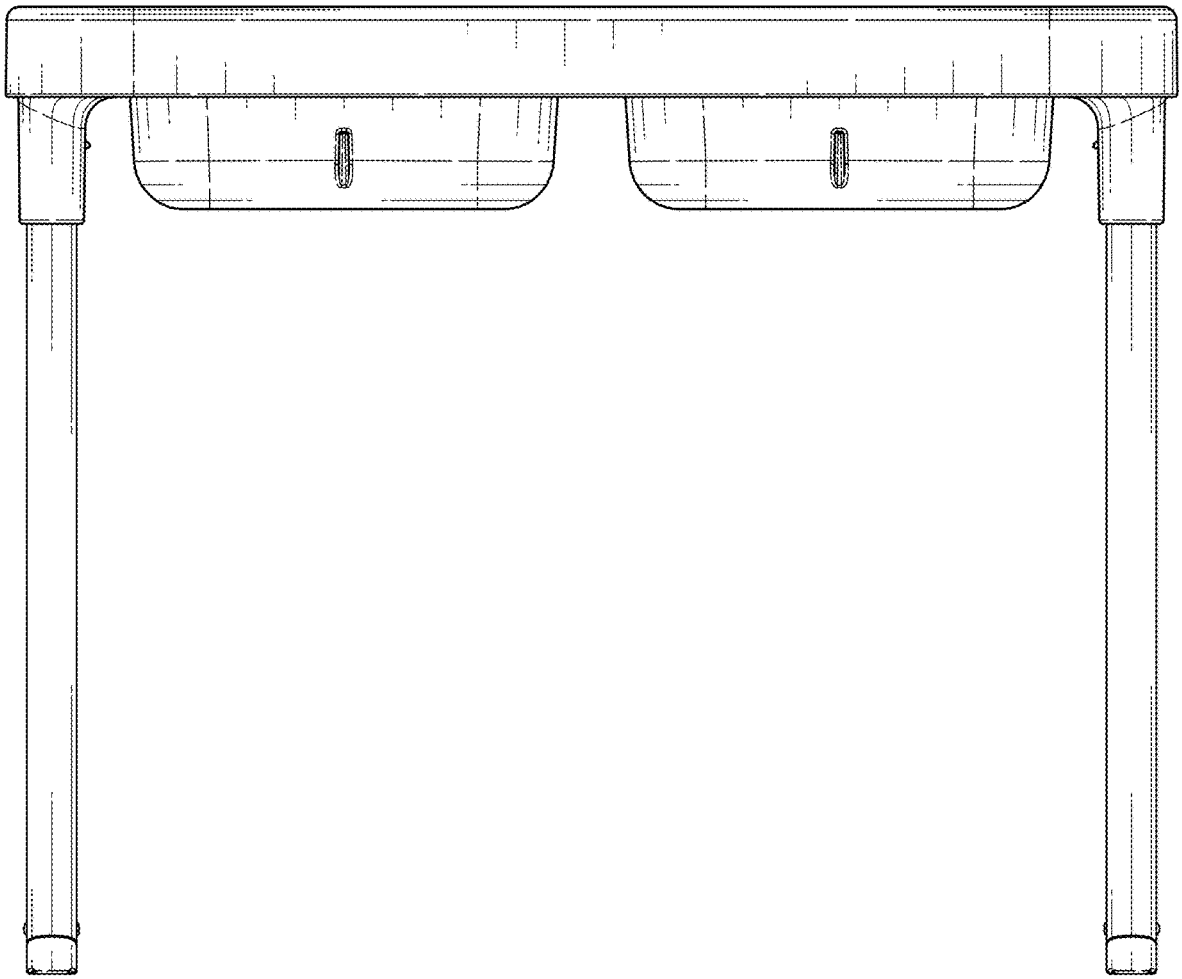
FIG. 10 is a front elevational view of the sensory table of FIG. 9.
Figure 11:
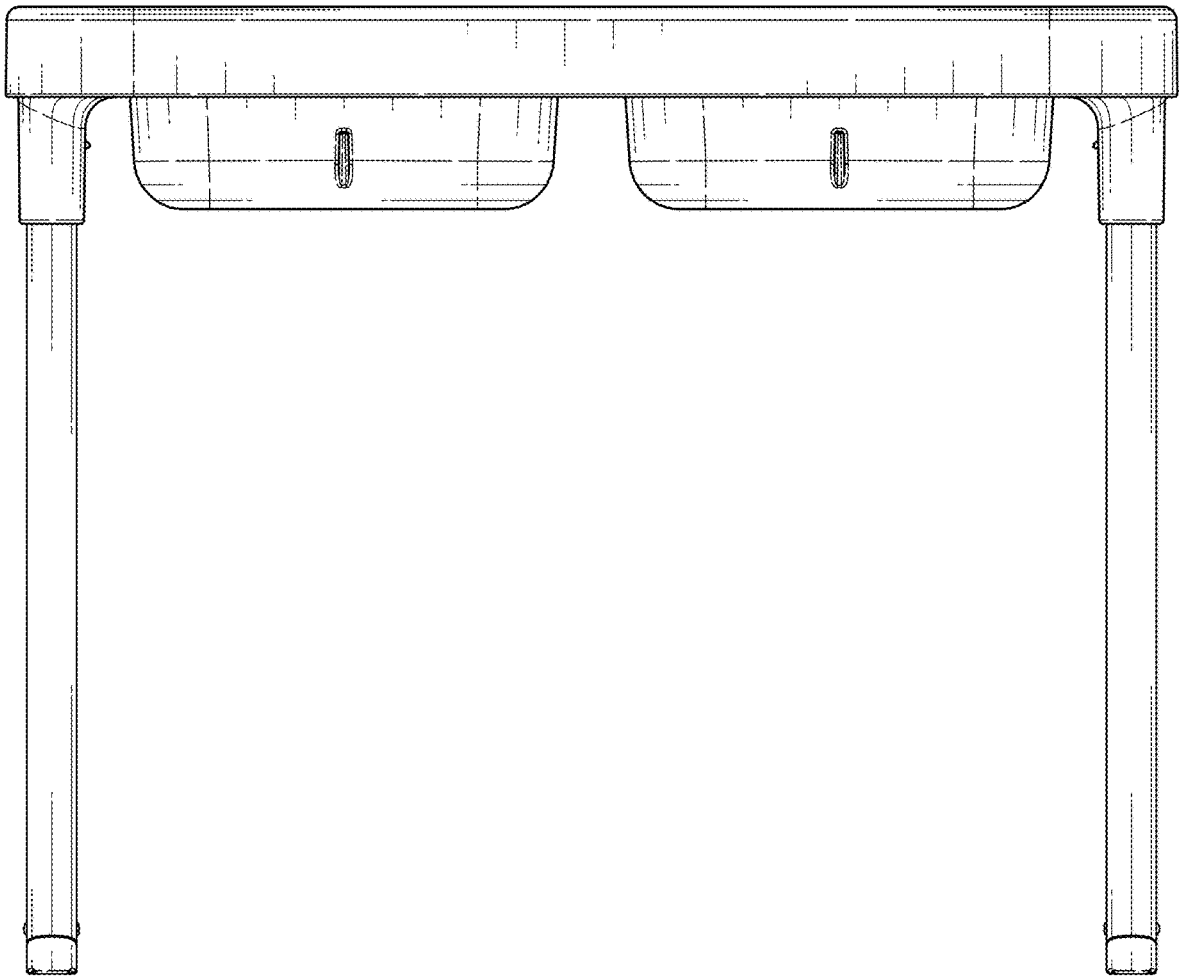
FIG. 11 is a rear elevational view of the sensory table of FIG. 9.
Figure 12:
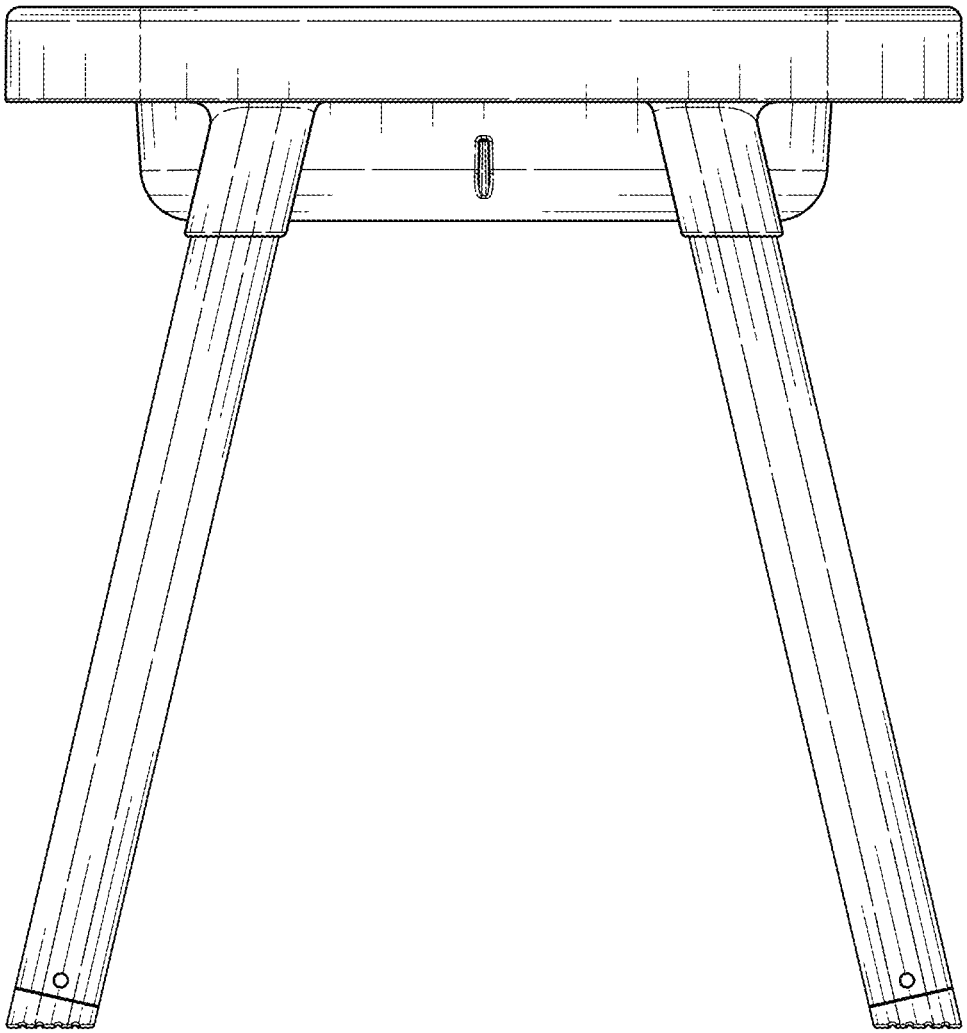
FIG. 12 is a left elevational view of the sensory table of FIG. 9.
Figure 13:
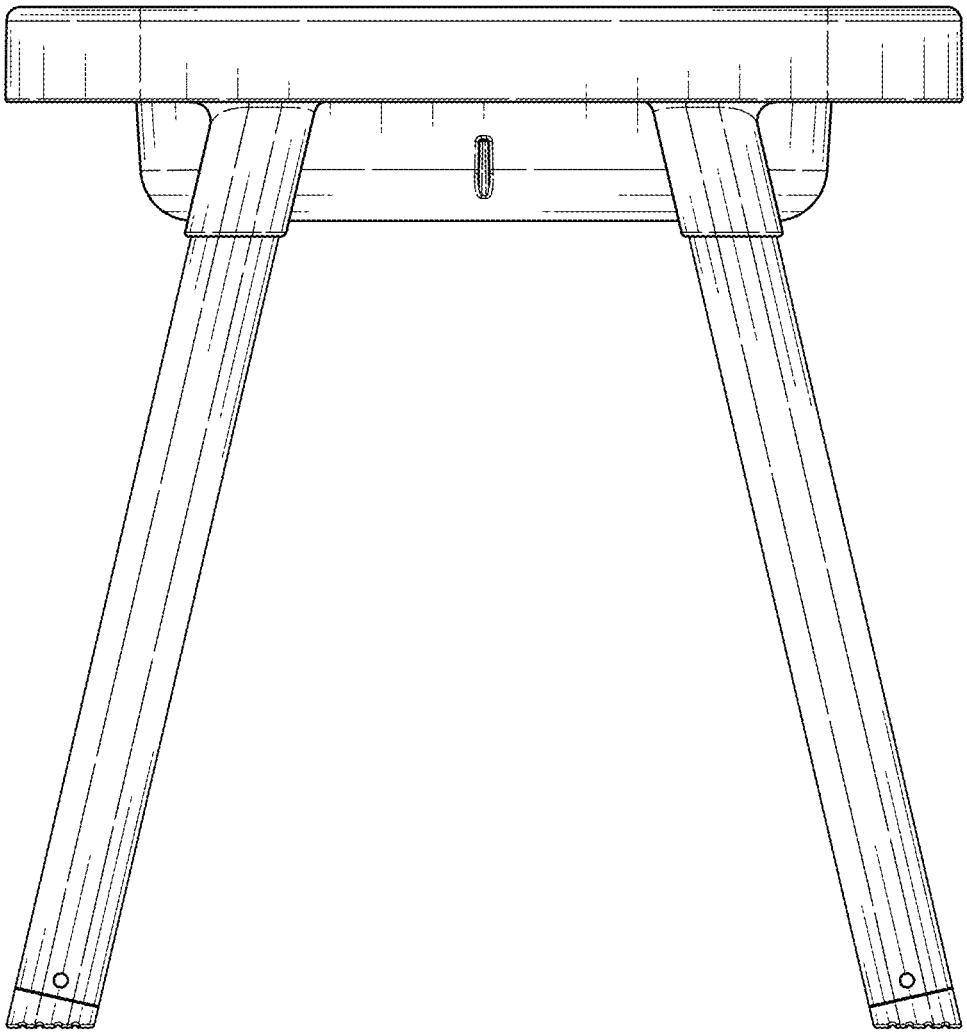
FIG. 13 is a right elevational view of the sensory table of FIG. 9.
Figure 14:
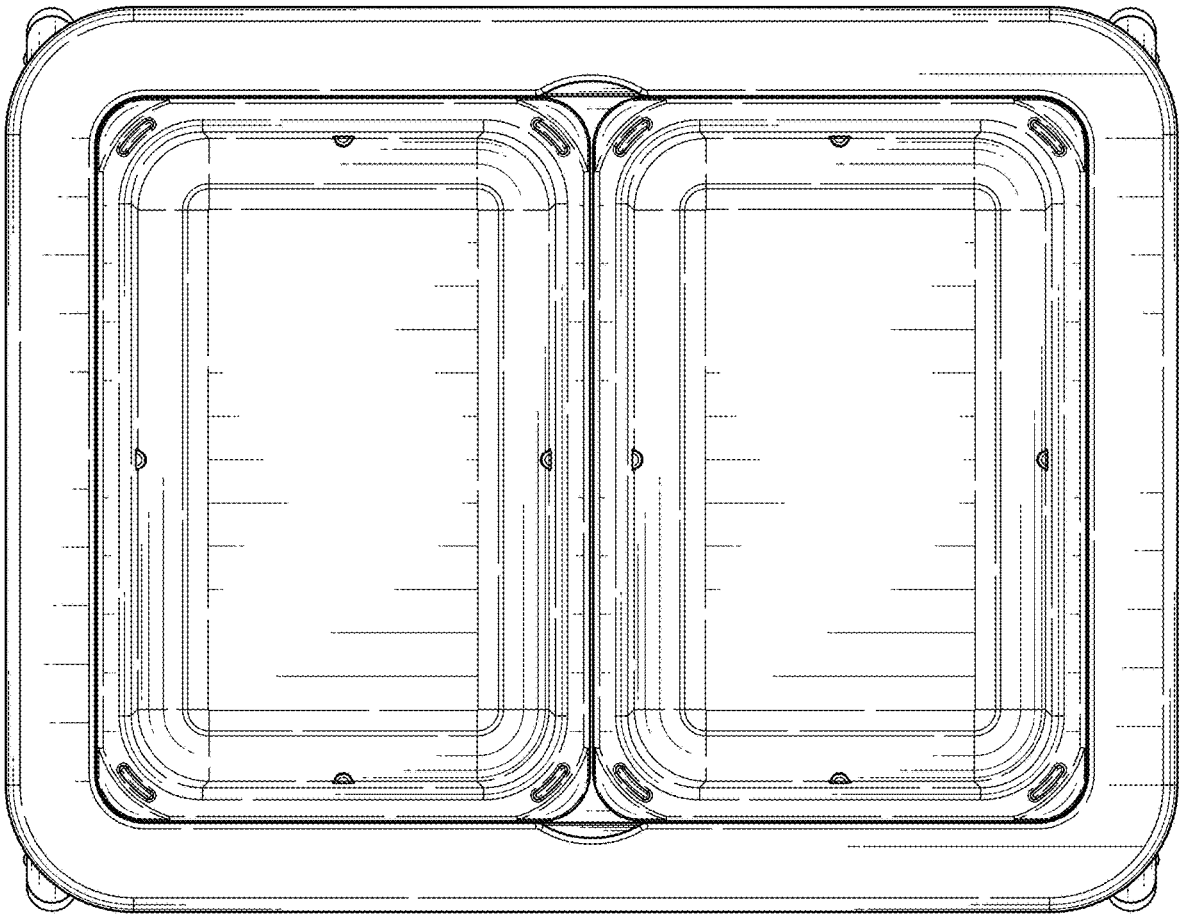
FIG. 14 is a top plan view of the sensory table of FIG. 9.
Figure 15:
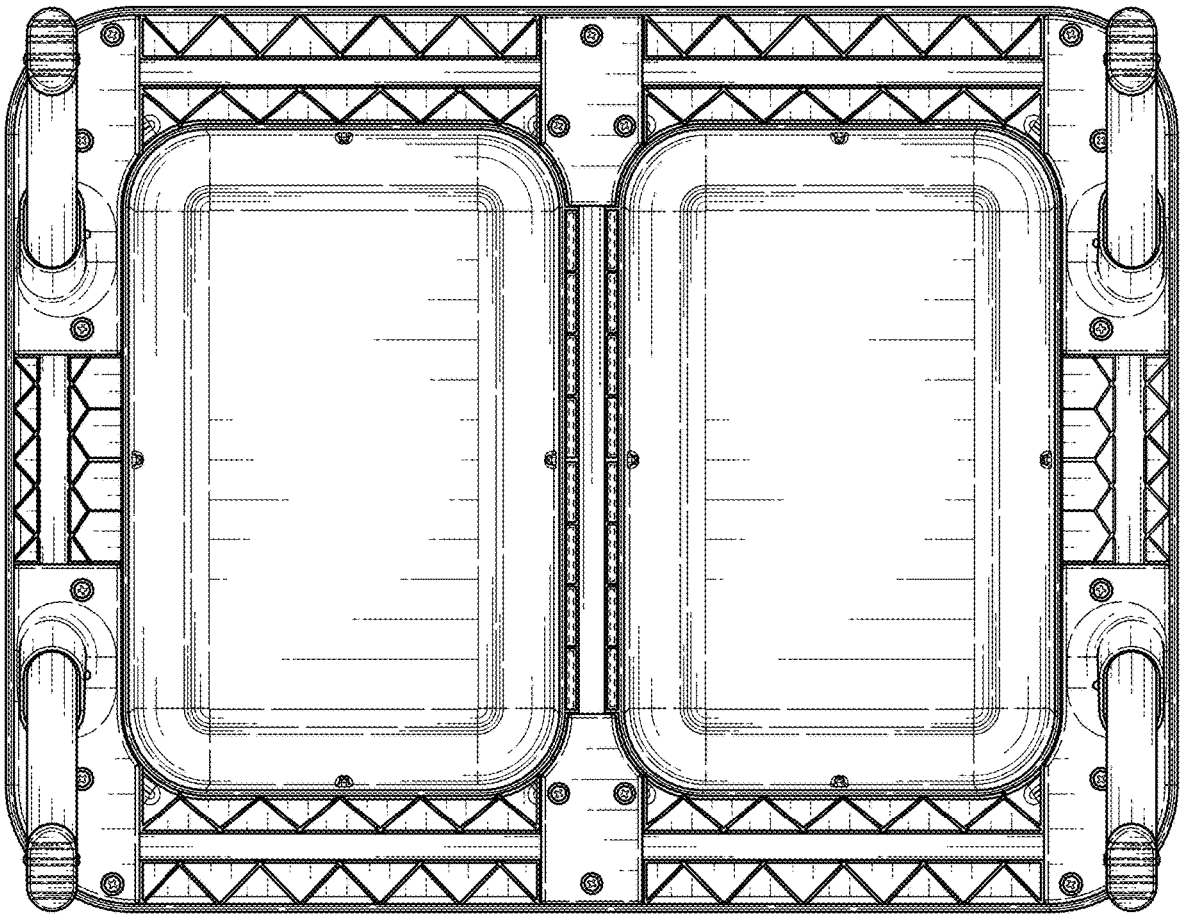
FIG. 15 is a bottom plan view of the sensory table of FIG. 9.

FIG. 9 is a top perspective view of a sensory table 100 having the two bins 108 and 110 but having no lids in place. FIGS. 10-15 show further views of the sensory table 100 of FIG. 9 without the lids. As can be seen, the bins 108 and 110 are now exposed without the lids 104 and 106 present. As such, a user may be able to use the bins 108 and 110 within the sensory table 100 (e.g., playing with sand or water with accessory toys as described herein).

Figure 16:
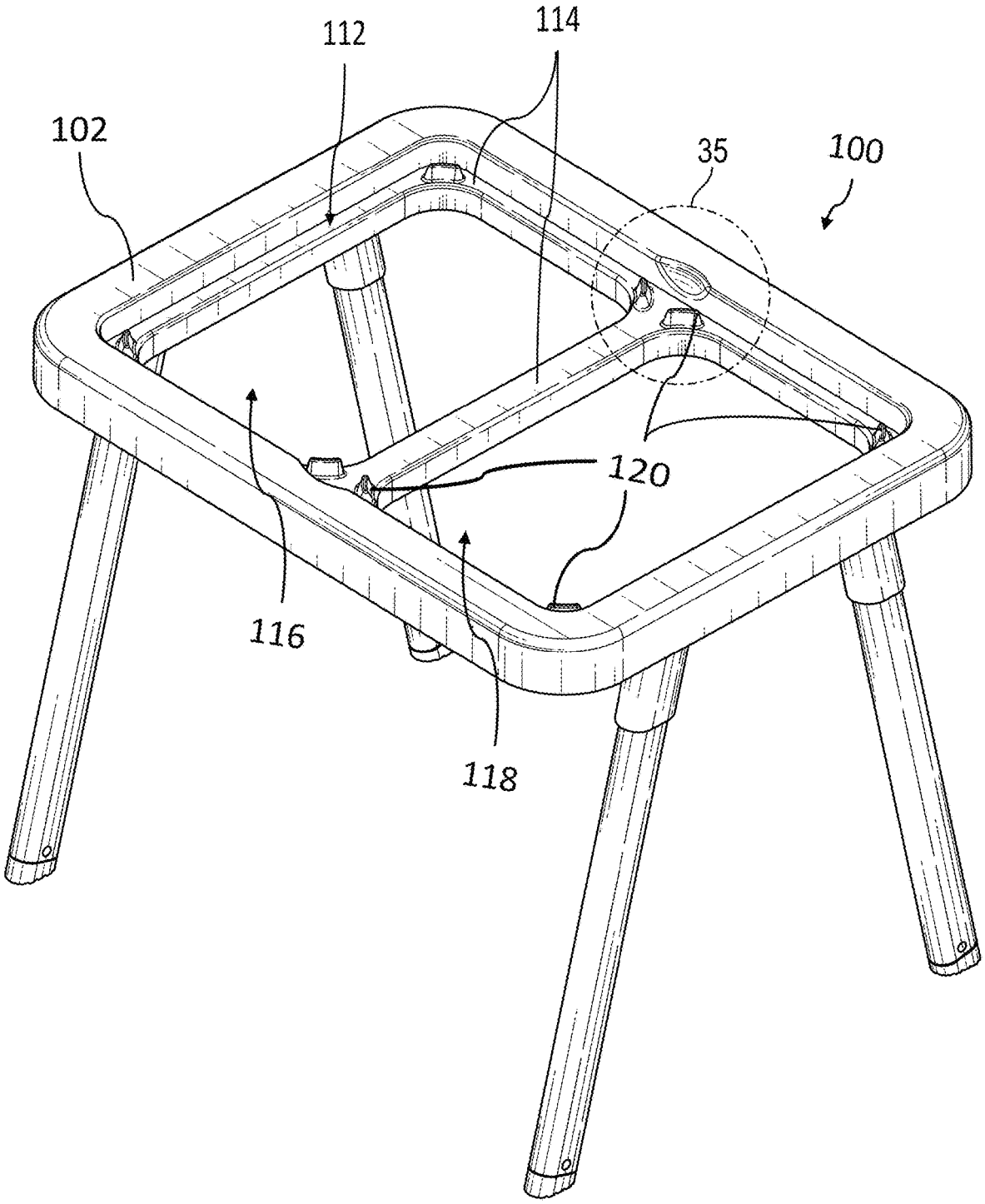
FIG. 16 is a top perspective view of a sensory table having no bins and no lids.
Figure 17:
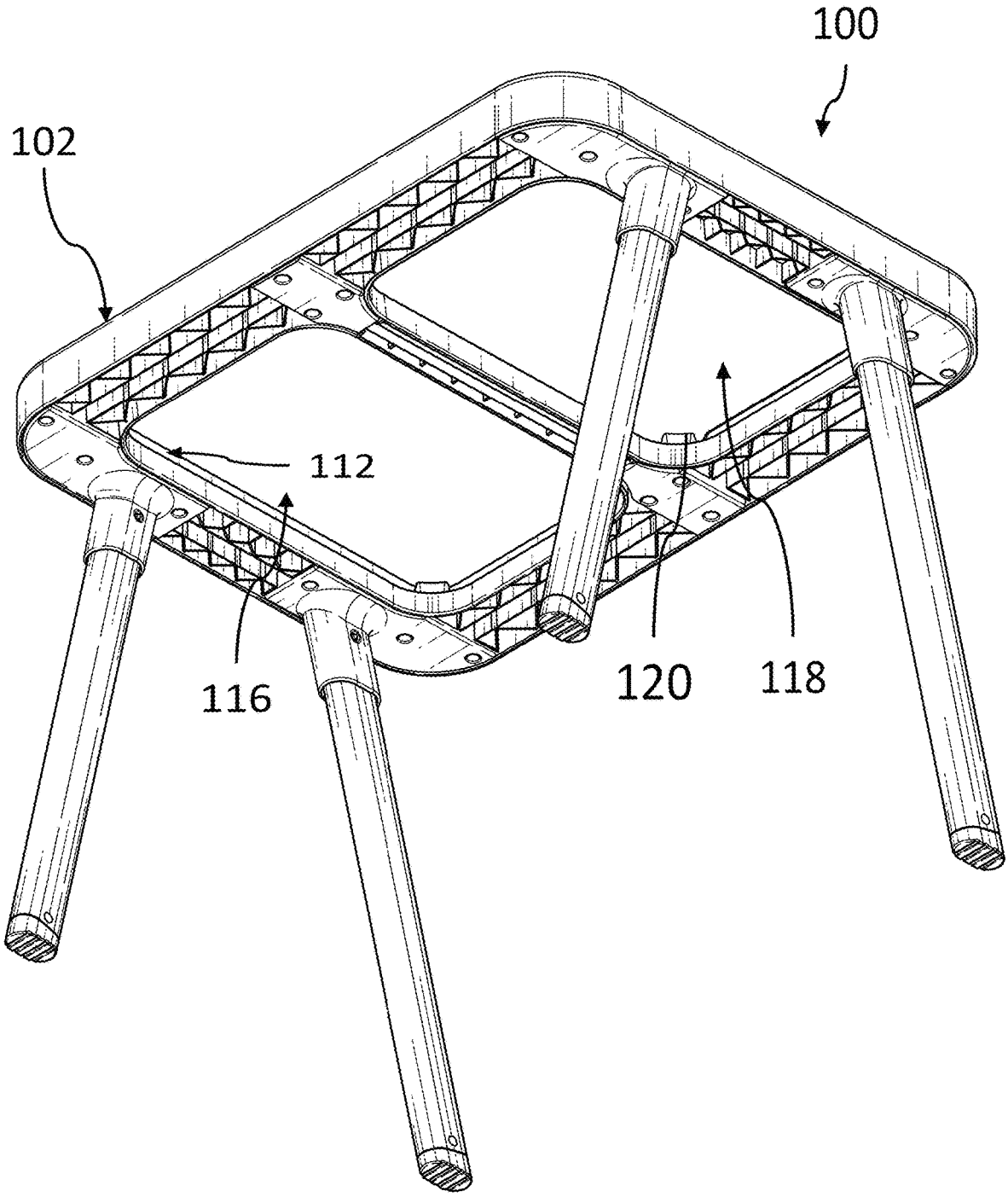
FIG. 17 is a bottom perspective view of the sensory table of FIG. 16.
Figure 18:
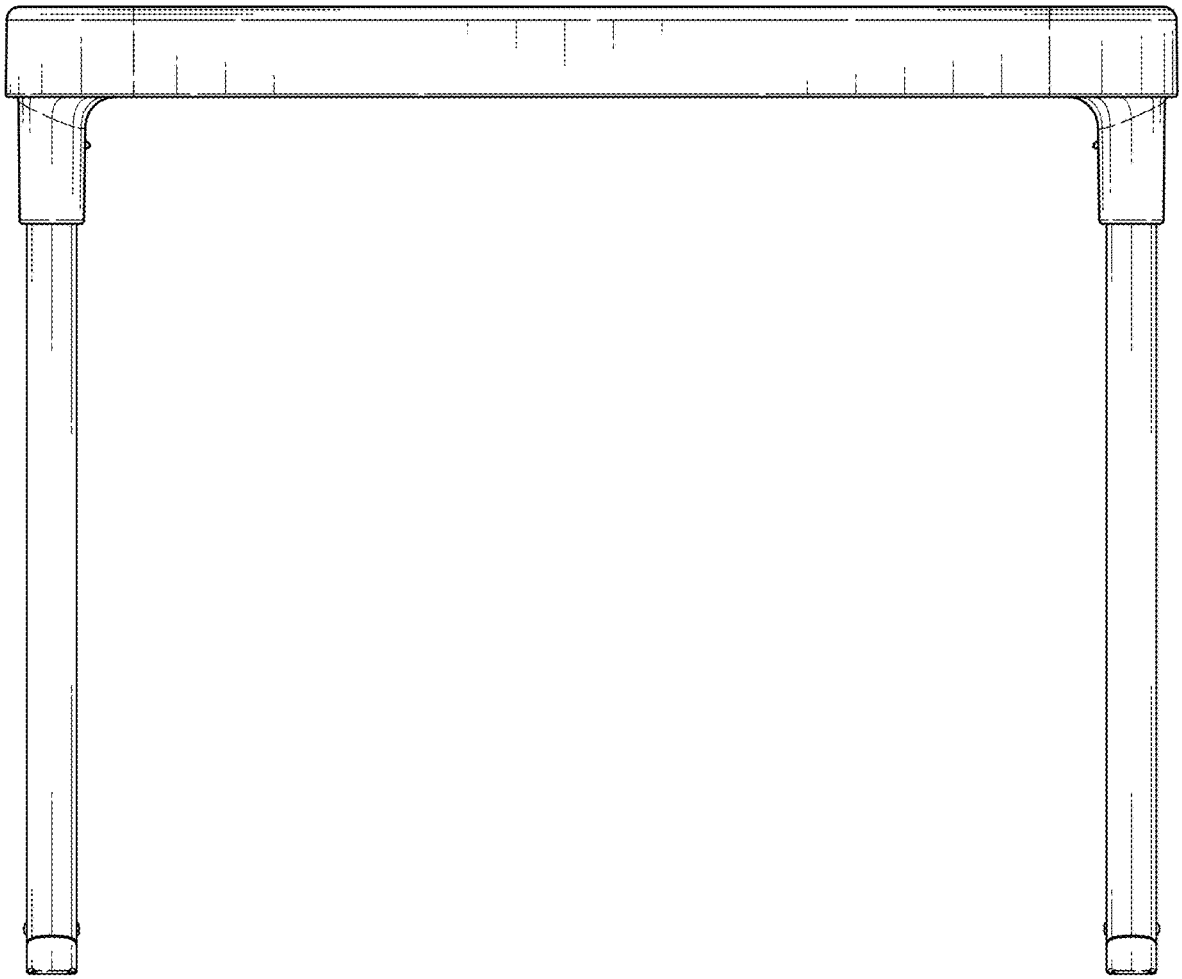
FIG. 18 is a front elevational view of the sensory table of FIG. 16.
Figure 19:
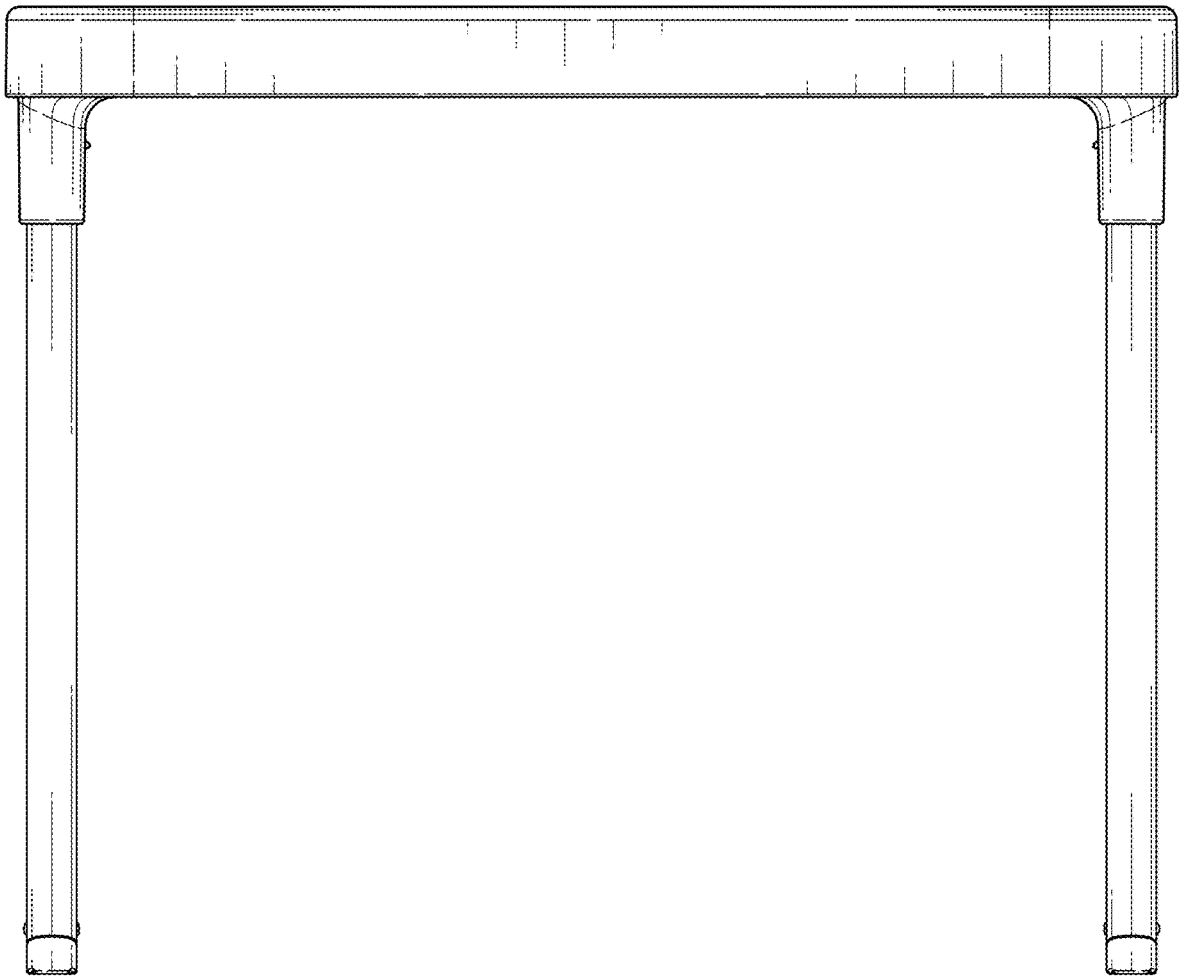
FIG. 19 is a rear elevational view of the sensory table of FIG. 16.
Figure 20:
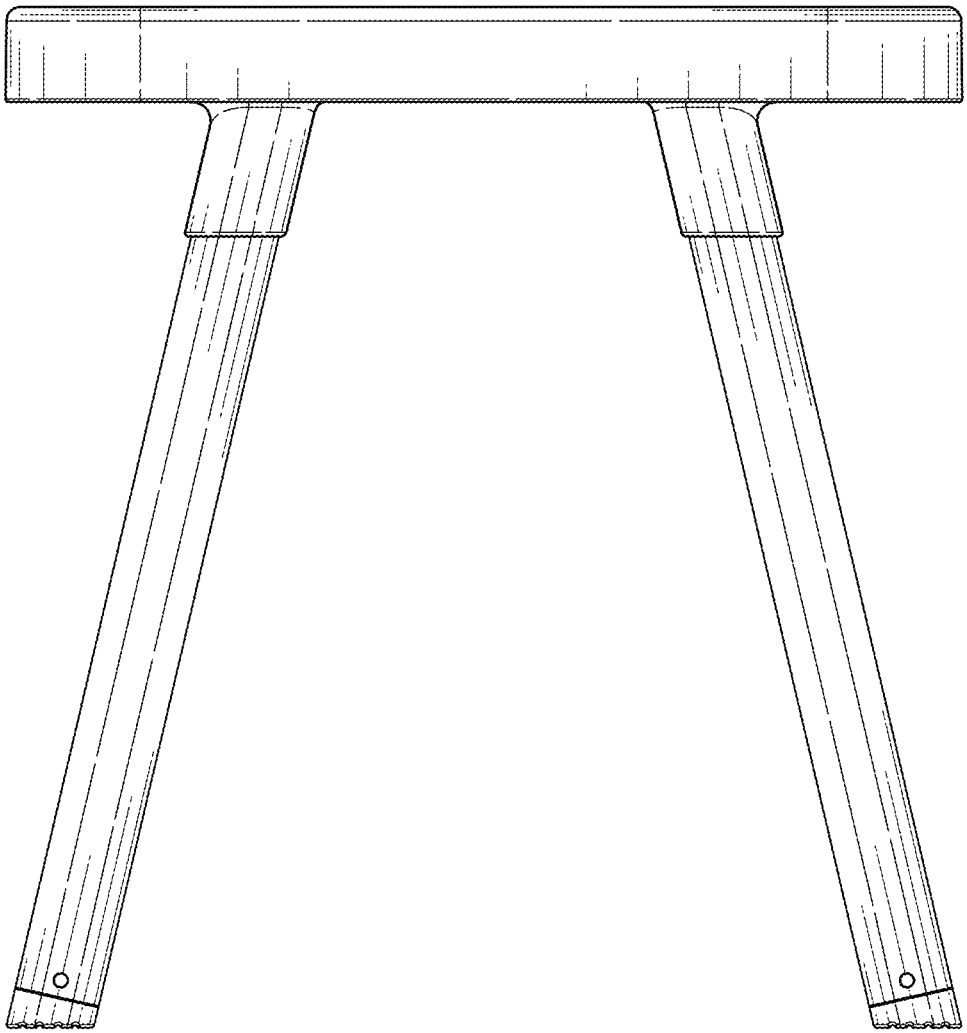
FIG. 20 is a left elevational view of the sensory table of FIG. 16.
Figure 21:
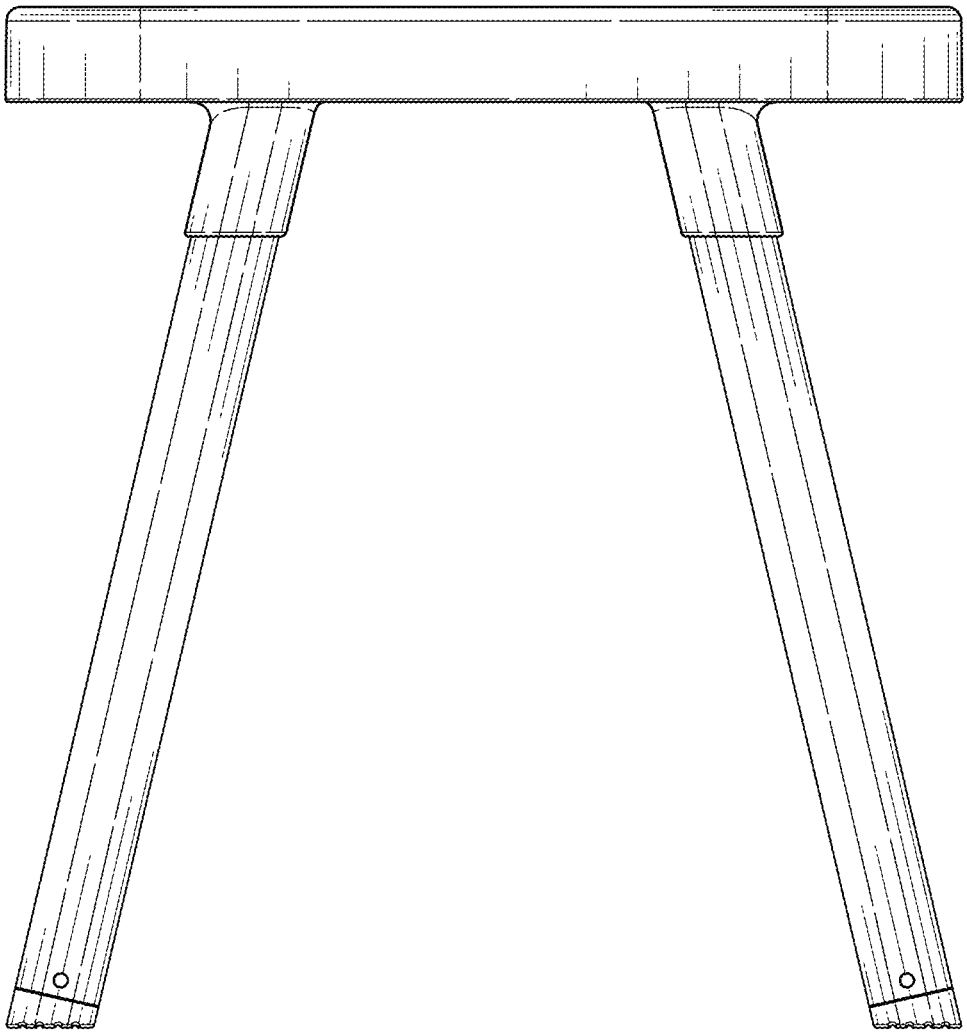
FIG. 21 is a right elevational view of the sensory table of FIG. 16.
Figure 22:
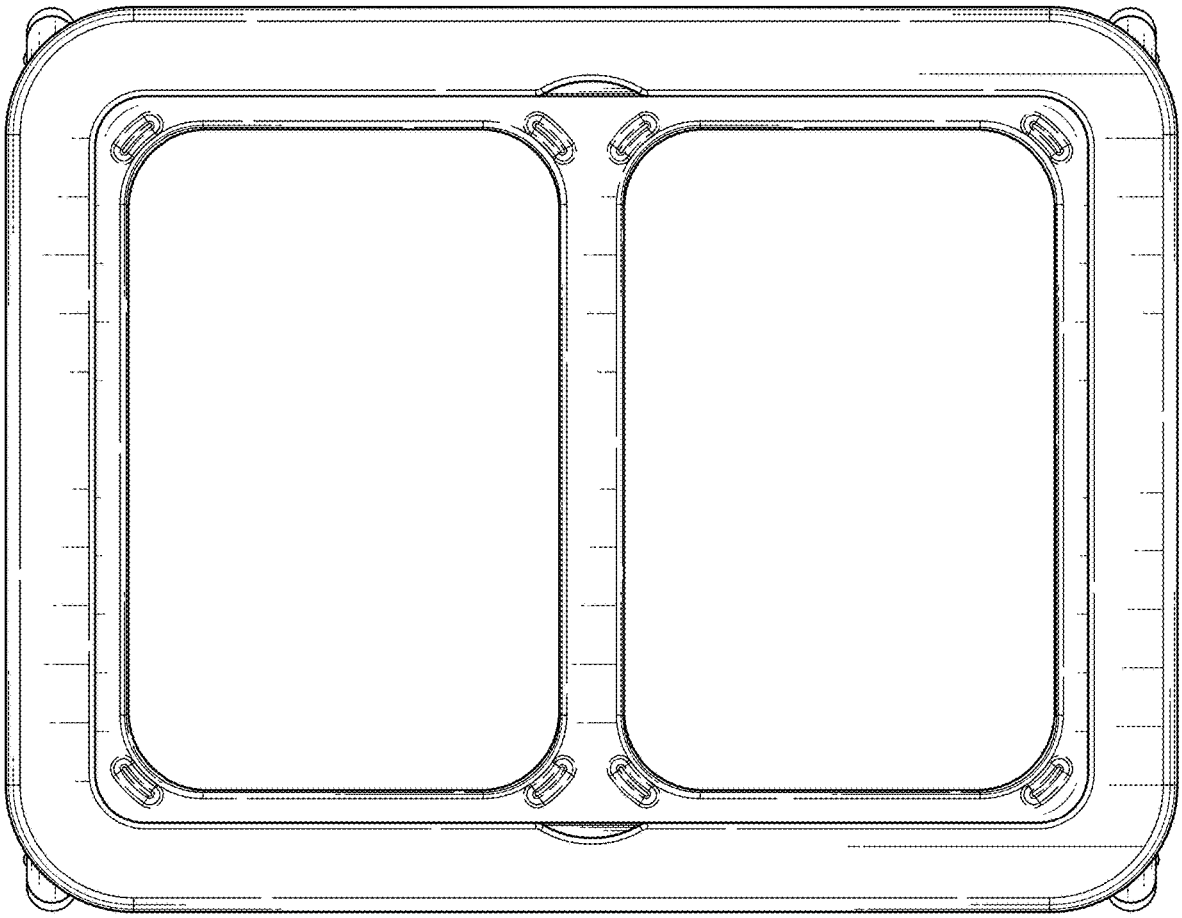
FIG. 22 is a top plan view of the sensory table of FIG. 16.
Figure 23:
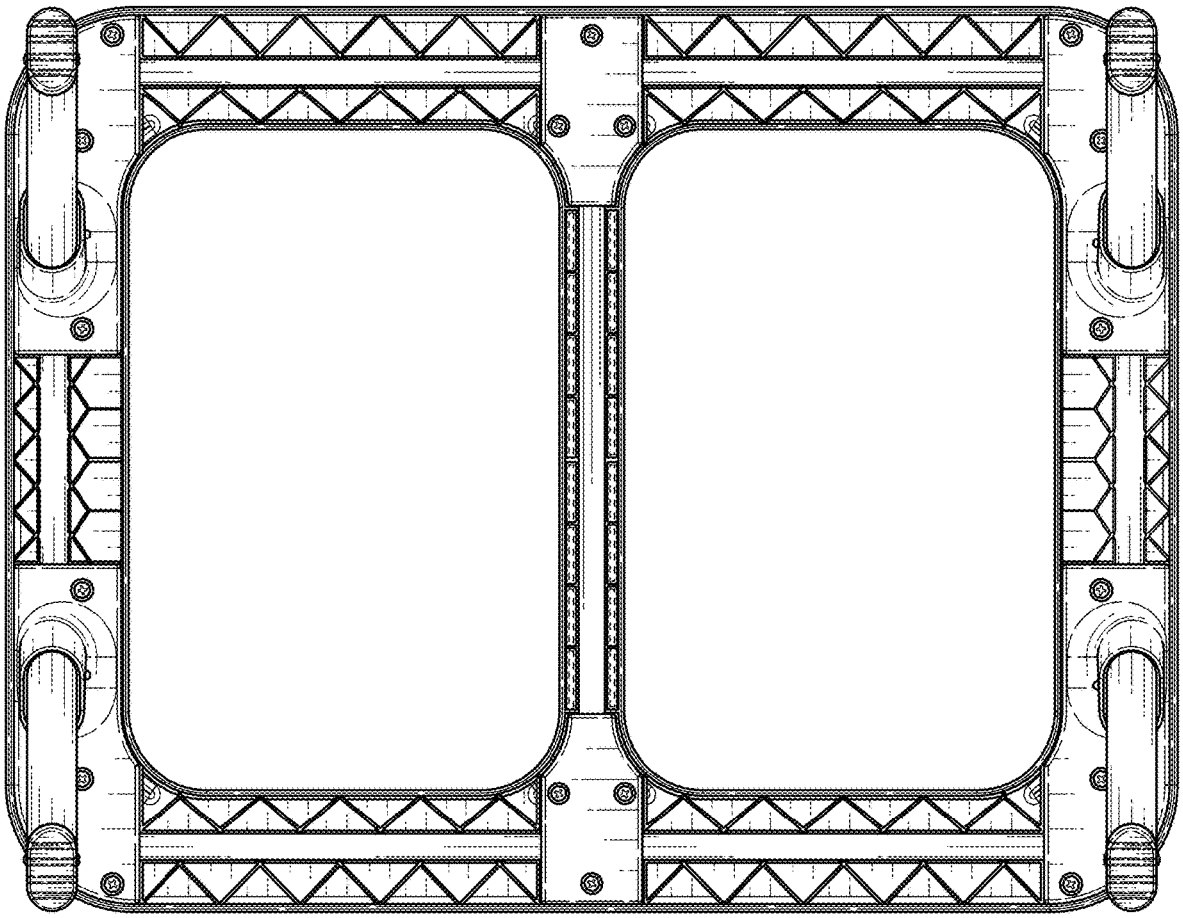
FIG. 23 is a bottom plan view of the sensory table of FIG. 16.

FIG. 16 is a top perspective view of a sensory table 100 having no bins and no lids. FIG. 17 is a bottom perspective view of the sensory table of FIG. 16. FIGS. 18-23 show further views of the sensory table 100 of FIG. 16. As shown, the tabletop surface 102 includes an opening 112. This opening may accommodate lids and bins (not shown in FIGS. 16-23). Within the opening 112 may further be a ledge 114 that forms additional openings 116 and 118. The openings 116 and 118 may accommodate the bins 108 and 110, such that the bins 108 and 110 may be placed in or removed from the sensory table 100.

As such, the openings 112 and 116 together form a space for accommodating the bin 108 and the openings 112 and 118 together form a space for accommodating the bin 110. The ledge 114 may extend around each of the openings 112 and 118, such that the ledge goes around the entire perimeter of the opening 112 within the tabletop surface 102 and also has a middle portion spanning across the opening 112 to form the separate bin openings 116 and 118. While this embodiment shows a ledge forming two bin openings, various embodiments may have a ledge that forms different amounts of bin openings than that shown in FIGS. 16-23, such as only one opening, three openings, four openings, five openings, six openings, etc.

The sensory table 100 further includes a first set of support posts 120 associated with the bin opening 118. There are four of the posts 120, with one of each of the posts 120 extending up from the ledge 114 at each corner of the bin opening 118. In this way, the first set of posts 120 may provide adequate support for the lid 106 and may also interact with openings of a bin to further support a bin when placed into the sensory table 100. Although not separately numbered with reference numerals, the bin opening 116 also has a second set of posts with one post at each corner of the bin opening 116. Each of the first and second sets of posts (including the posts 120) may extend up from the ledge 114 toward the top of the sensory table 100 (e.g., toward a plane formed by the tabletop surface 102). However, the posts may not reach the plane formed by the tabletop surface 102, such that when lids are placed on the posts (e.g., the lids 104 and 106) top surfaces of the lids will rest substantially within the same plane formed by the tabletop surface 102 to form a table top as shown in FIG. 1. That is, a gap between a top of the posts 120 and a plane formed by the tabletop surface 102 may be approximately the width of the lid 104 and/or 106 such that the tabletop surface 102 along with the lids 104/106 may form a contiguous tabletop while the lids are placed in the sensory table 102.

Figure 24:
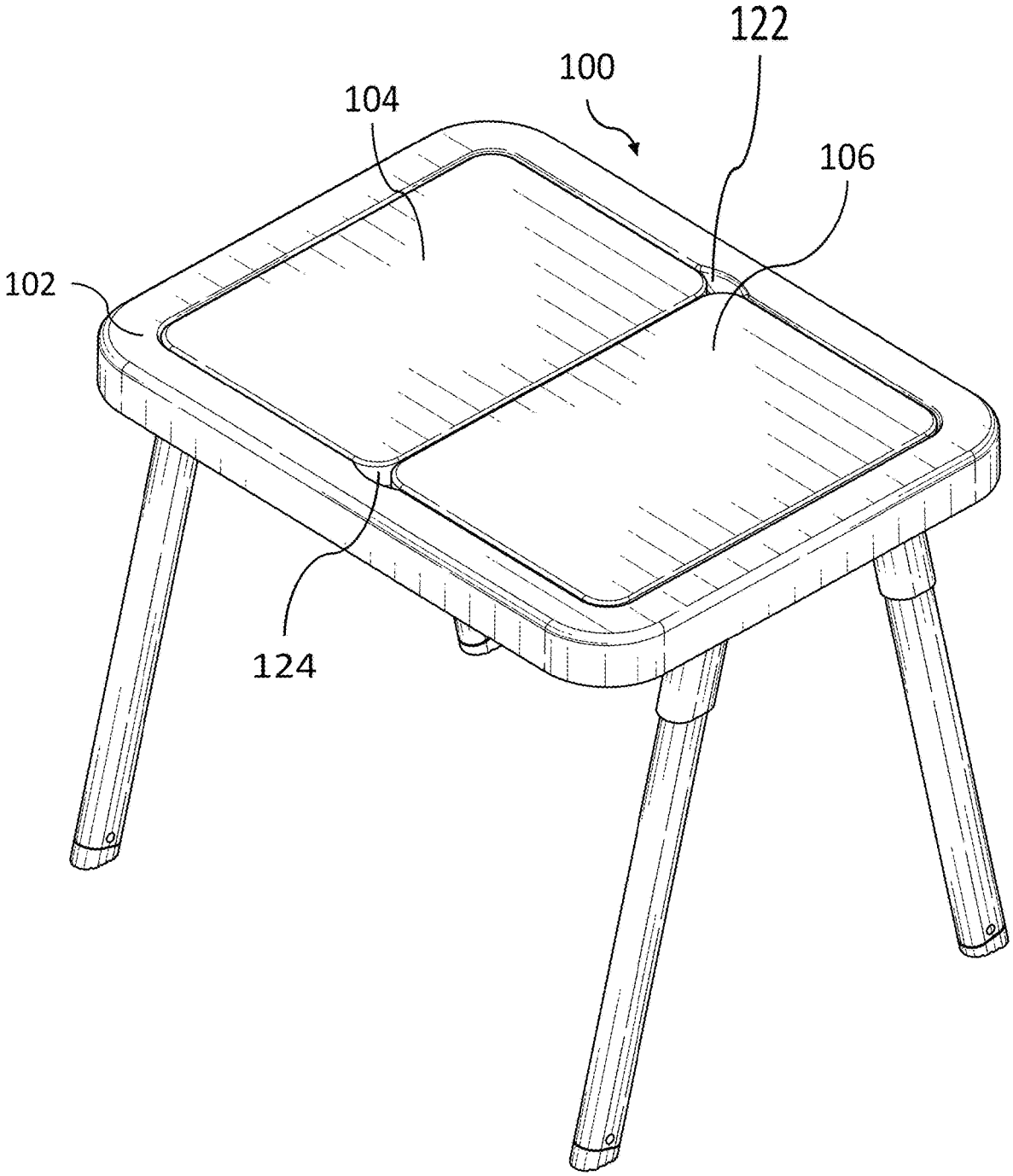
FIG. 24 is a top perspective view of a sensory table having two lids and no bins.
Figure 25:
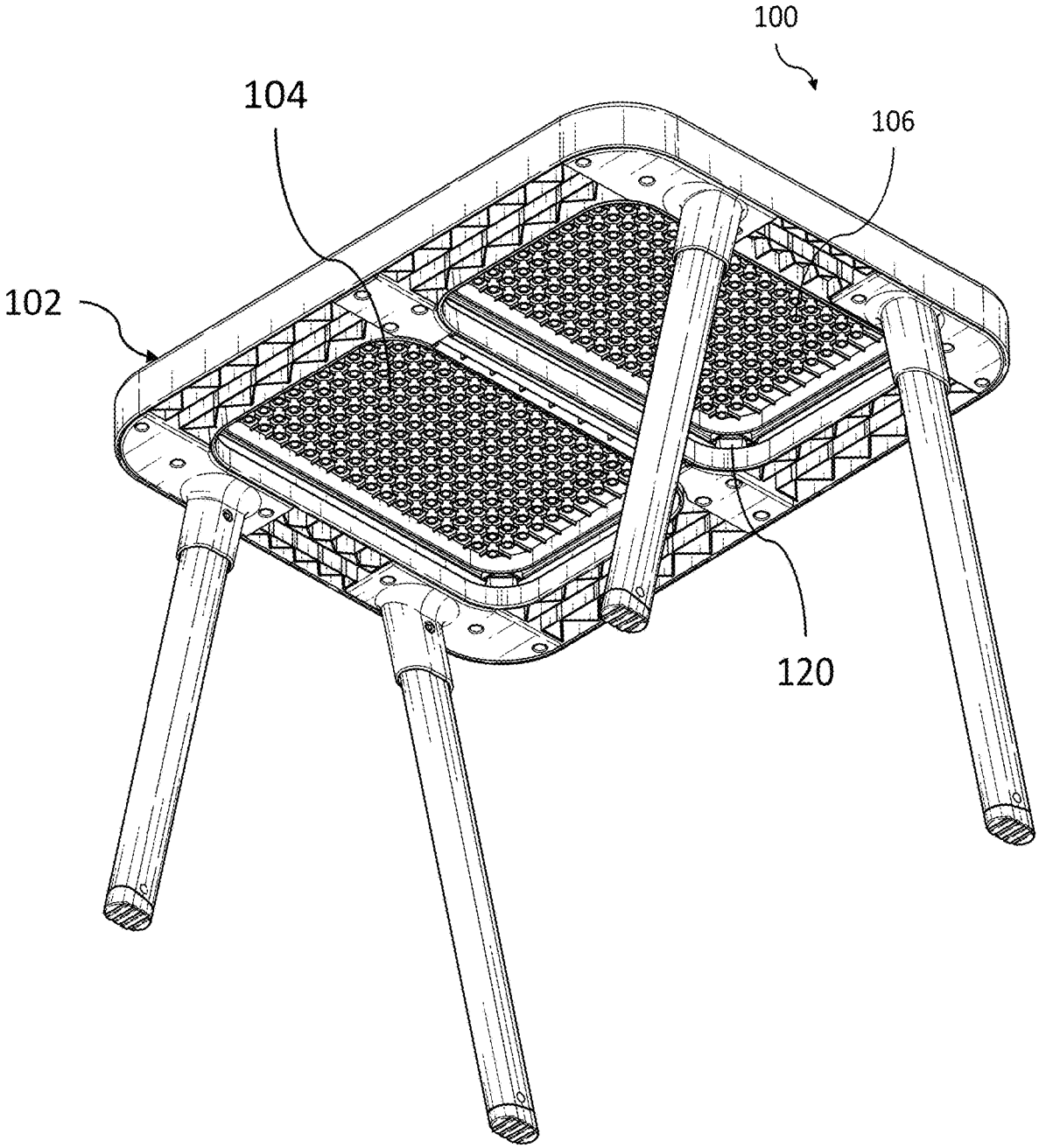
FIG. 25 is a bottom perspective view of the sensory table of FIG. 24.
Figure 26:
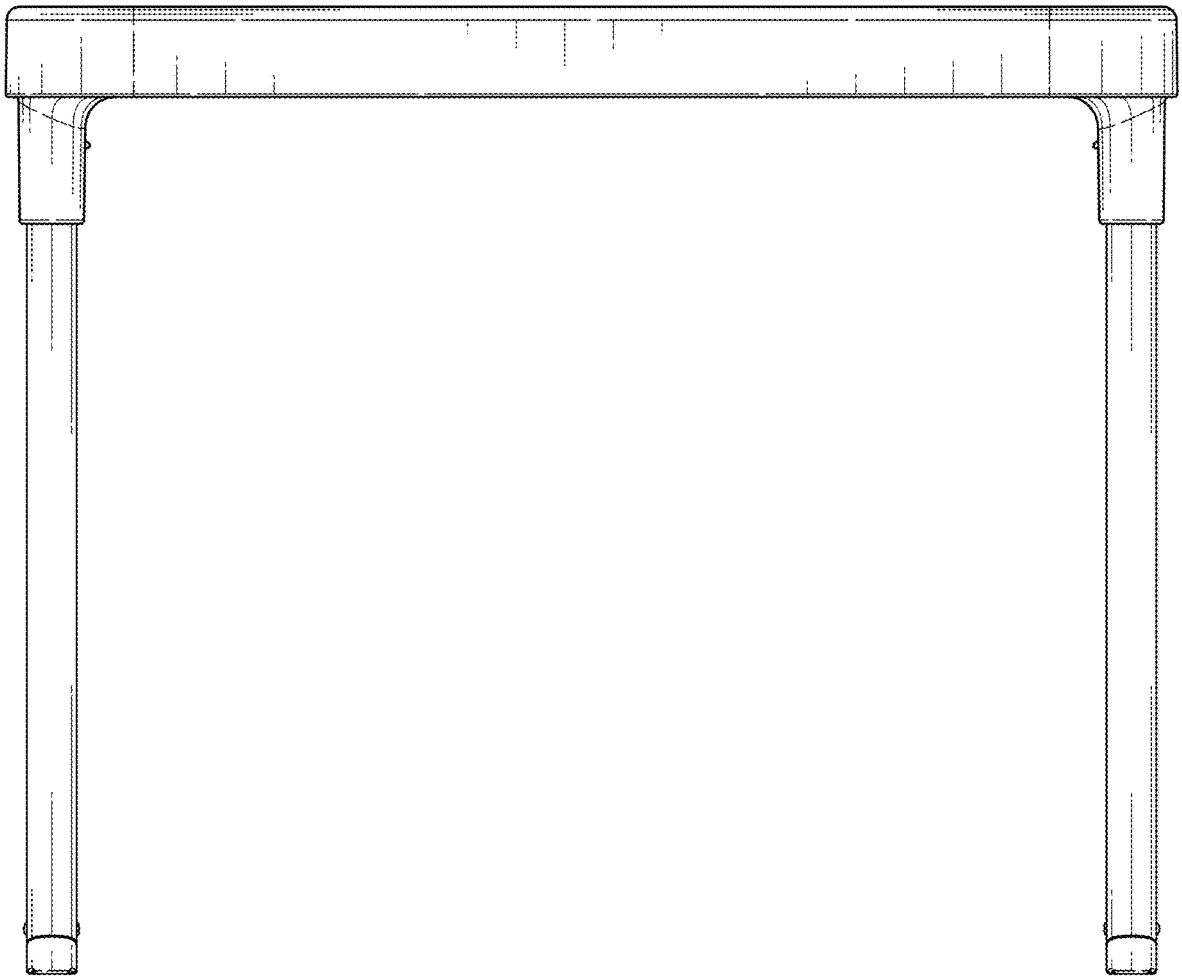
FIG. 26 is a front elevational view of the sensory table of FIG. 24.
Figure 27:
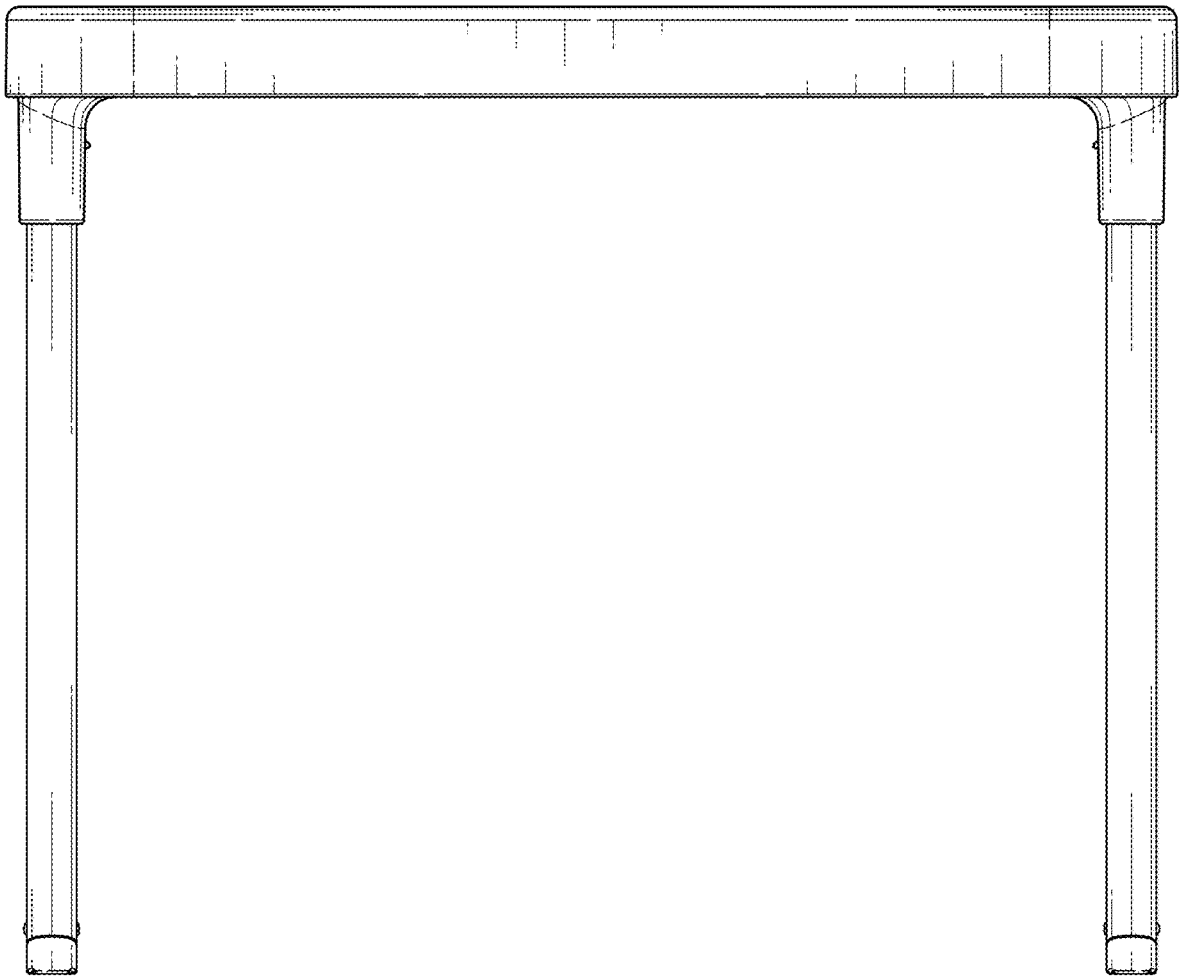
FIG. 27 is a rear elevational view of the sensory table of FIG. 24.
Figure 28:
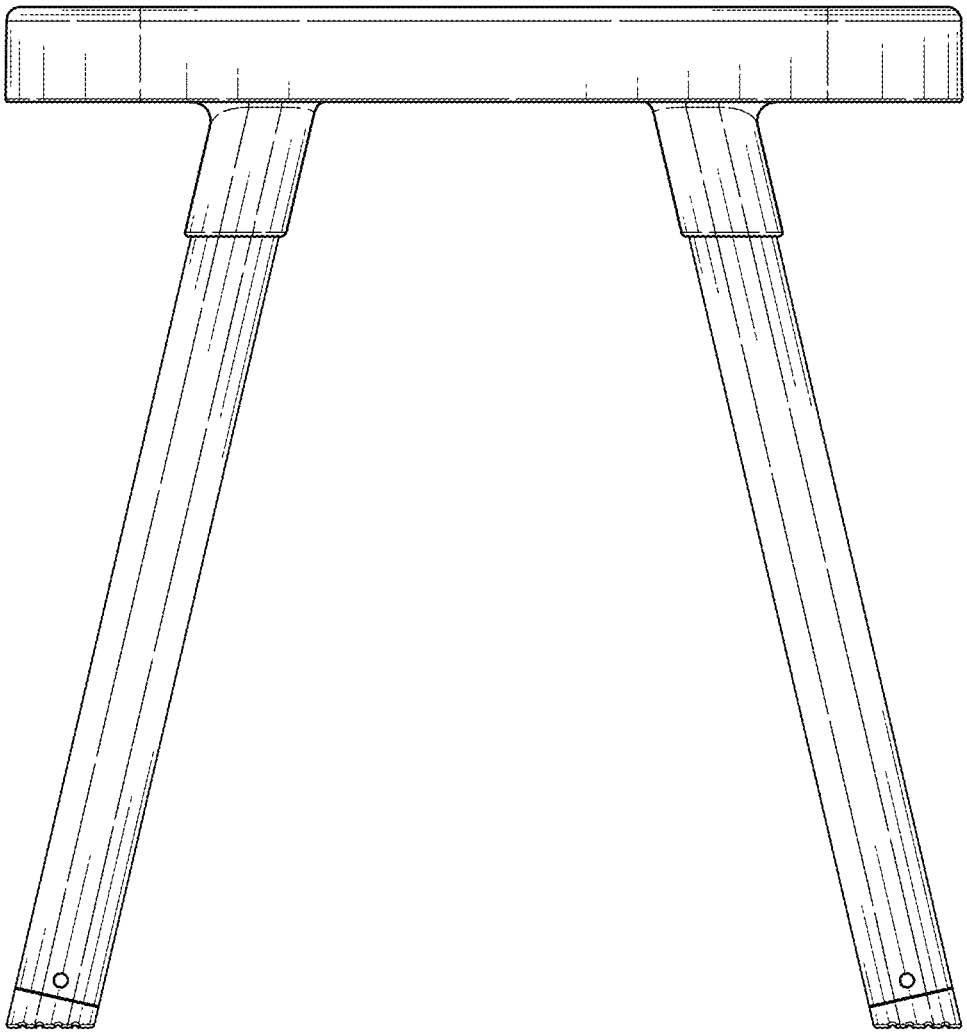
FIG. 28 is a left elevational view of the sensory table of FIG. 24.
Figure 29:
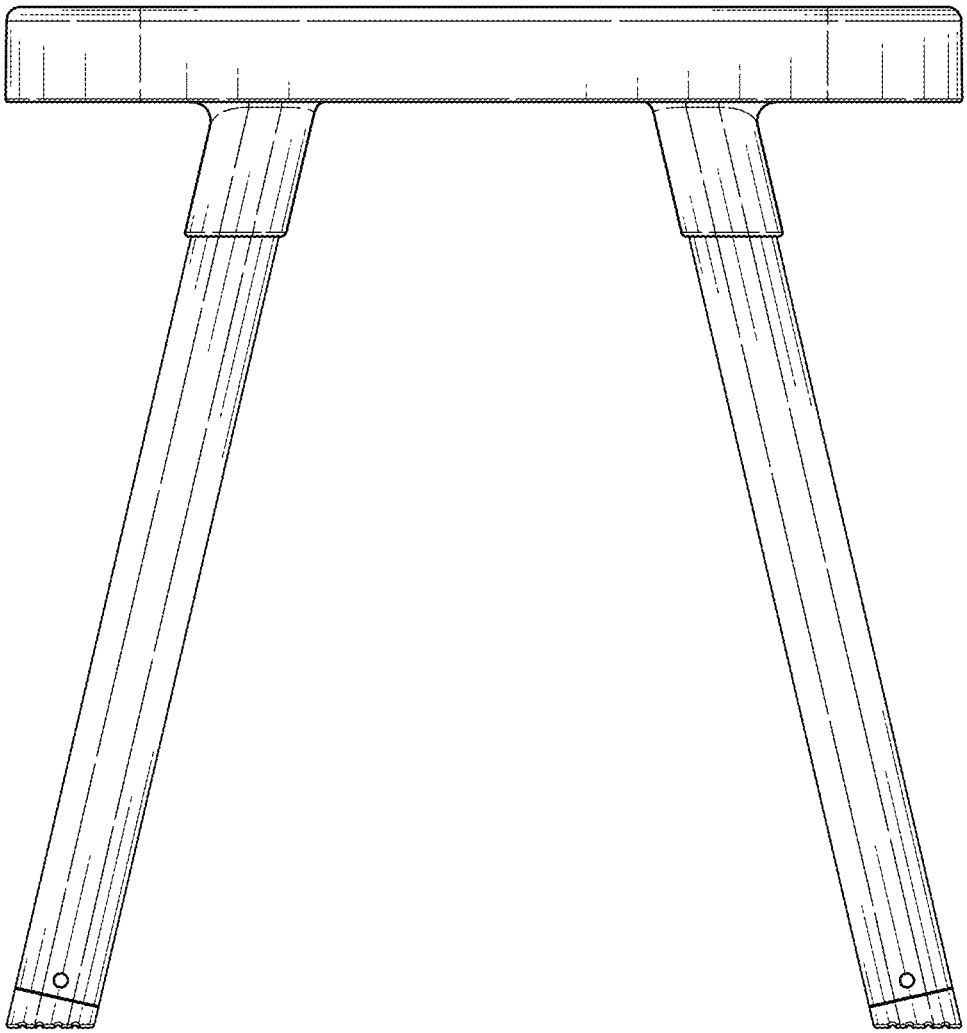
FIG. 29 is a right elevational view of the sensory table of FIG. 24.
Figure 30:
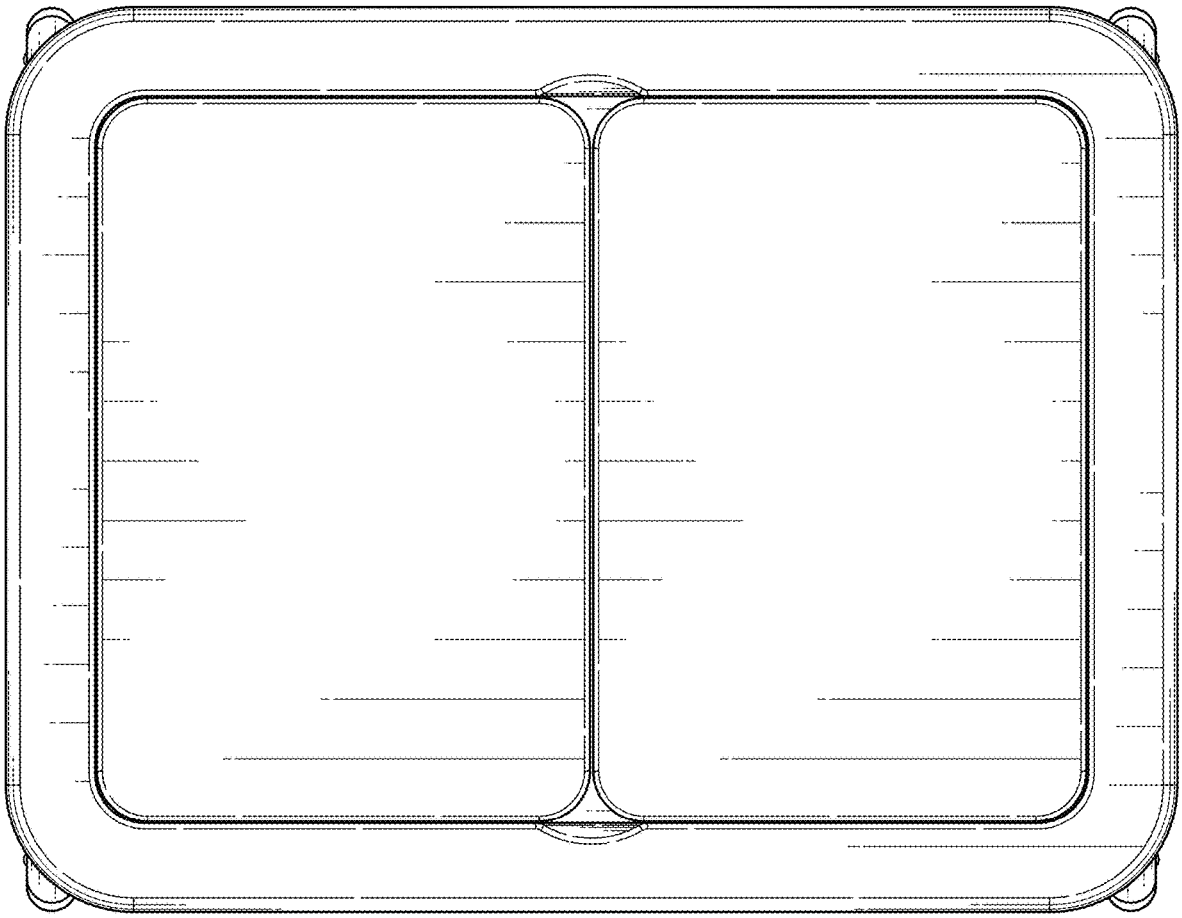
FIG. 30 is a top plan view of the sensory table of FIG. 24.
Figure 31:
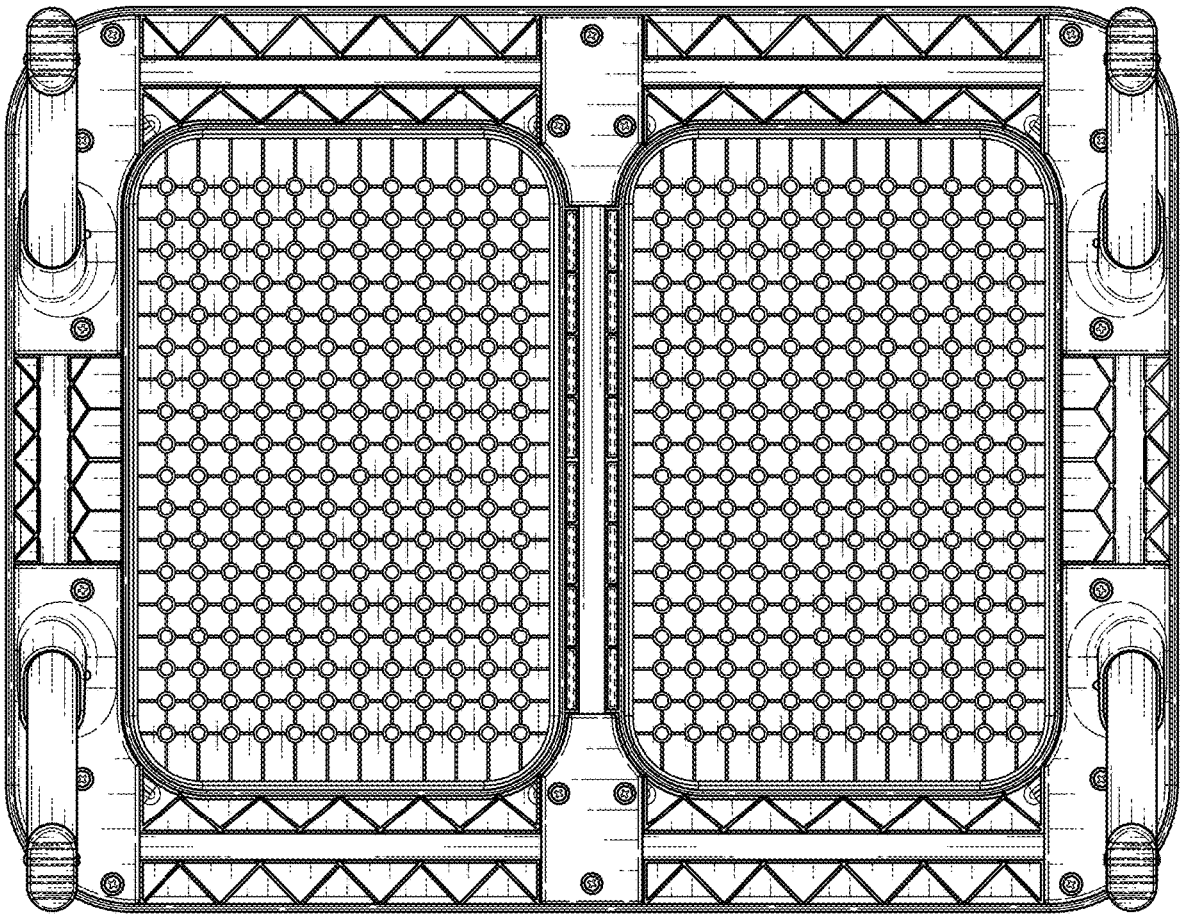
FIG. 31 is a bottom plan view of the sensory table of FIG. 24.

FIG. 24 is a top perspective view of a sensory table 100 having two lids and no bins. FIG. 25 is a bottom perspective view of the sensory table 100 of FIG. 24. FIGS. 26-31 show further views of the sensory table 100 of FIG. 24. As such, the lids 104 and 106 may be in place as described herein even if the bins are not present. The sensory table 100 may therefore be used as a table while the lids 104 and 106 are in place with or without any bins, and posts that extend up from the ledge 114 support those lids 104/106. In addition the shape of the opening 112 within the tabletop surface 102 of the sensory table 100 further holds the lids 104/106 in place, as the lids 104/106 are generally shaped to correspond to the opening 112. In various embodiments, the opening 112 of the tabletop surface 102 may further include small cutouts 122 and 124 that are not filled by the lids 104/106. In this way, the user may insert a finger into the cutout 122 or the cutout 124 to access a lower edge of the lids 104/106 to remove the lids 104/106 from the sensory table 100 (e.g., to access the bins underneath or anything stored in the bins, replace the bins in the sensory table, etc.).

The cutouts 122/124 may be comparatively small compared to the opening 112 or the bin openings 116/118. In this way, the sensory table 100 may still be generally used as a table top when the lids 104/106 are in place despite the present of the cutouts 122/124. In other words, the tabletop formed by the tabletop surface 102 and top surfaces of the lids 104/106 may be generally contiguous despite the cutouts 122/124 and any gaps between edges of the lid 104, lid 106, and tabletop surface 102, such that (i) a user may still place items on the sensory table 100 without them falling into any cutouts or gaps and (ii) the lids 104/106 are substantially secured within the sensory table 100 such that the lids 104/106 will not move around or translate side to side within the sensory table 100 during use in table mode.

Figure 32:
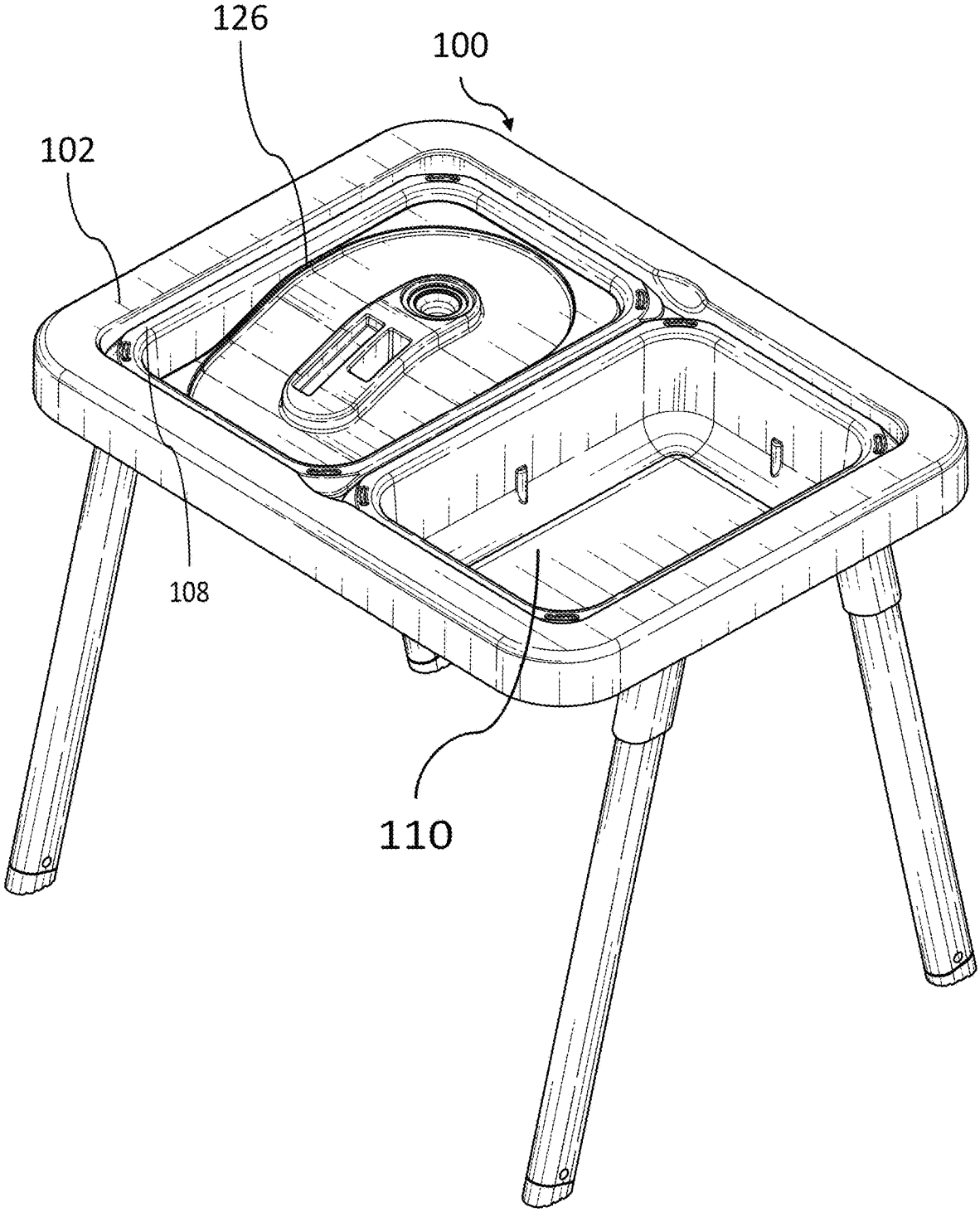
FIG. 32 is a top perspective view of a sensory table having two bins, no lids, and a play tray inserted into one of the bins.

FIG. 32 is a top perspective view of a sensory table 100 having two bins 108/110, no lids, and a play tray 126 inserted into one of the bins. The play tray 126 may fit somewhat snugly within one of the bins 108/110, such that the play tray 126 will not significantly slide around. The play tray 126 may be removable from the bins 108/110. The play tray 126 may fit fully inside the bins 108/110 height-wise, so that the play tray 126 will not interfere with placement of the lids 104/106 while the play tray 126 is stored within one of the bins 108/110 and the sensory table is being used in table mode.

Figure 33:
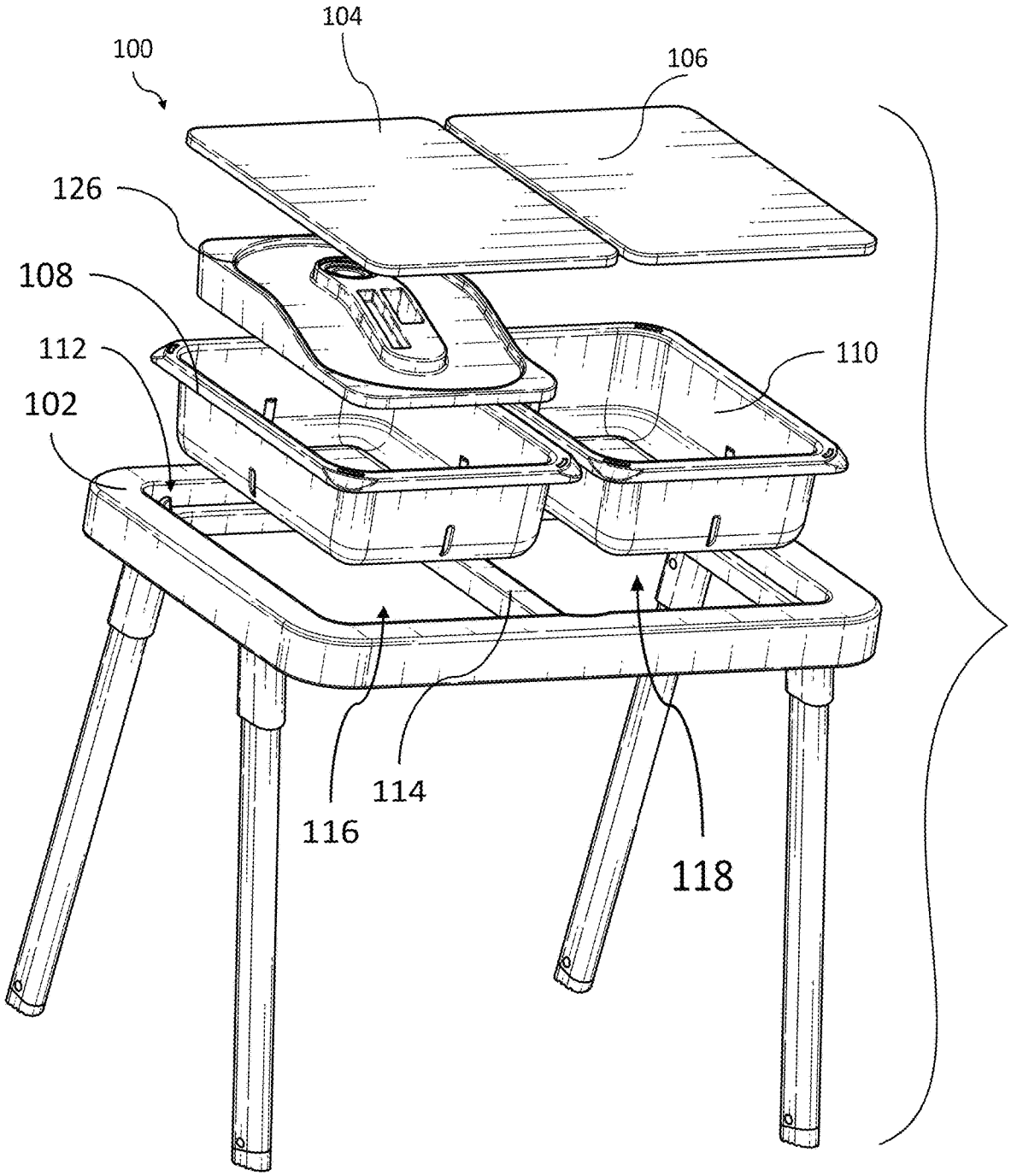
FIG. 33 is an exploded perspective view of a sensory table with two bins, two lids, and a play tray.

FIG. 33 is an exploded perspective view of a sensory table 100 with two bins 108/110, two lids 104/106, and the play tray 126. Further shown in FIG. 33 are the opening 112 in the tabletop surface 102, the bin openings 116/118, and the ledge 114. As such, FIG. 33 demonstrates how various components may be stacked and fit together. When the components of FIG. 33 are nested together (e.g., non-exploded), the pieces may fit together and appear as in FIG. 1.

Figure 34:
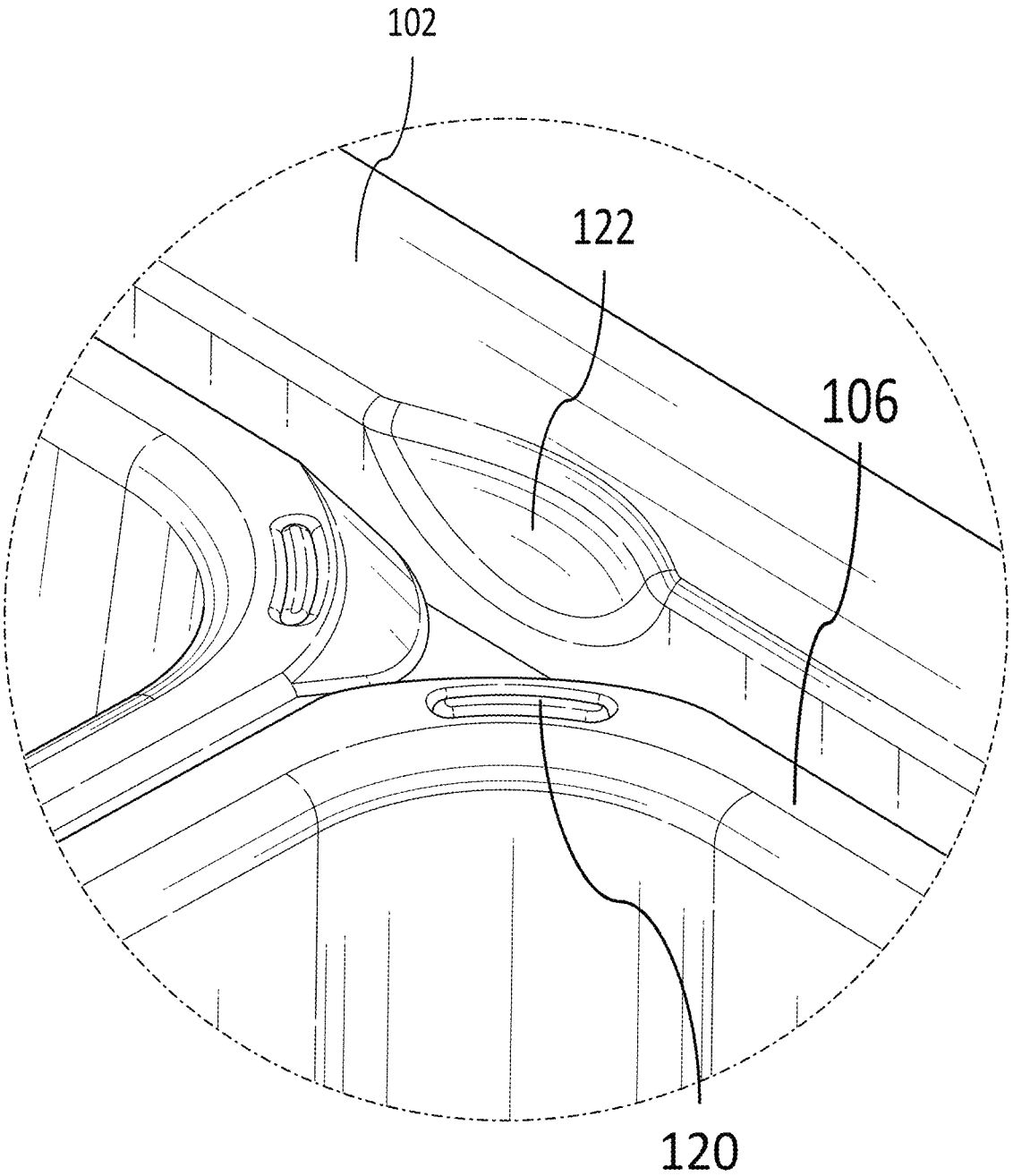
FIG. 34 is a top perspective detail view of an interaction between posts of a sensory table and bins inserted into the sensory table.

FIG. 34 is a top perspective detail view of an interaction between posts of the sensory table 100 and bins inserted into the sensory table 100. In particular, FIG. 34 shows how a post 120 may extend through an opening near a corner of the bin 106. The post 120 may assist in securing the bin 106 in place within the sensory table 100, while also still being available to support a lid as described herein. Since the post 120 is exposed through the top of the bin 106, the bin 106 in this embodiment has a passthrough opening for the post 120. That is, the opening in which the post 120 fits is a hole that completely passes through a lip of the bin 106. In other embodiments, a bin may have an opening that does not pass all the way through the bin (e.g., an opening only on a bottom side of a lip). In various embodiments, other interference fit mechanisms between a bin and sensory table may be used, such as a tongue and groove feature on the side of a bin and within the opening 112 or one of the bin openings 116/118. In various embodiments, the bins 104/106 may also be held in place by the openings 116/118 formed in the ledge 114 itself. If a passthrough opening in a lip of a bin is not used for the post 120 to passthrough, other mechanisms for supporting a lid or lids may be used (e.g., as shown in and described with respect to FIGS. 157-162). FIG. 34 further shows one of the cutouts 122 in a closer view.

Figure 35:
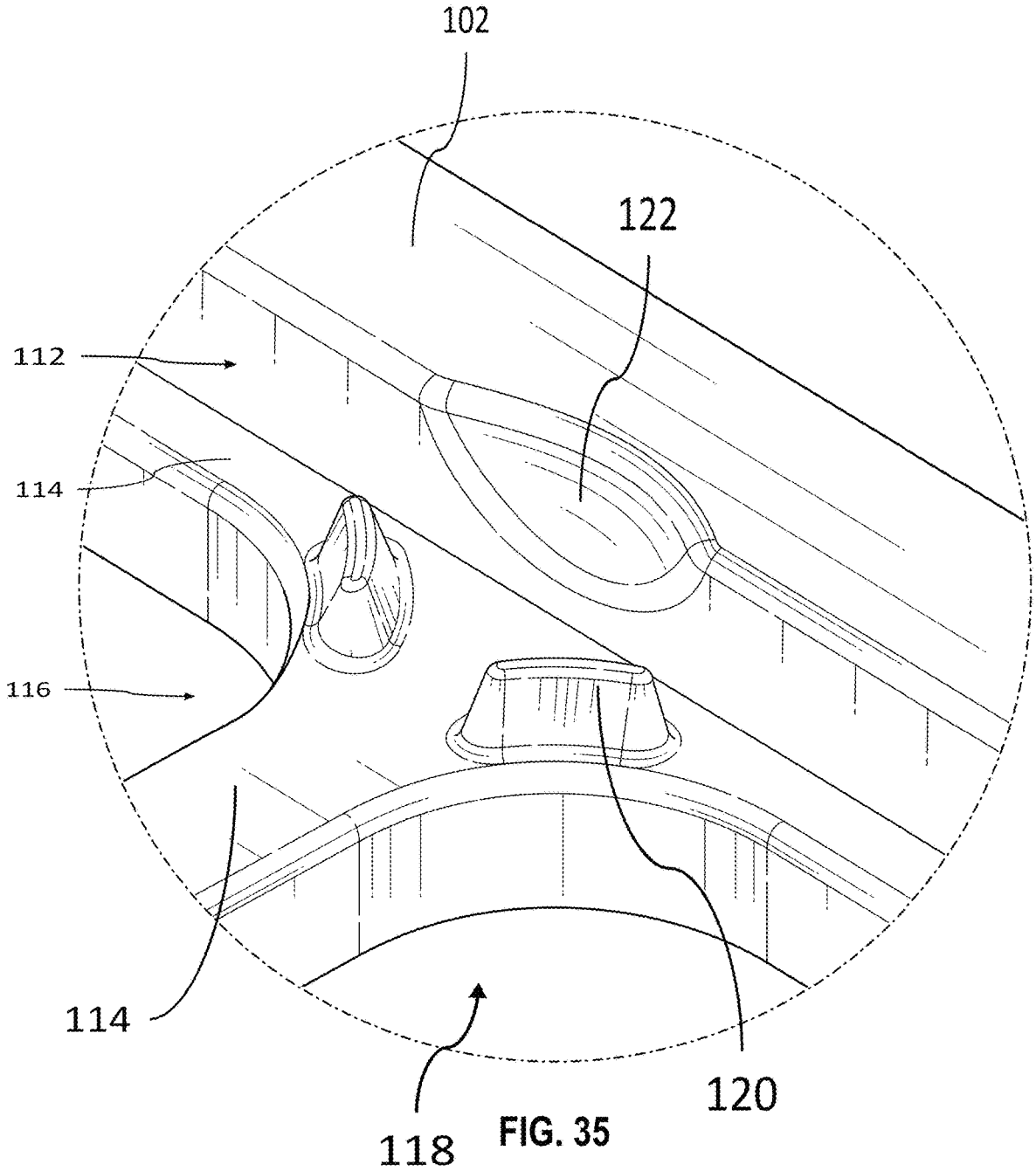
FIG. 35 is a top perspective detail view of the posts of a sensory table without bins inserted.

FIG. 35 is a top perspective detail view of the posts of a sensory table 100 without bins inserted. Without the bins and lids, the posts 120 and the ledge 114 are fully exposed and nothing is in the opening 112, 116, and 118.

Figure 36:
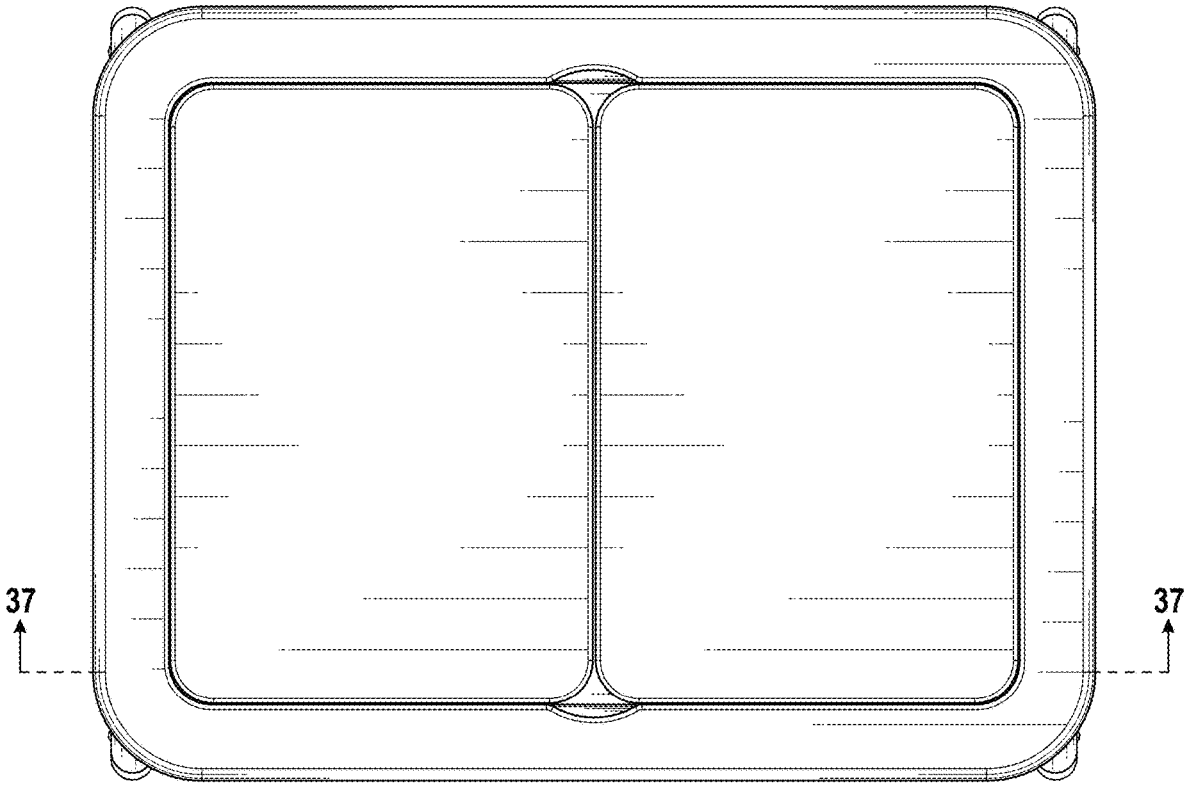
FIG. 36 is a top view of a sensory table with lids and bins.
Figure 37:
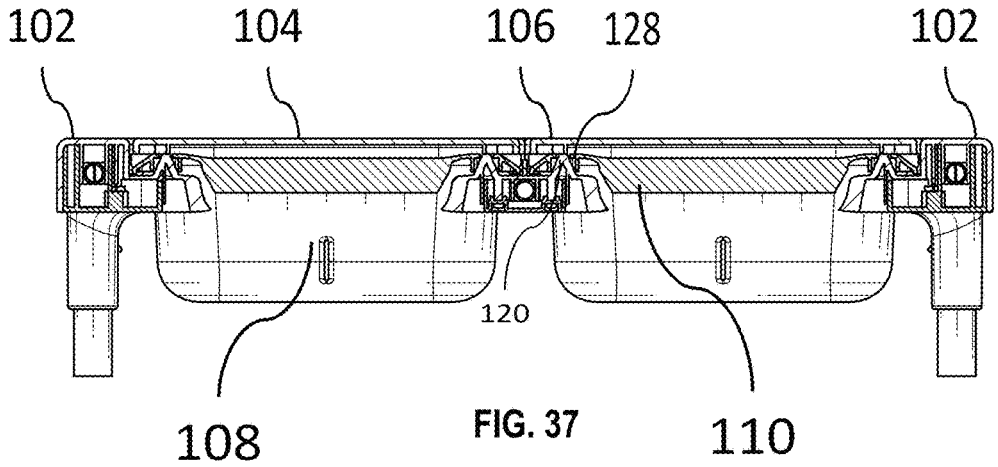
FIG. 37 is a cross-sectional view of the sensory table of FIG. 36.

FIG. 36 is a top view of a sensory table 100 with lids 104/106 and bins 108/110. FIG. 37 is a cross-sectional view of the sensory table 100 of FIG. 36 taken along the section view line of FIG. 36. The bin 110 includes a lip 128 that has an opening for the post 120 as described herein. A top of the post 120 is approximately even with a top surface of the lip 128 of the bin 110. As such, the post 120 may still support a bottom surface or portion of the lid 106. Similarly, the lid 104 may be supported by other posts in the same way. The lids 104/106 may be supported even if the bins 108/110 are not present as shown in and described with respect to FIGS. 38 and 39. In addition, as is shown in FIG. 37, the top surfaces of the lids 104 and 106 generally align with the tabletop surface 102 to form a generally flat and contiguous surface that can serve as a table.

Figure 38:
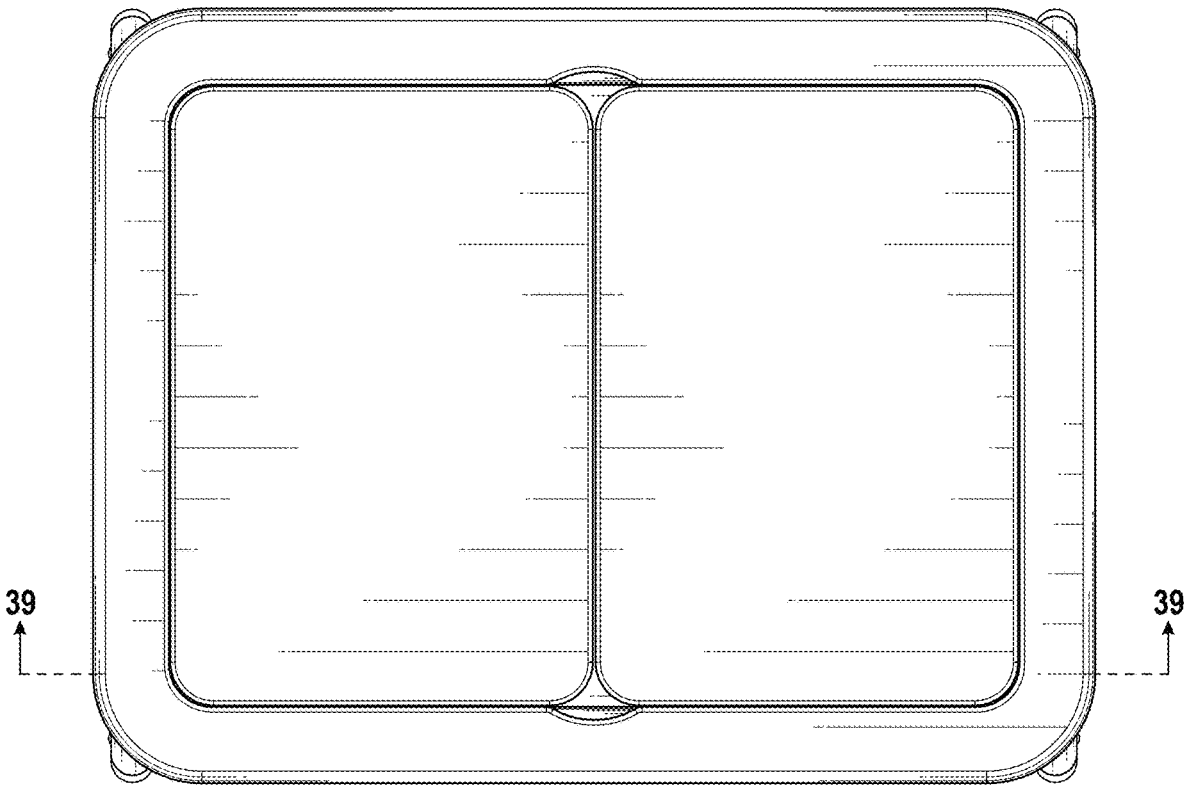
FIG. 38 is a top view of a sensory table with lids and no bins.
Figure 39:
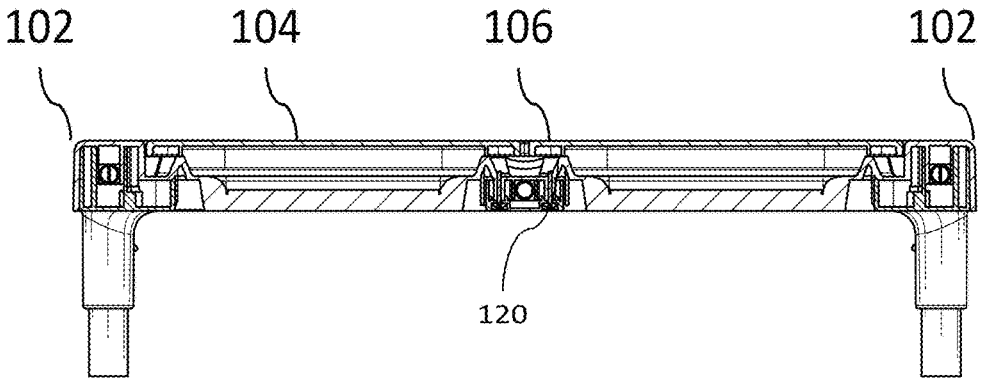
FIG. 39 is a cross-sectional view of the sensory table of FIG. 38.

Similarly, FIG. 38 is a top view of a sensory table 100 with lids and no bins. FIG. 39 is a cross-sectional view of the sensory table of FIG. 38 taken along the section view line of FIG. 38. The lids 104/106 still sit flat on their respective posts (e.g., the post 120) in the same position as they did in FIG. 37, even without bins present.

As such, described herein are embodiments for a table that includes that has a tabletop surface with an opening configured to removably receive at least one bin. The table further includes a ledge within the opening to support a lip of the bin while the bin is within the opening. The table further includes a plurality of posts connected to the ledge and within the opening, where each of the plurality of posts are configured to fit into a respective opening (e.g., a passthrough opening) in the lip of the bin to hold the bin in place within the opening. The plurality of posts are further configured to support a lid. While the lid is placed to rest upon the plurality of posts, the lid generally covers the opening (or if there are two lids or more lids, the two or more lids may be placed to generally cover the opening and form a table top).

While the bin is placed within the opening, a top surface of each of the plurality of posts may be exposed and therefore still configured to support the lid. While the lid is placed to rest upon the plurality of posts, the lid and the tabletop surface together may form a generally flat tabletop. The tabletop surface may form a perimeter around the outside edges of the table so that the opening is formed within the outside edges of the table. The ledge within the opening may have a top surface of the ledge that is lower than the tabletop surface, and the ledge may support the lip of one or more bins. While the bin is placed within the opening, a top surface of each of the plurality of posts may be approximately level with a top surface of the lip of the bin. In various embodiments the tabletop surface and the ledge may together or separately form more than one opening to accommodate more than one removable bin.

If an embodiment has two bins and two bin openings (or more than two bins and bin openings), the sensory table may have one lid that covers all bins/openings, may have lids that cover multiple bins/openings but not all bins/openings (e.g., a configuration with three bins may have a first lid that covers two bins and/or openings and a second lid that covers the third bin and/or opening), or there may be a lid associated with each bin and/or opening as shown in the embodiments of FIGS. 1-39.

Accordingly, while a lid is placed to rest upon a plurality of posts (or otherwise placed in a sensory table in other embodiments), a top surface of the lid may be generally aligned with the tabletop surface irrespective of whether a bin is placed within the opening of the sensory table. The tabletop surface of the sensory table may further include, as described herein, a cutout in which the lid is not configured to fill, and the cutout may configured to receive a user's finger to access a bottom edge of the lid and lift the lid out of the opening.

As such, various embodiments with multiple bins may be a sensory table kit that includes a table with a tabletop surface that has a tabletop opening and a ledge within the opening. The ledge may further form a first bin opening and a second bin opening. The table further includes a first set of posts connected to the ledge, adjacent to the first bin opening, and located within the tabletop opening. The table further includes a second set of posts connected to the ledge, adjacent to the second bin opening, and located within the tabletop opening. The sensory table kit further includes a first bin including a first lip around a first outside edge of the first bin. The sensory table kit further includes a second bin including a second lip around a second outside edge of the second bin. The sensory table kit further includes a first lid and a second lid. The tabletop opening and the first bin opening together are configured to removably receive the first bin. The tabletop opening and the second bin opening together are configured to removably receive the second bin. The ledge is configured to support the first lip of the first bin while the first bin is within the tabletop opening and the first bin opening. The ledge is configured to support the second lip of the second bin while the second bin is within the tabletop opening and the second bin opening. The first set of posts are configured to fit into first respective lip openings of the first lip of the first bin to hold the first bin in place within the tabletop opening and the first bin opening. The second set of posts are configured to fit into second respective lip openings of the second lip of second first bin to hold the second bin in place within the tabletop opening and the second bin opening. The first of posts are further configured to support the first lid. The second of posts are further configured to support the second lid. While the first lid is placed to rest upon the first set of posts and the second lid is placed to rest upon the second set of posts, a first top surface of the first lid, a second top surface of the second lid, and the tabletop surface together generally form a level tabletop of the sensory table kit.

Further shown and described herein are other various components that may be included in a sensory table kit. Such toys or accessories may be stored in the bins described herein when not in use and covered by the lids. Various aspects may also be used to play with mediums such as water or sand within the sensory table bins.

Figure 40:
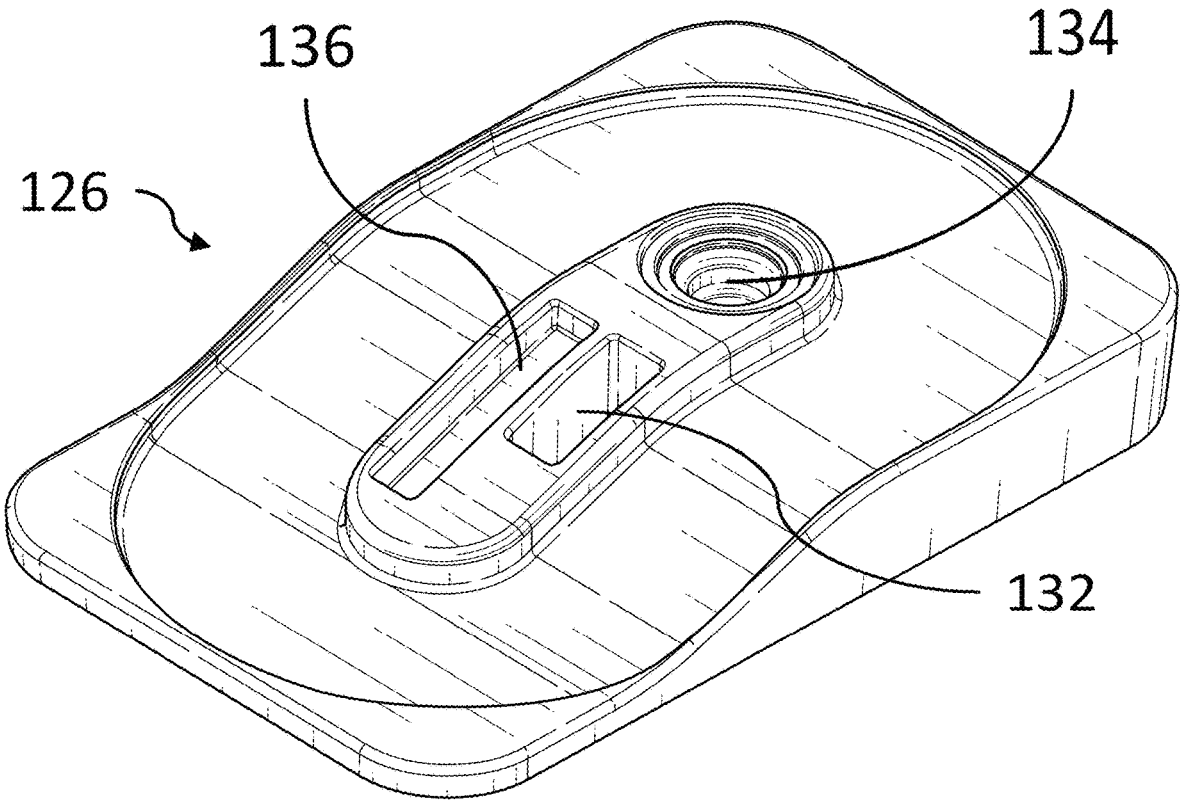
FIG. 40 is a top perspective view of a play tray of a sensory table kit.
Figure 41:
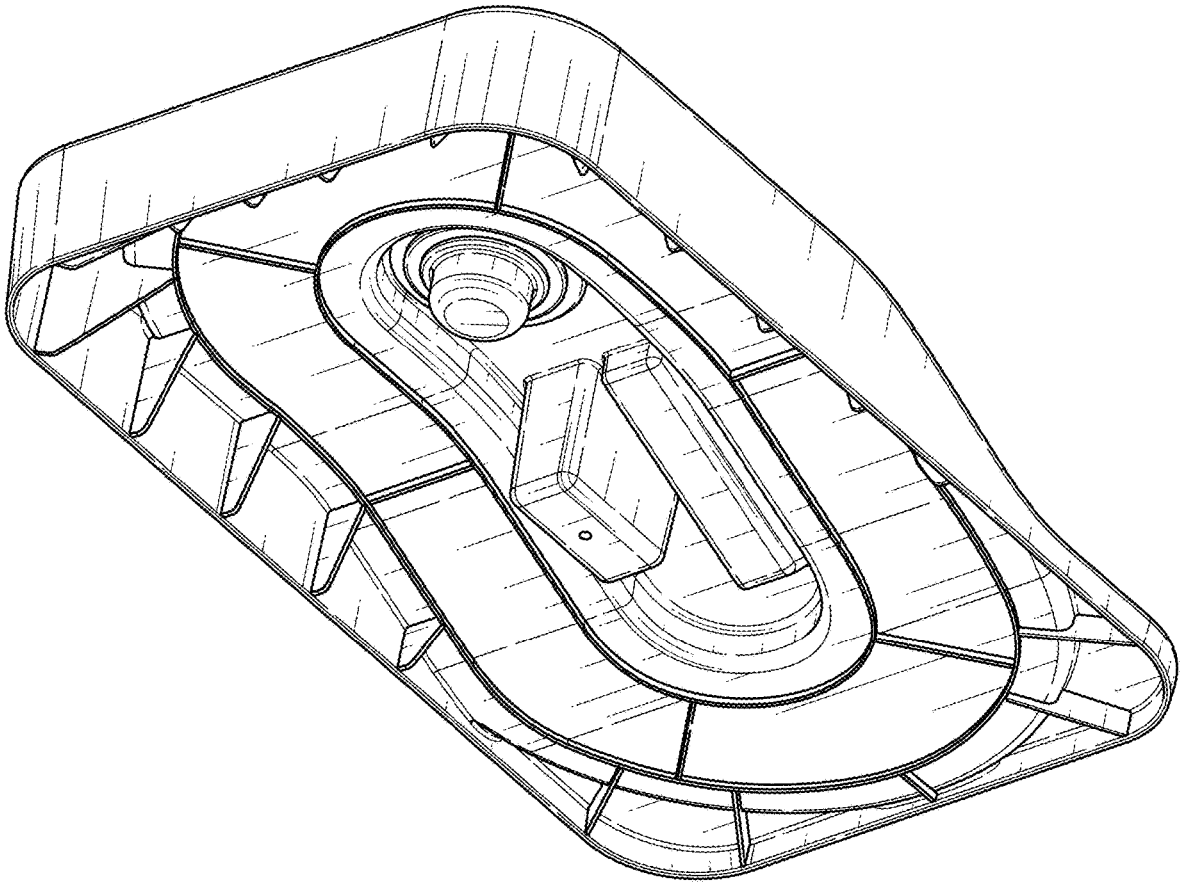
FIG. 41 is a bottom perspective view of the play tray of FIG. 40.
Figure 42:
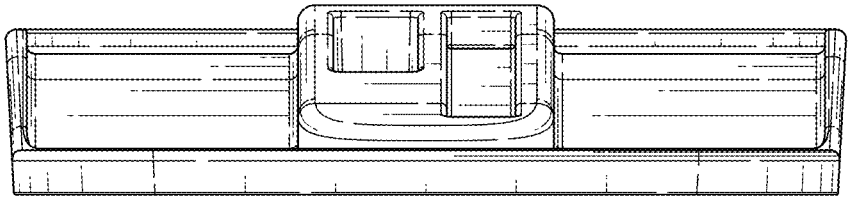
FIG. 42 is a front elevational view of the play tray of FIG. 40.
Figure 43:
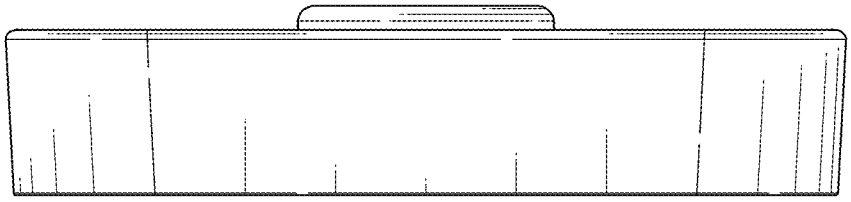
FIG. 43 is a rear elevational view of the play tray of FIG. 40.
Figure 44:
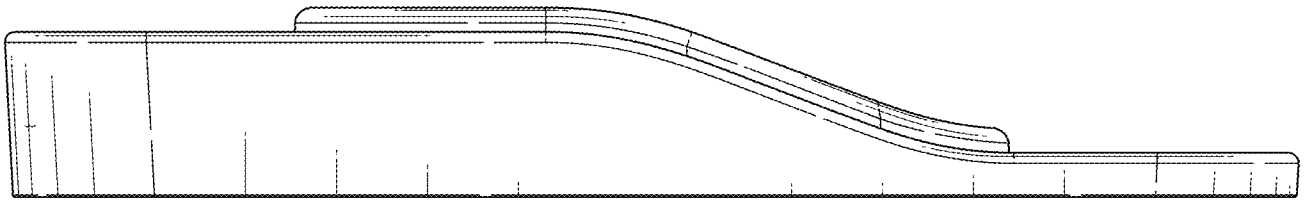
FIG. 44 is a left elevational view of the play tray of FIG. 40.
Figure 45:
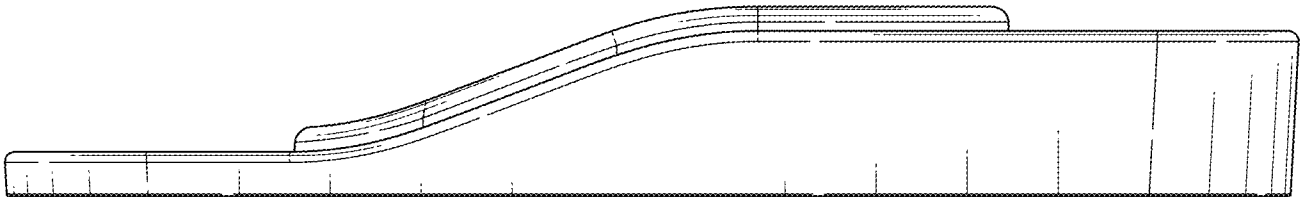
FIG. 45 is a right elevational view of the play tray of FIG. 40.
Figure 46:
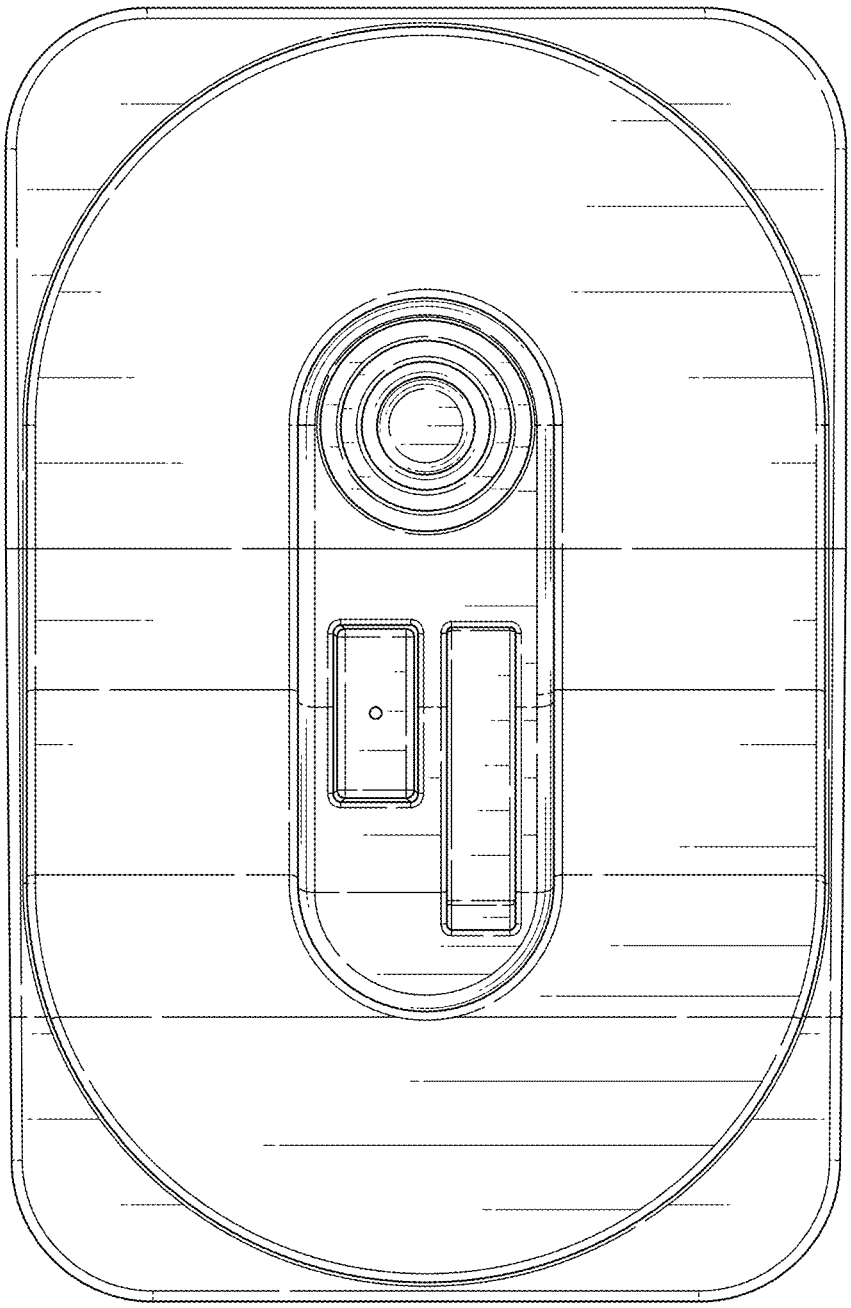
FIG. 46 is a top plan view of the play tray of FIG. 40.
Figure 47:
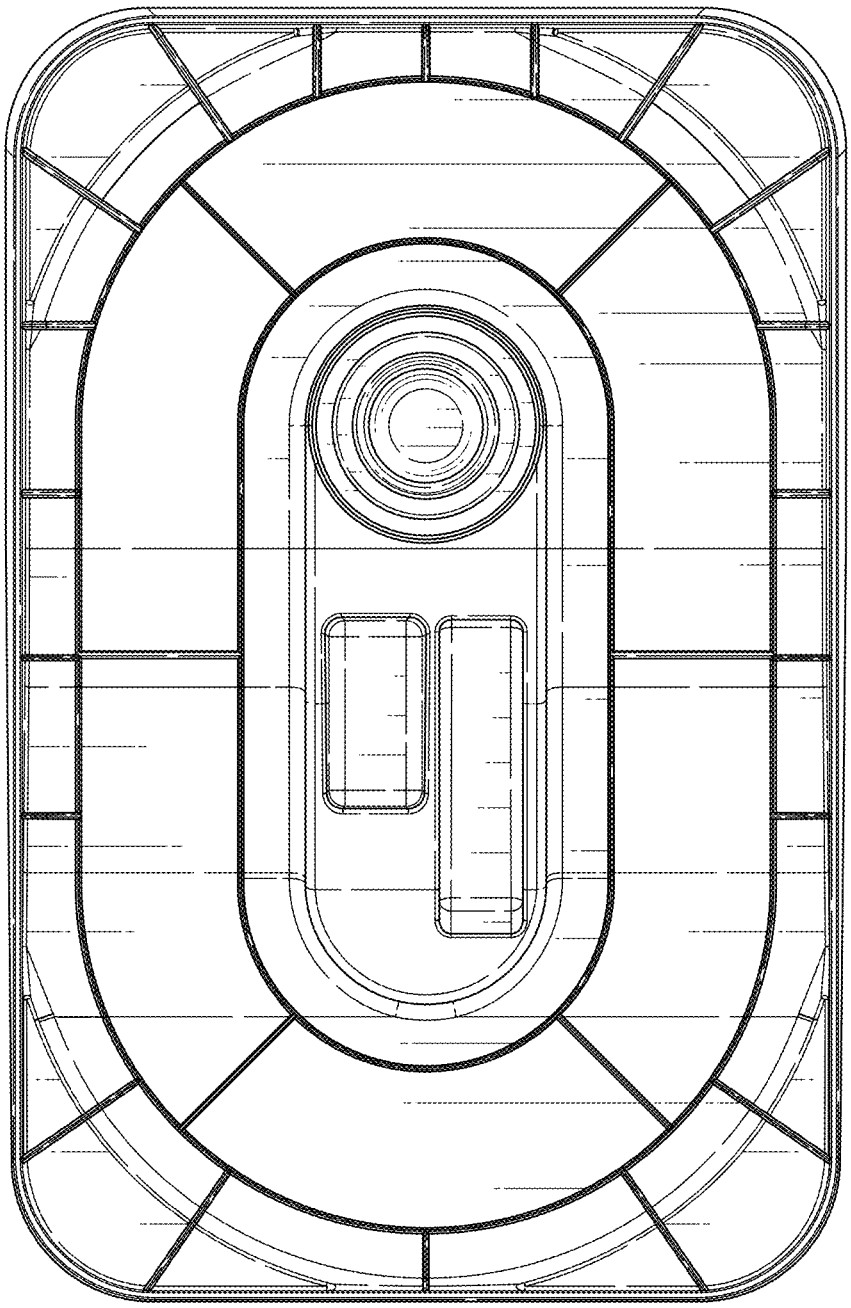
FIG. 47 is a bottom plan view of the play tray of FIG. 40.

FIG. 40 is a top perspective view of a play tray 126 of a sensory table kit. FIG. 41 is a bottom perspective view of the play tray 126 of FIG. 40. FIGS. 42-47 show further views of the play tray of FIG. 40. The play tray may include a track 130, for example for a user to have other pieces run around during play (e.g., the bunny, turtle, or snail of FIGS. 112-135). The play tray 126 may include features for interaction with or storage of other components of the sensory table kit. For example, a feature 136 may be shaped for a sawgrass toy such as that of FIGS. 91-97 for storage or play. A feature 134 may be shaped for a post on which the rollers and mushroom cap strainer of FIGS. 48-76 may be stacked and placed as shown in FIG. 156, for example. A feature 132 may be used for storage of tongs, such as those shown in FIGS. 77-83. In this way, the play tray 126 may be used in combination with play of several objects and/or for storage of several objects.

Figure 49:
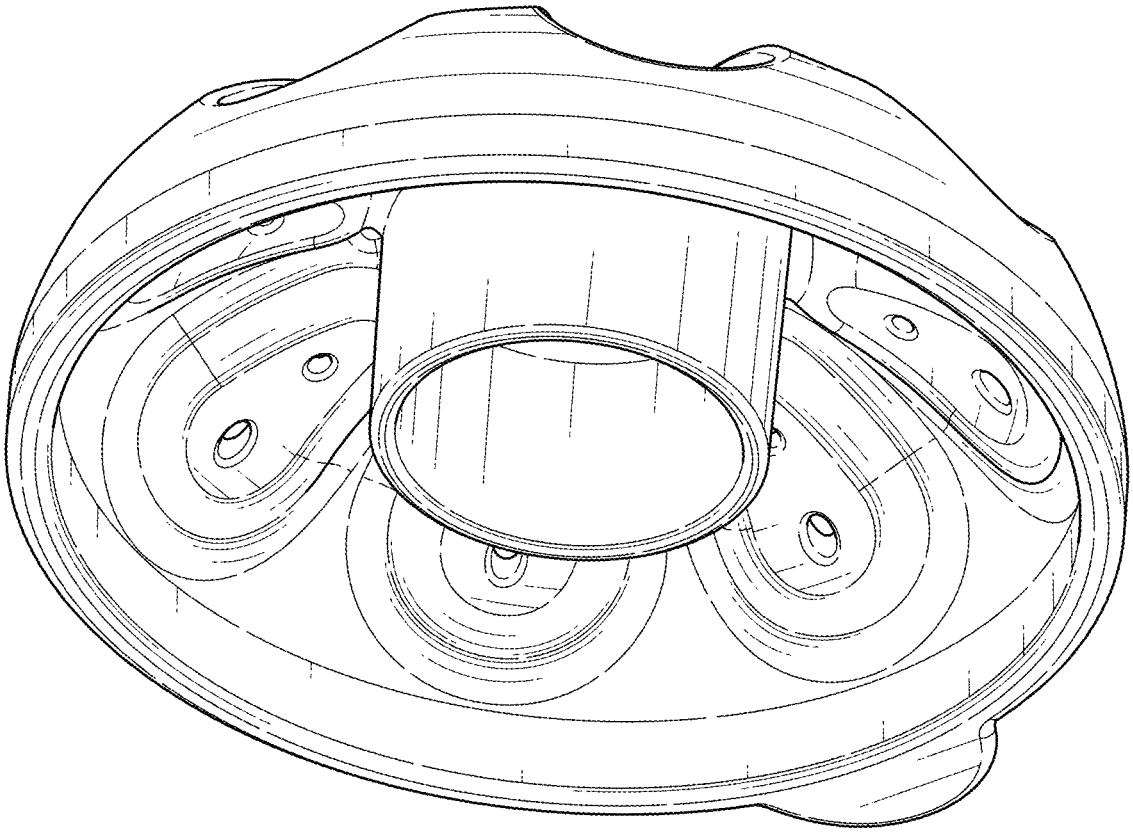
FIG. 49 is a bottom perspective view of the mushroom cap strainer of FIG. 48.
Figure 50:
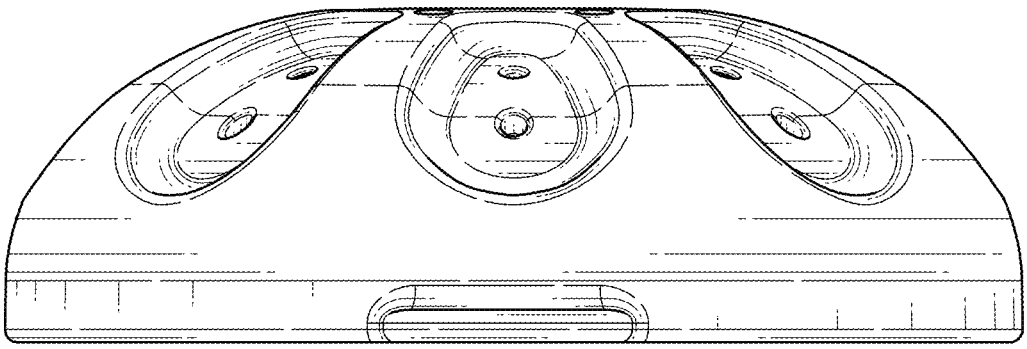
FIG. 50 is a front elevational view of the mushroom cap strainer of FIG. 48.
Figure 51:
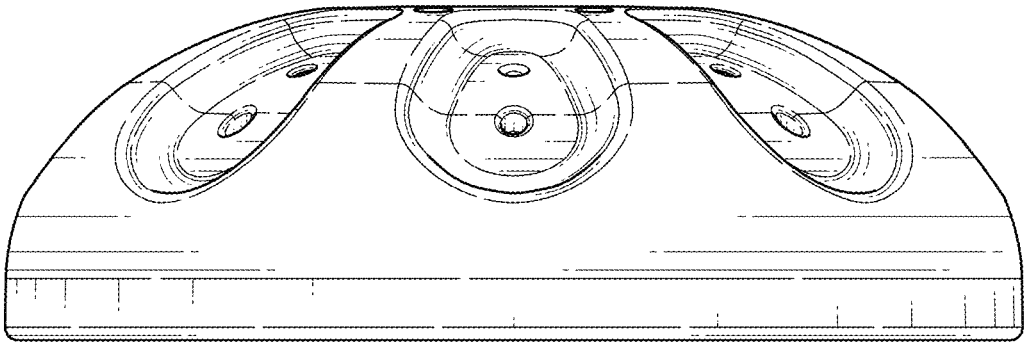
FIG. 51 is a rear elevational view of the mushroom cap strainer of FIG. 48.
Figure 52:
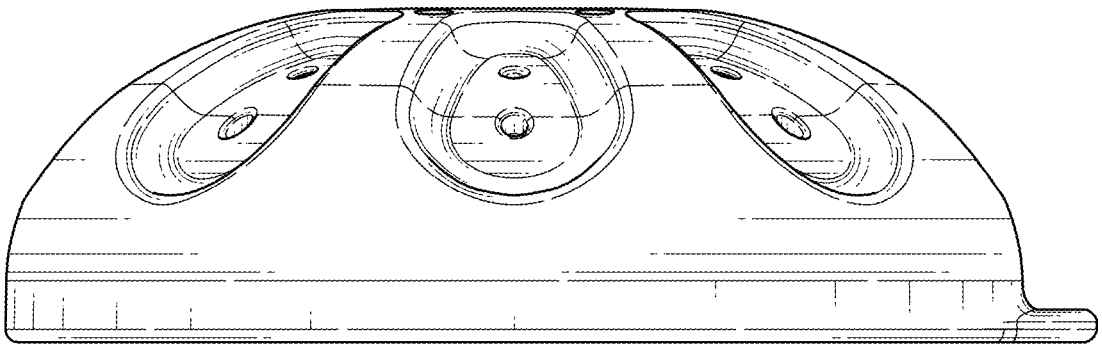
FIG. 52 is a left elevational view of the mushroom cap strainer of FIG. 48.
Figure 53:
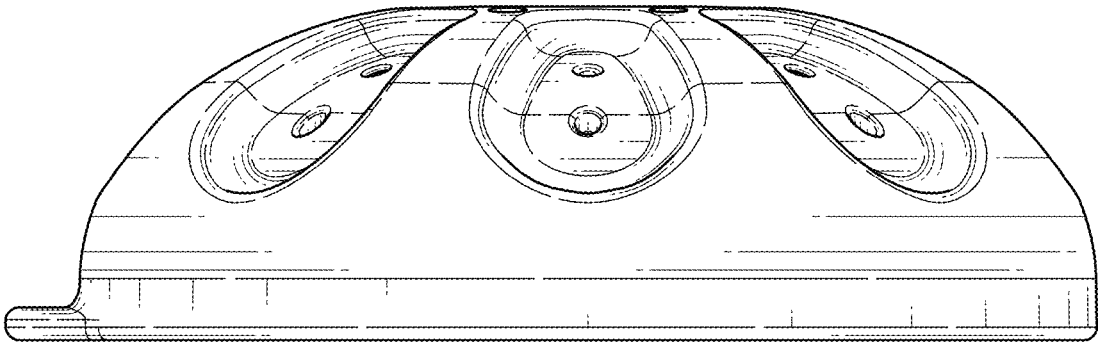
FIG. 53 is a right elevational view of the mushroom cap strainer of FIG. 48.
Figure 54:
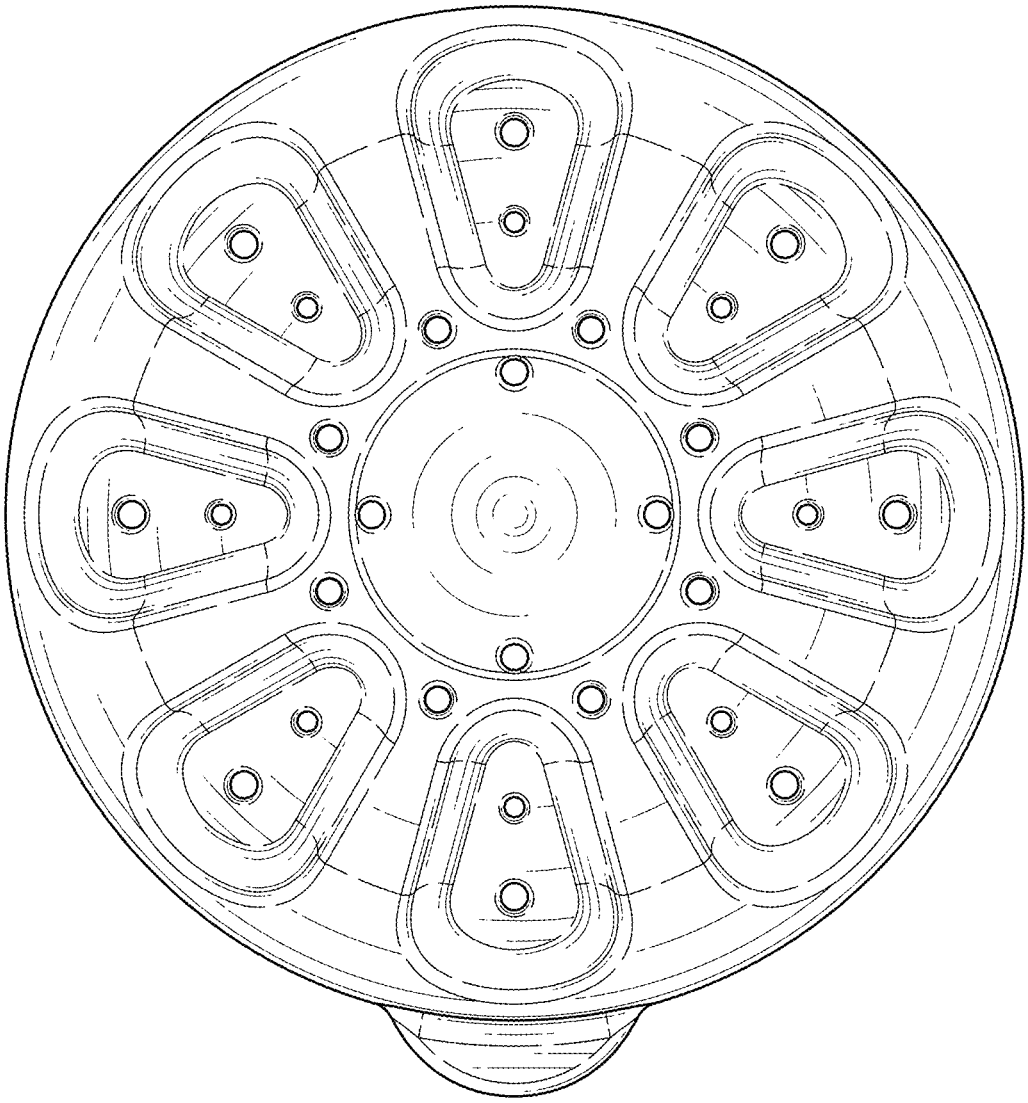
FIG. 54 is a top plan view of the mushroom cap strainer of FIG. 48.
Figure 55:
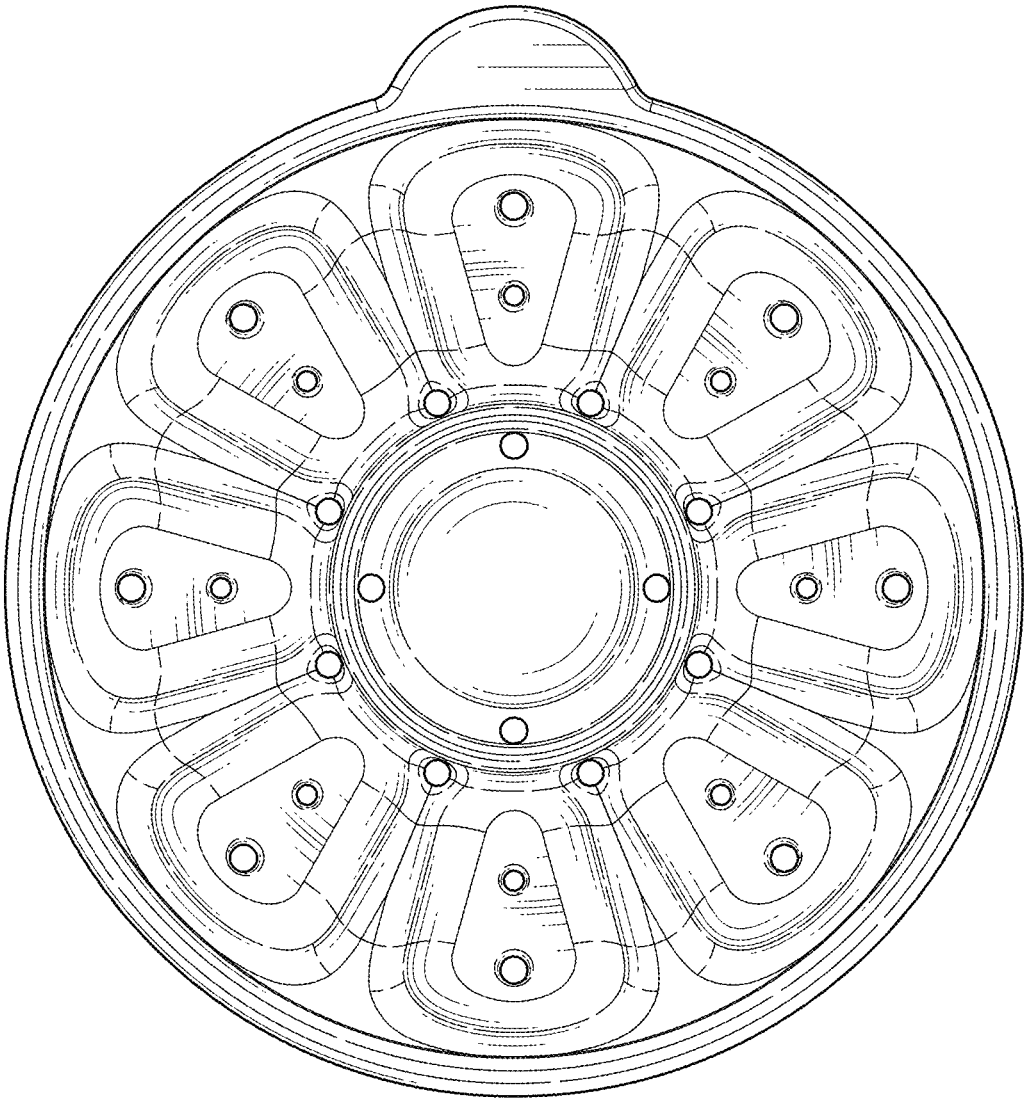
FIG. 55 is a bottom plan view of the mushroom cap strainer of FIG. 48.

FIG. 48 is a top perspective view of a mushroom cap strainer of a sensory table kit. FIG. 49 is a bottom perspective view of the mushroom cap strainer of FIG. 48. FIGS. 50-55 show further views of the mushroom cap strainer of FIG. 48. The mushroom top strainer may have holes for straining and playing with water and may also have shapes formed in its surfaces that are interesting for a child to make impressions with (e.g., into sand).

FIG. 56 is a perspective view of a small roller of a sensory table kit. FIGS. 57-62 show further views of the small roller of FIG. 56. FIG. 63 is a perspective view of a medium roller of a sensory table kit. FIGS. 64-69 show further views of the medium roller of FIG. 63. FIG. 70 is a perspective view of a large roller of a sensory table kit. FIGS. 71-76 show further views of the large roller of FIG. 70. The rollers may also be used, for example to make impressions (e.g., into sand). The rollers may also fit over a wooden peg and be stackable along with the mushroom cap strainer as shown in FIG. 156.

Figure 77:
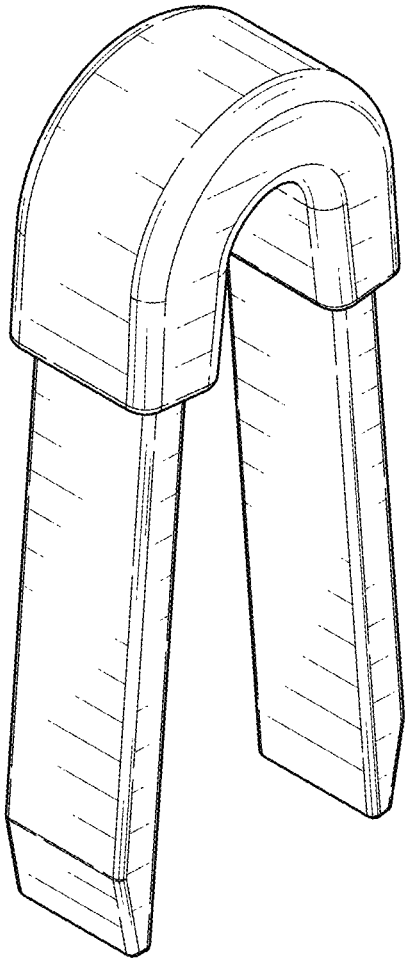
FIG. 77 is a perspective view of tongs of a sensory table kit.
Figure 78:
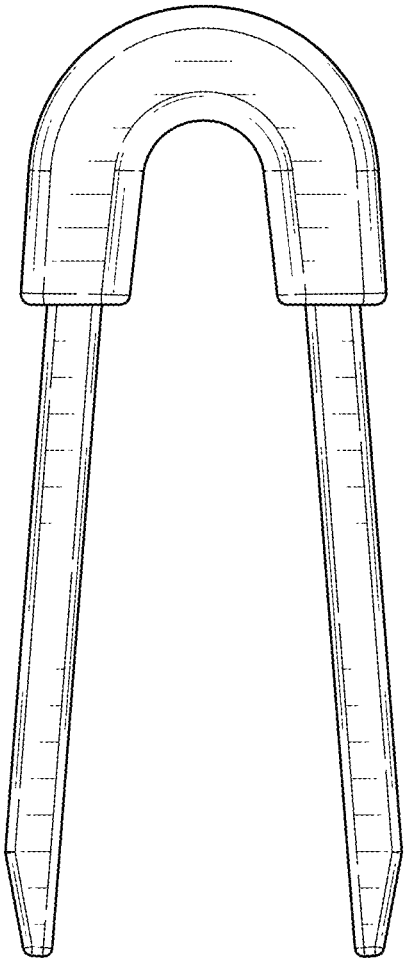
FIG. 78 is a front elevational view of the tongs of FIG. 77.
Figure 79:
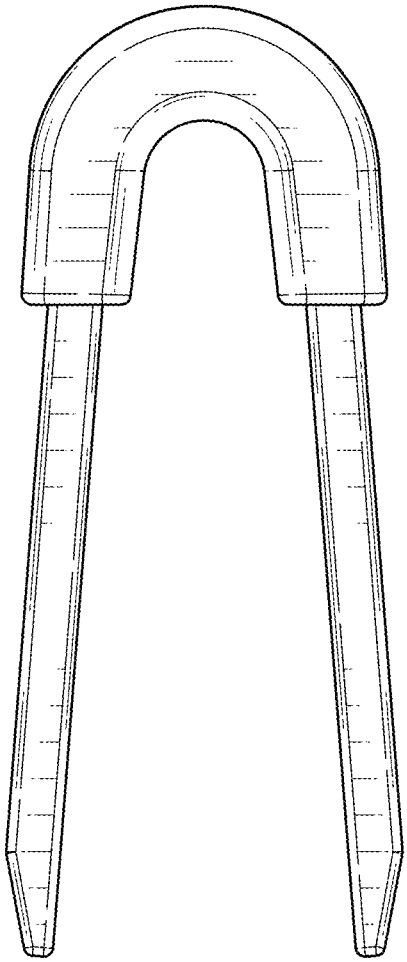
FIG. 79 is a rear elevational view of the tongs of FIG. 77.
Figure 80:
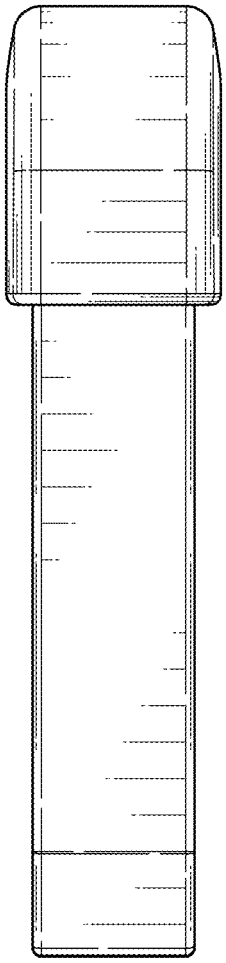
FIG. 80 is a left elevational view of the tongs of FIG. 77.
Figure 81:
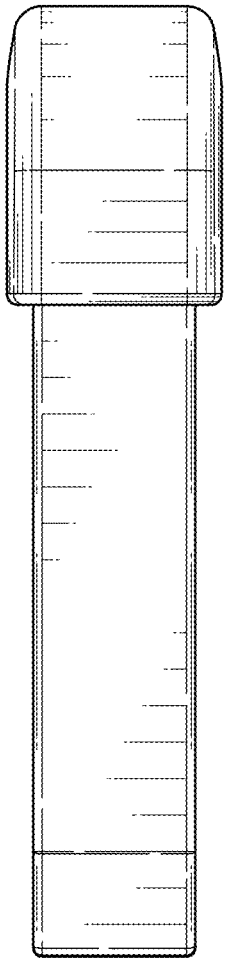
FIG. 81 is a right elevational view of the tongs of FIG. 77.
Figure 82:
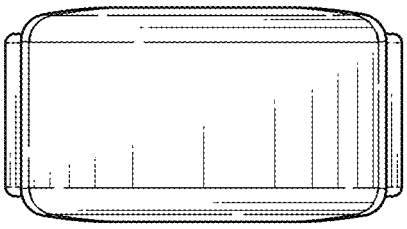
FIG. 82 is a top plan view of the tongs of FIG. 77.
Figure 83:
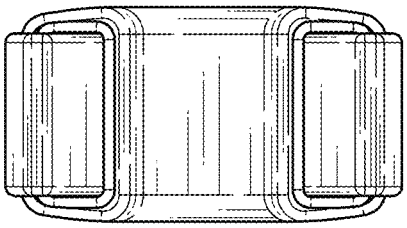
FIG. 83 is a bottom plan view of the tongs of FIG. 77.

FIG. 77 is a perspective view of tongs of a sensory table kit. FIGS. 78-83 show further views of the tongs of FIG. 77. The tongs may further be used for play with a sensor table, such as picking up and manipulating other objects, toys, rocks, etc.

Figure 84:
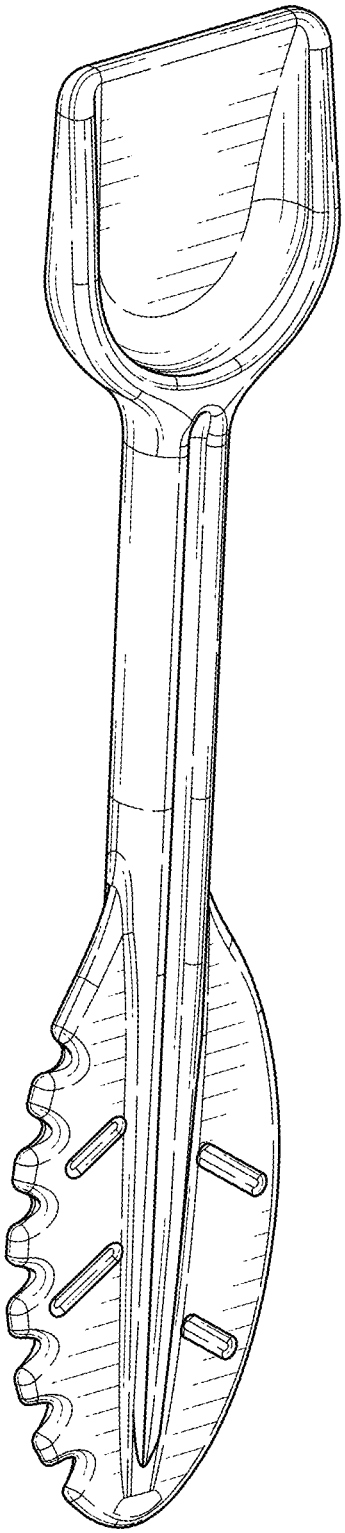
FIG. 84 is a perspective view of a scraper of a sensory table kit.
Figure 85:
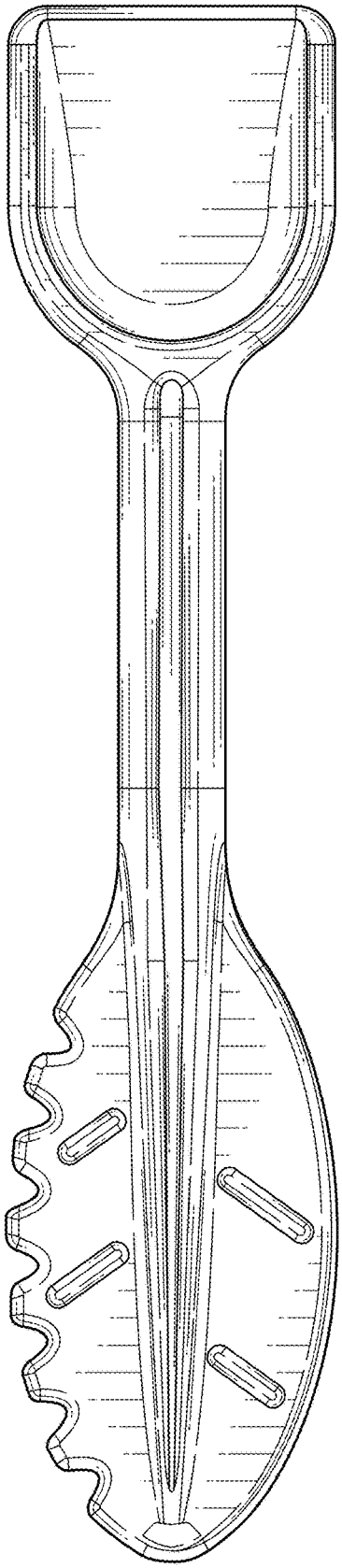
FIG. 85 is a front elevational view of the scraper of FIG. 84.
Figure 86:
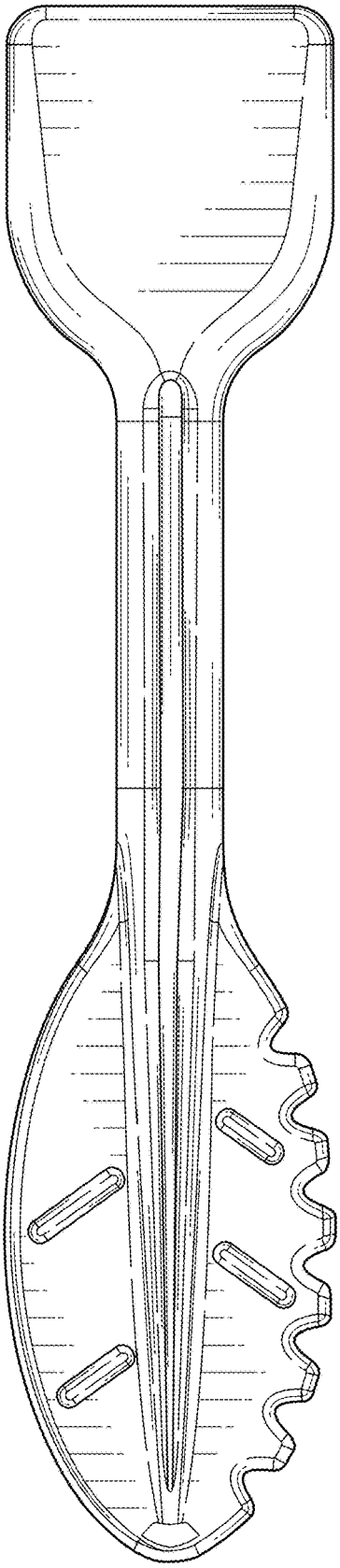
FIG. 86 is a rear elevational view of the scraper of FIG. 84.
Figure 87:
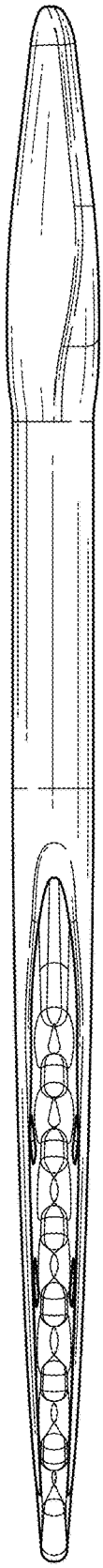
FIG. 87 is a left elevational view of the scraper of FIG. 84.
Figure 88:
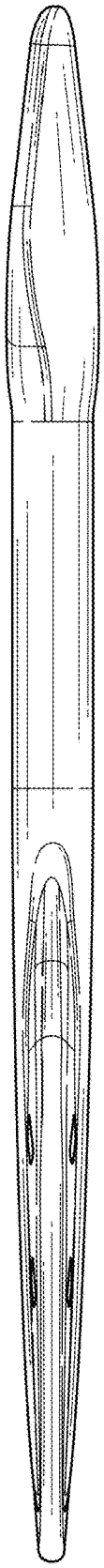
FIG. 88 is a right elevational view of the scraper of FIG. 84.
Figure 89:
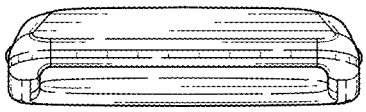
FIG. 89 is a top plan view of the scraper of FIG. 84.
Figure 90:
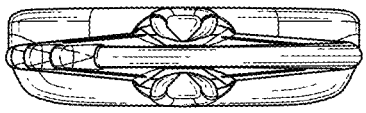
FIG. 90 is a bottom plan view of the scraper of FIG. 84.

FIG. 84 is a perspective view of a scraper of a sensory table kit. FIGS. 85-90 show further views of the scraper of FIG. 84. The scraper may be used to scoop or scrape mediums in the sensory table bins, such as water, sand, dirt, etc.

Figure 91:
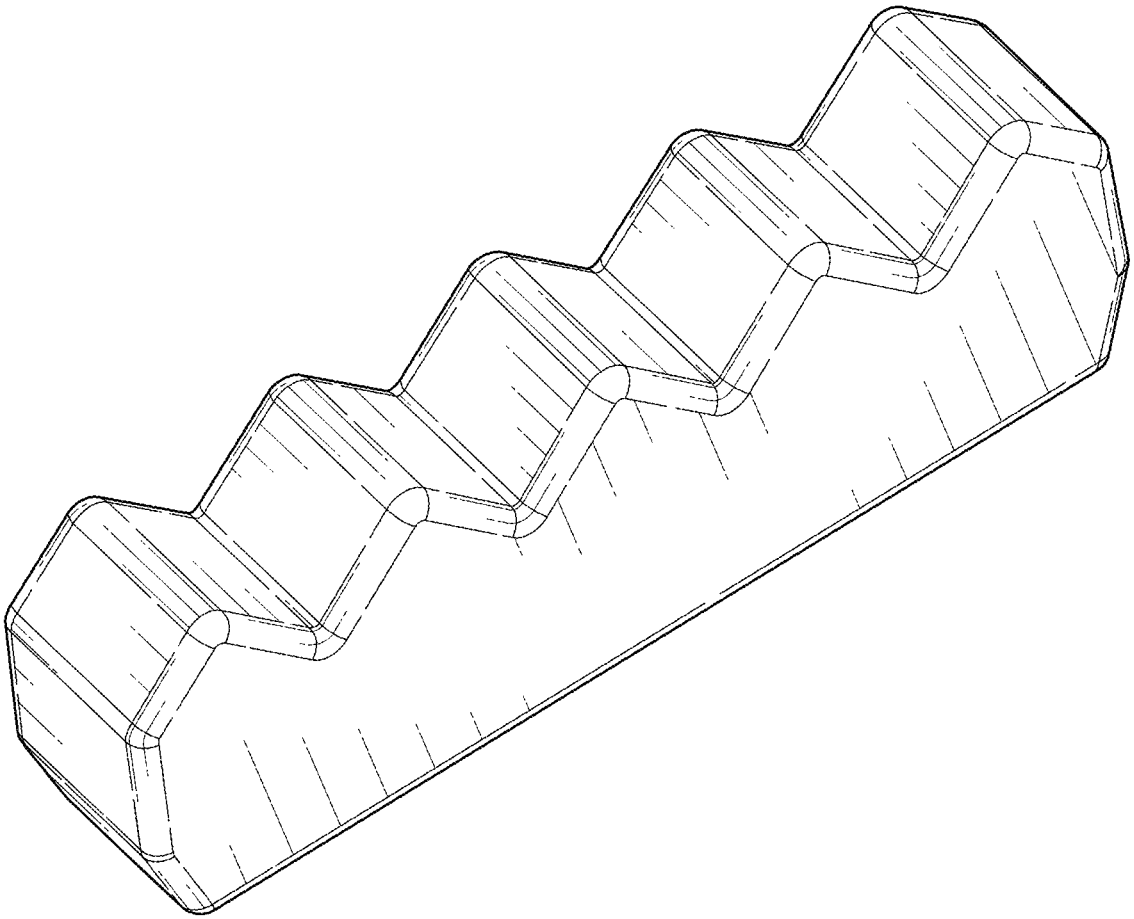
FIG. 91 is a perspective view of a sawgrass toy of a sensory table kit.
Figure 92:
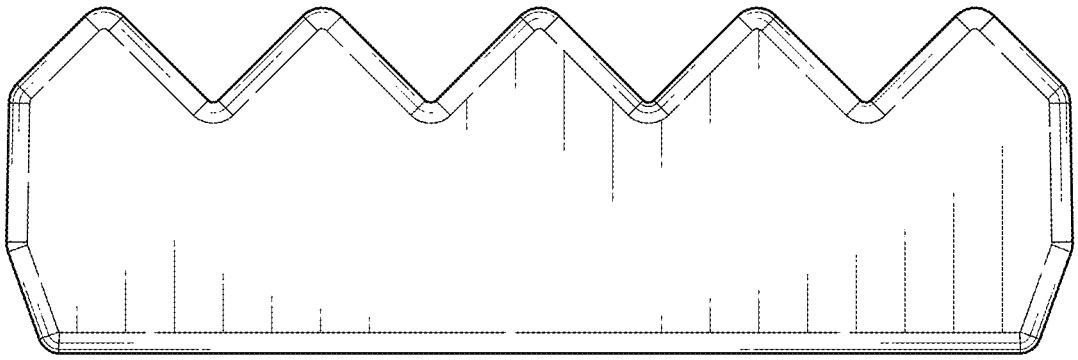
FIG. 92 is a front elevational view of the sawgrass toy of FIG. 91.
Figure 93:
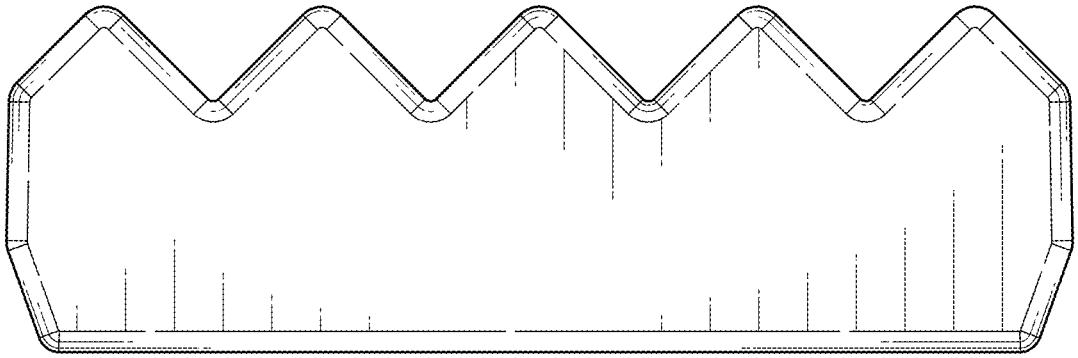
FIG. 93 is a rear elevational view of the sawgrass toy of FIG. 91.
Figure 94:
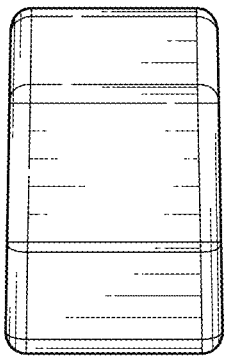
FIG. 94 is a left elevational view of the sawgrass toy of FIG. 91.
Figure 95:
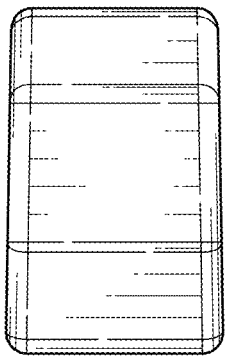
FIG. 95 is a right elevational view of the sawgrass toy of FIG. 91.
Figure 96:
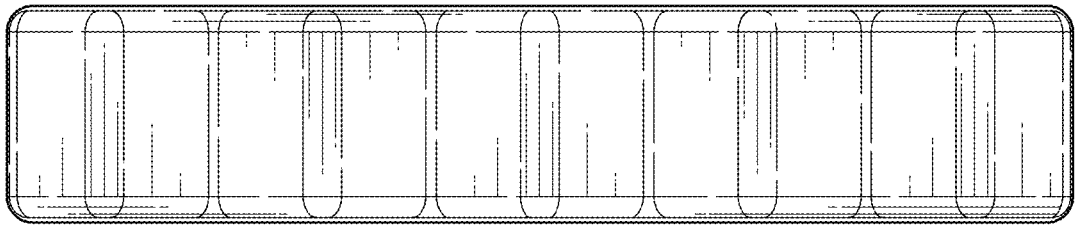
FIG. 96 is a top plan view of the sawgrass toy of FIG. 91.
Figure 97:
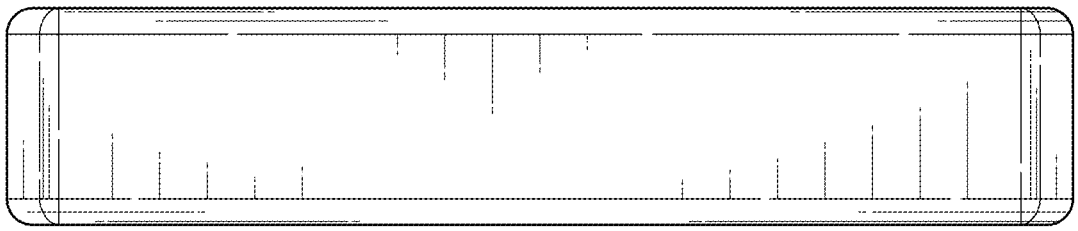
FIG. 97 is a bottom plan view of the sawgrass toy of FIG. 91.

FIG. 91 is a perspective view of a sawgrass toy of a sensory table kit. FIGS. 92-97 show further views of the sawgrass toy of FIG. 91. The sawgrass toy may be used to make impressions in a medium such as sand or dirt. The sawgrass toy may further be scraped with another object such as the scraper of FIGS. 84-90 or the wooden post of FIG. 156 to made sounds.

Figure 98:
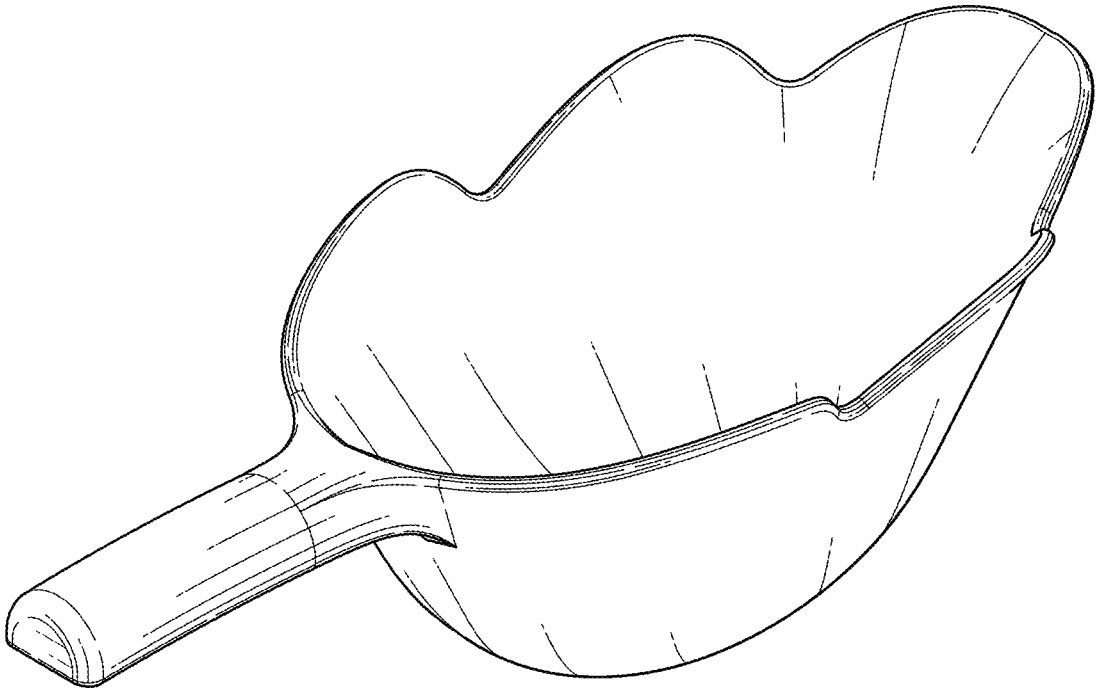
FIG. 98 is a perspective view of a leaf scoop of a sensory table kit.
Figure 99:
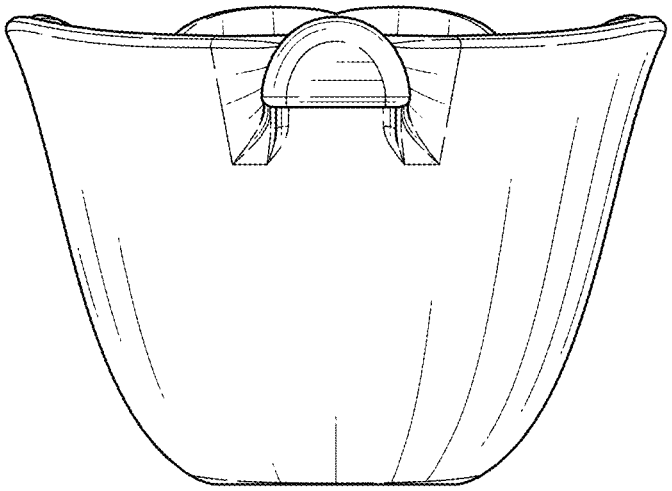
FIG. 99 is a front elevational view of the leaf scoop of FIG. 98.
Figure 100:
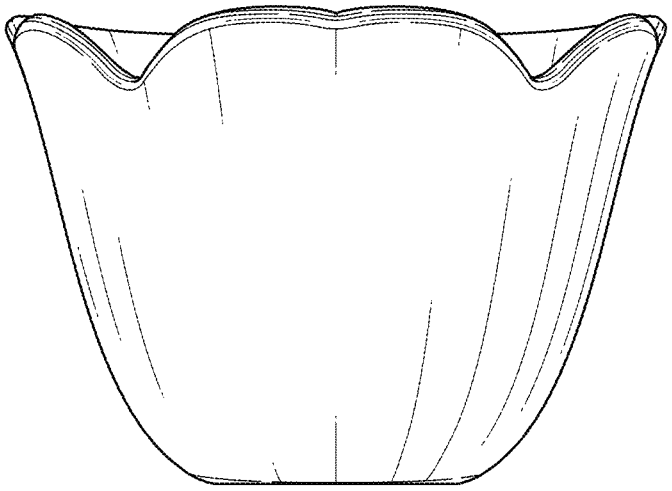
FIG. 100 is a rear elevational view of the leaf scoop of FIG. 98.
Figure 101:
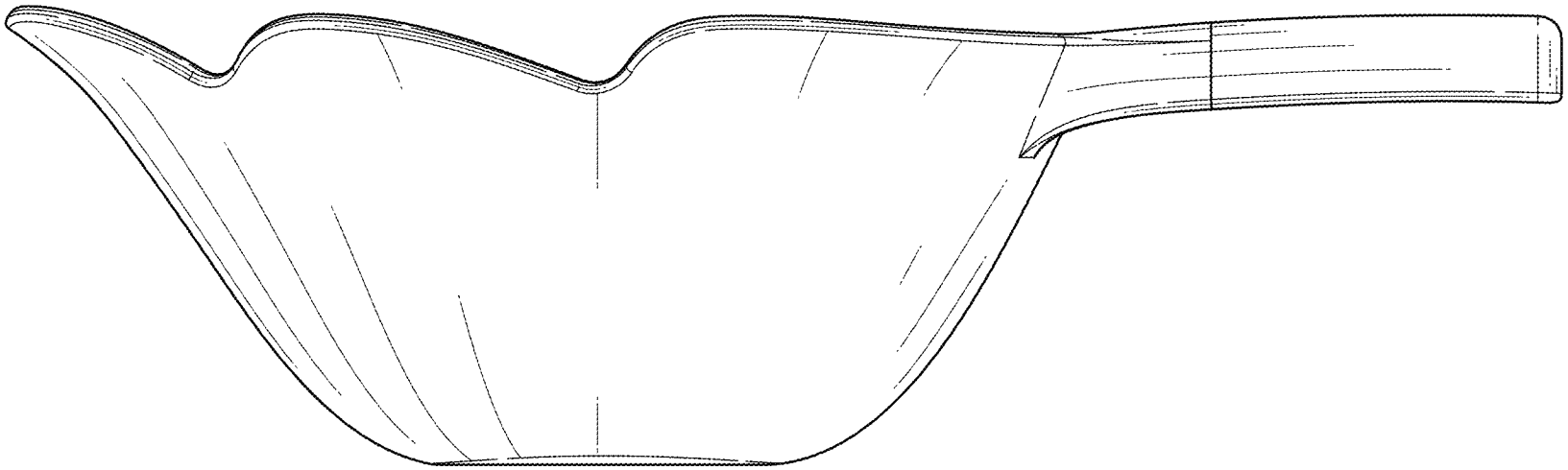
FIG. 101 is a left elevational view of the leaf scoop of FIG. 98.
Figure 102:
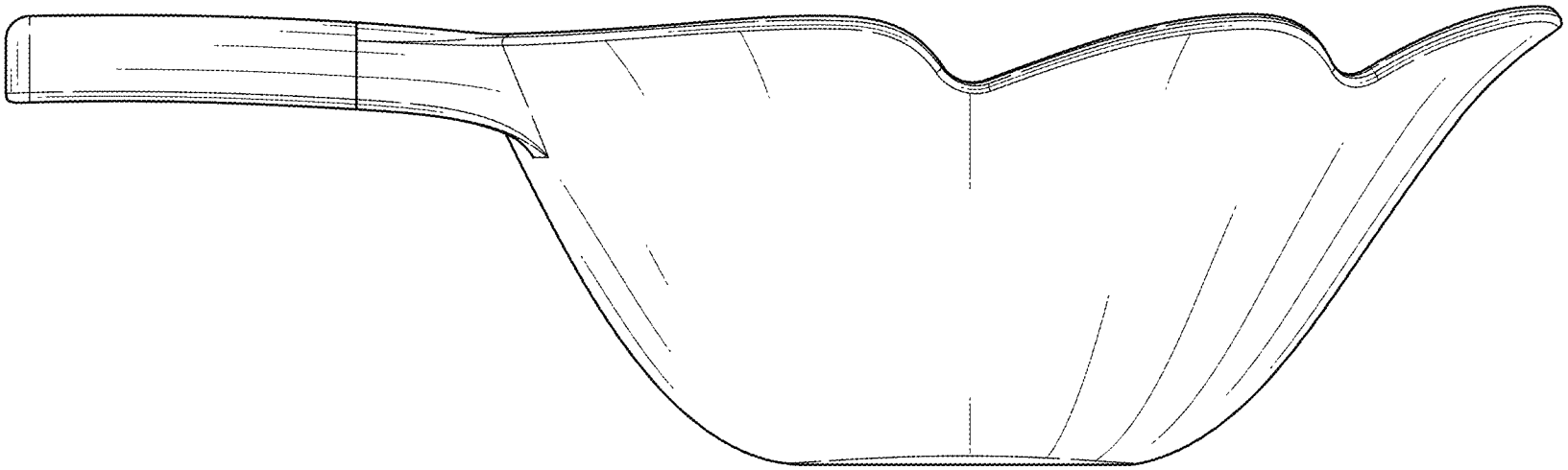
FIG. 102 is a right elevational view of the leaf scoop of FIG. 98.
Figure 103:
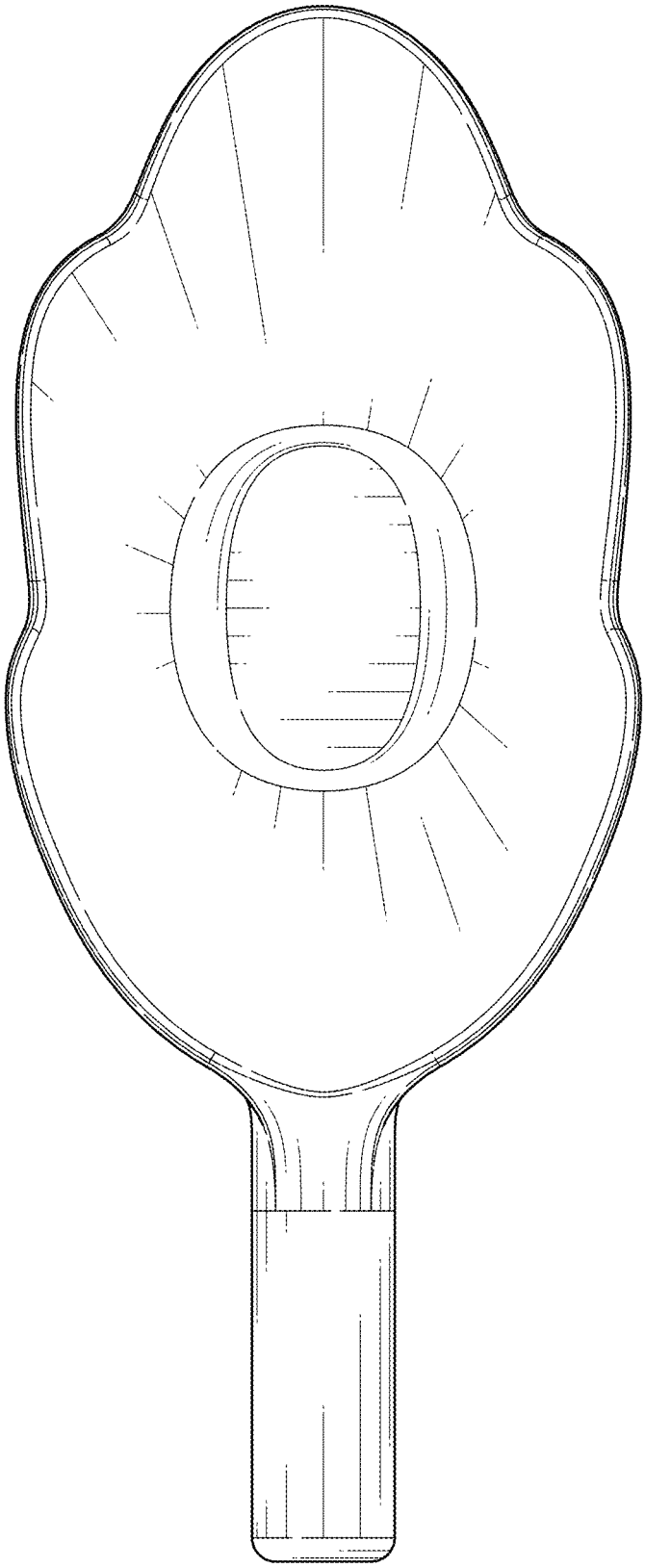
FIG. 103 is a top plan view of the leaf scoop of FIG. 98.
Figure 104:
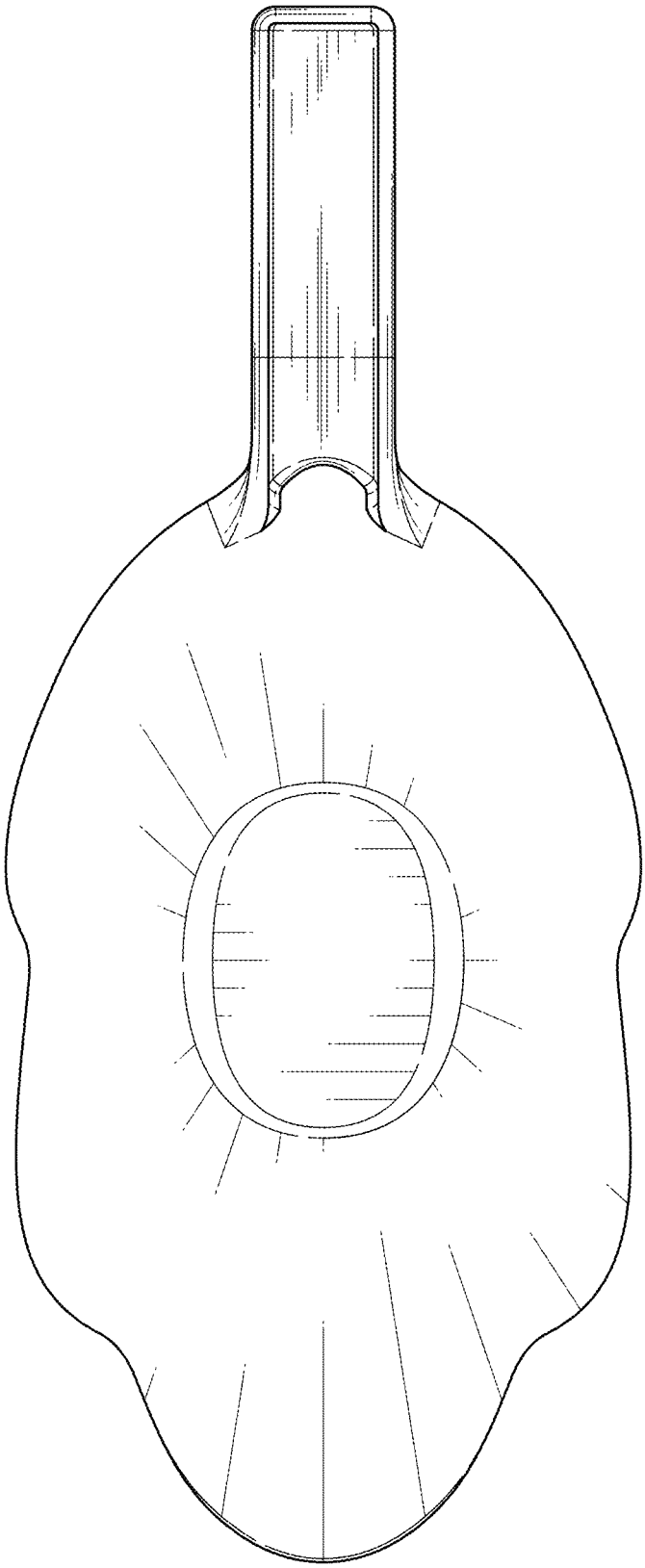
FIG. 104 is a bottom plan view of the leaf scoop of FIG. 98.

FIG. 98 is a perspective view of a leaf scoop of a sensory table kit. FIGS. 99-104 show further views of the leaf scoop of FIG. 98. The leaf scoop may be used to interact with and scoop different mediums in the bins of the sensory table such as water, sand, dirt, etc.

Figure 105:
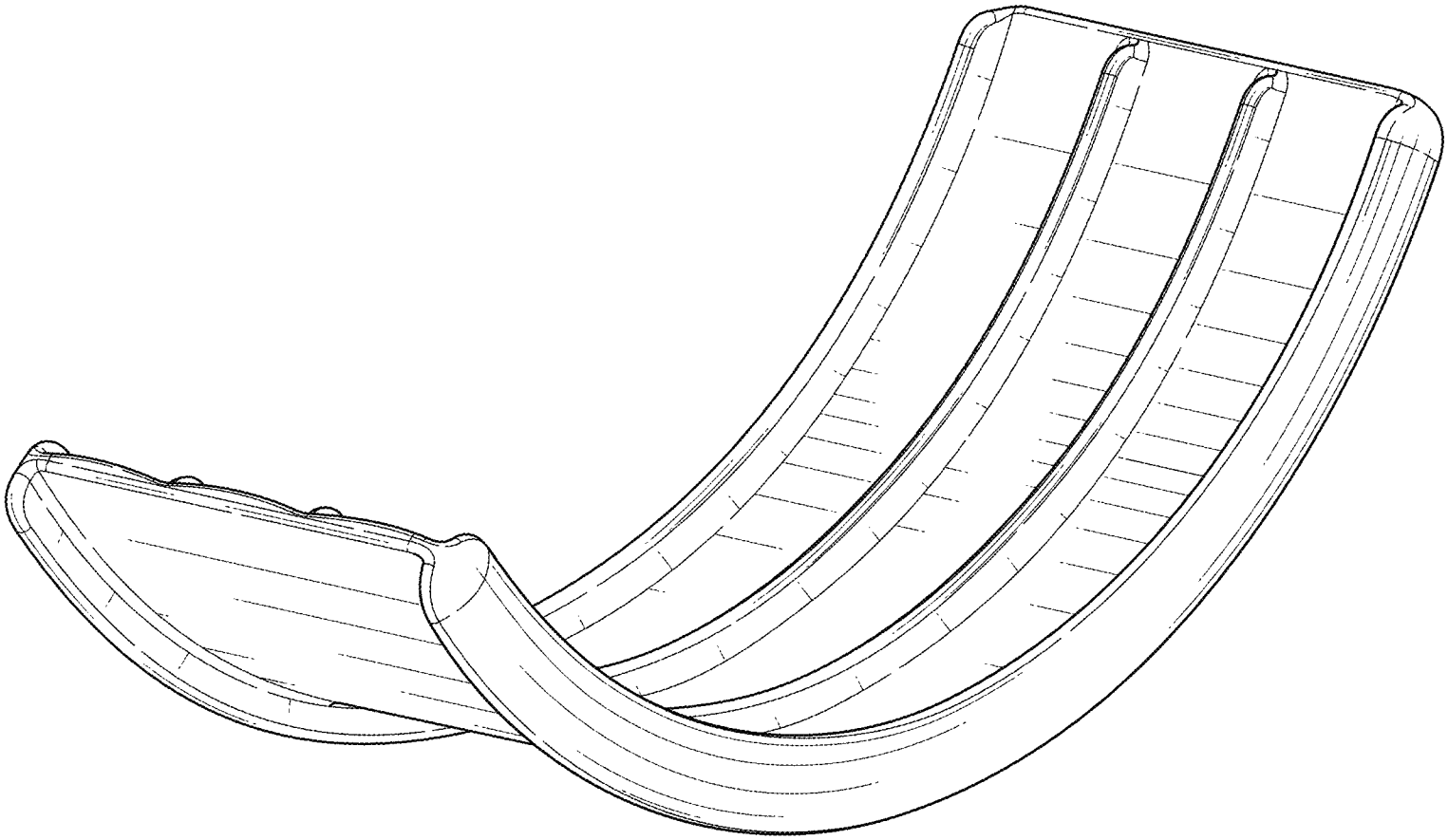
FIG. 105 is a perspective view of a bridge toy of a sensory table kit.
Figure 106:
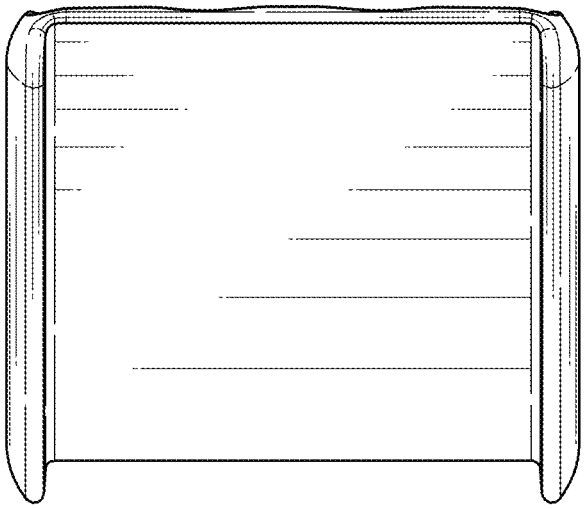
FIG. 106 is a front elevational view of the bridge toy of FIG. 105.
Figure 107:
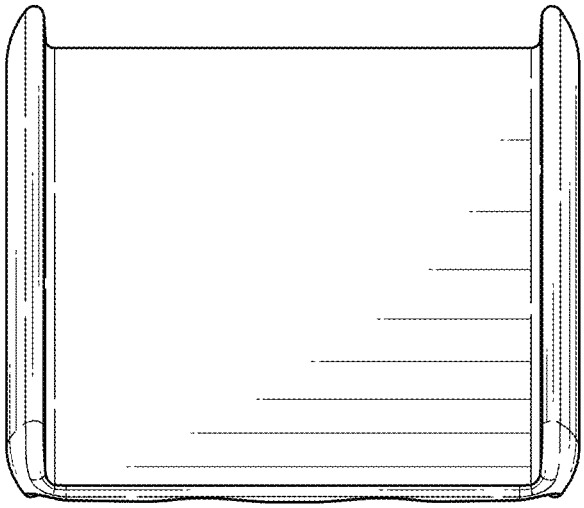
FIG. 107 is a rear elevational view of the bridge toy of FIG. 105.
Figure 108:
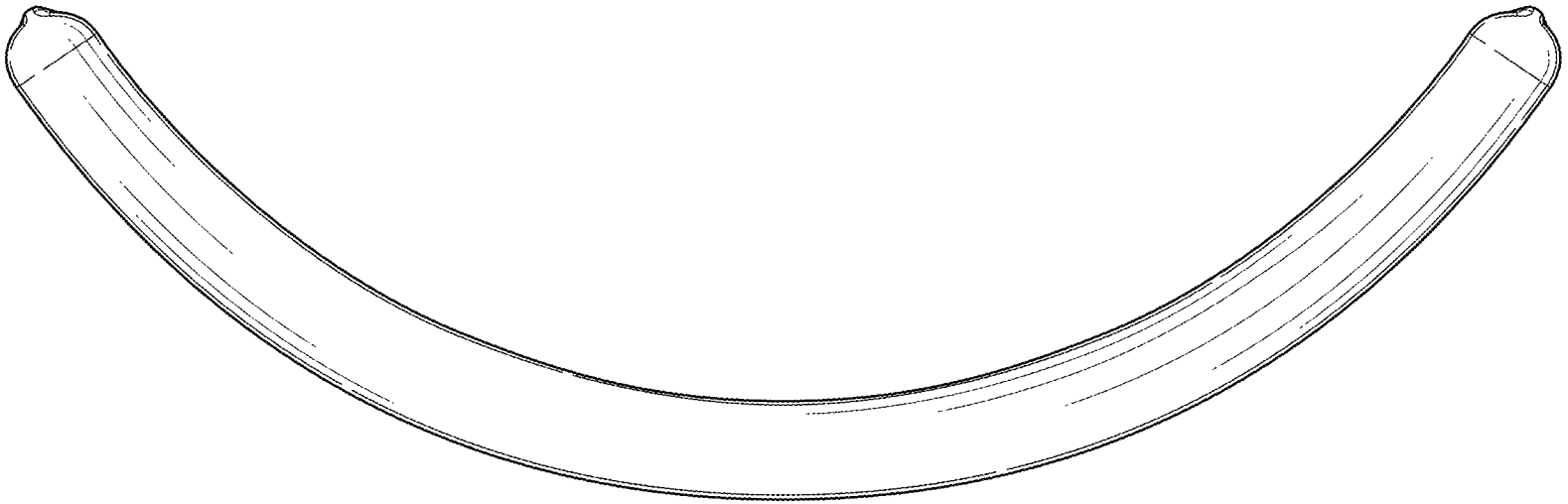
FIG. 108 is a left elevational view of the bridge toy of FIG. 105.
Figure 109:
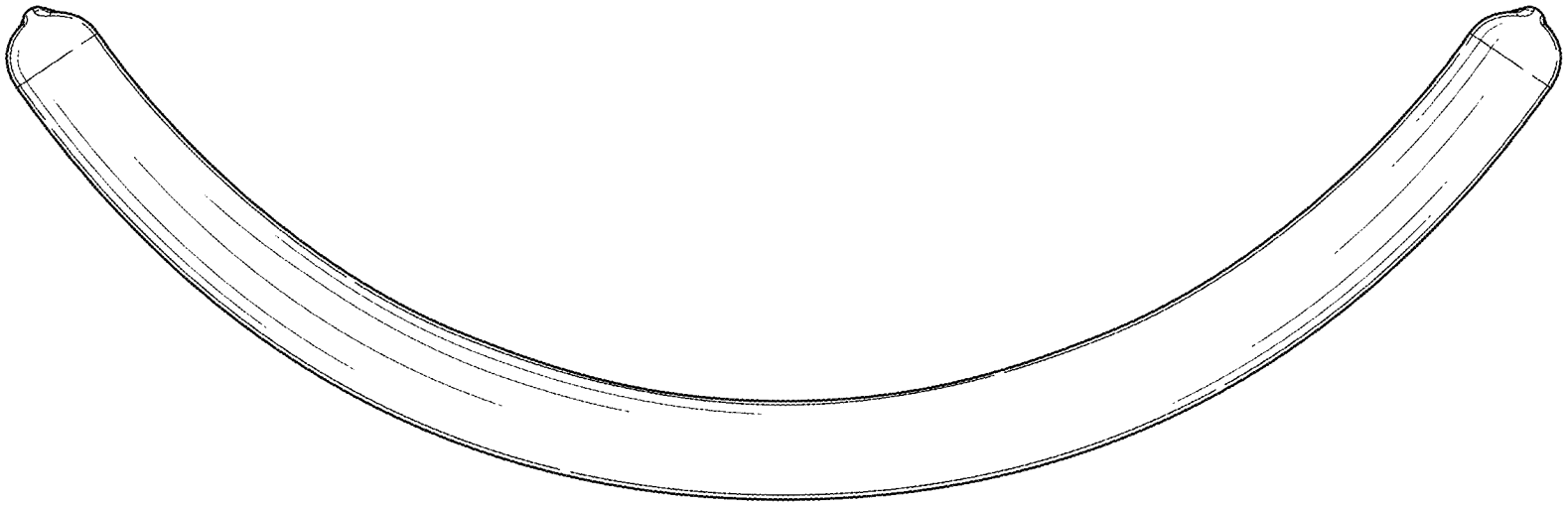
FIG. 109 is a right elevational view of the bridge toy of FIG. 105.
Figure 110:
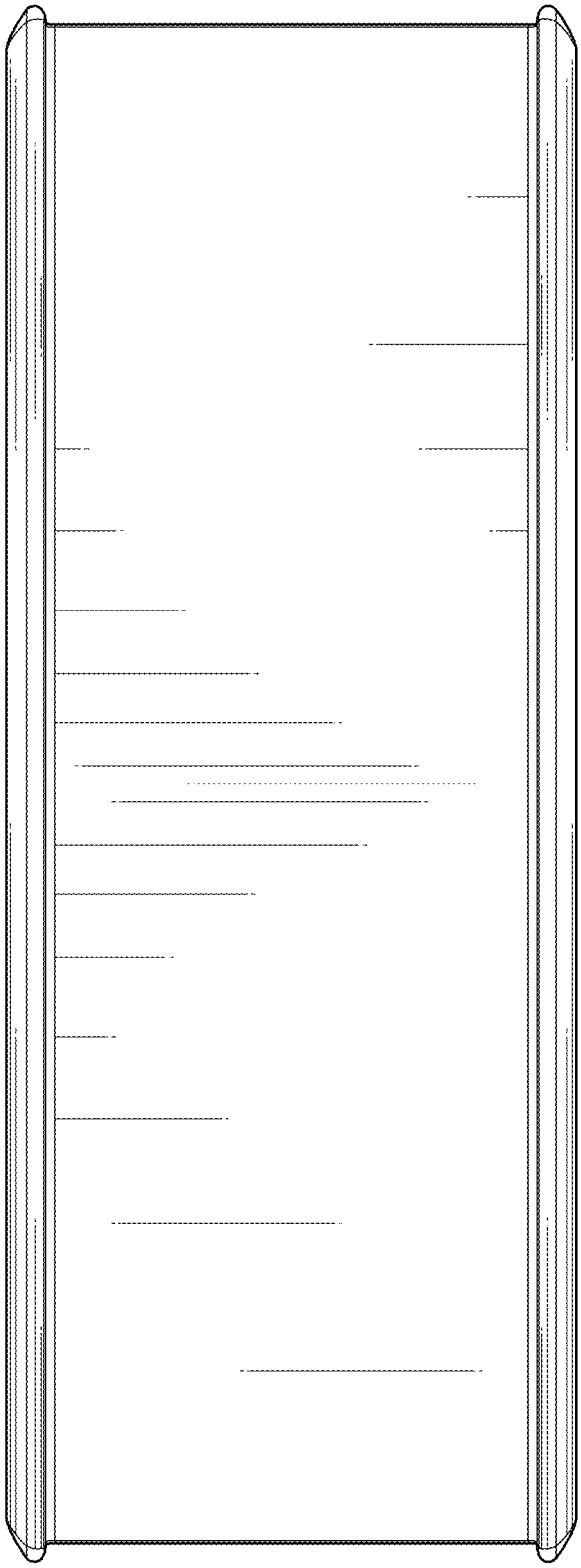
FIG. 110 is a top plan view of the bridge toy of FIG. 105.
Figure 111:
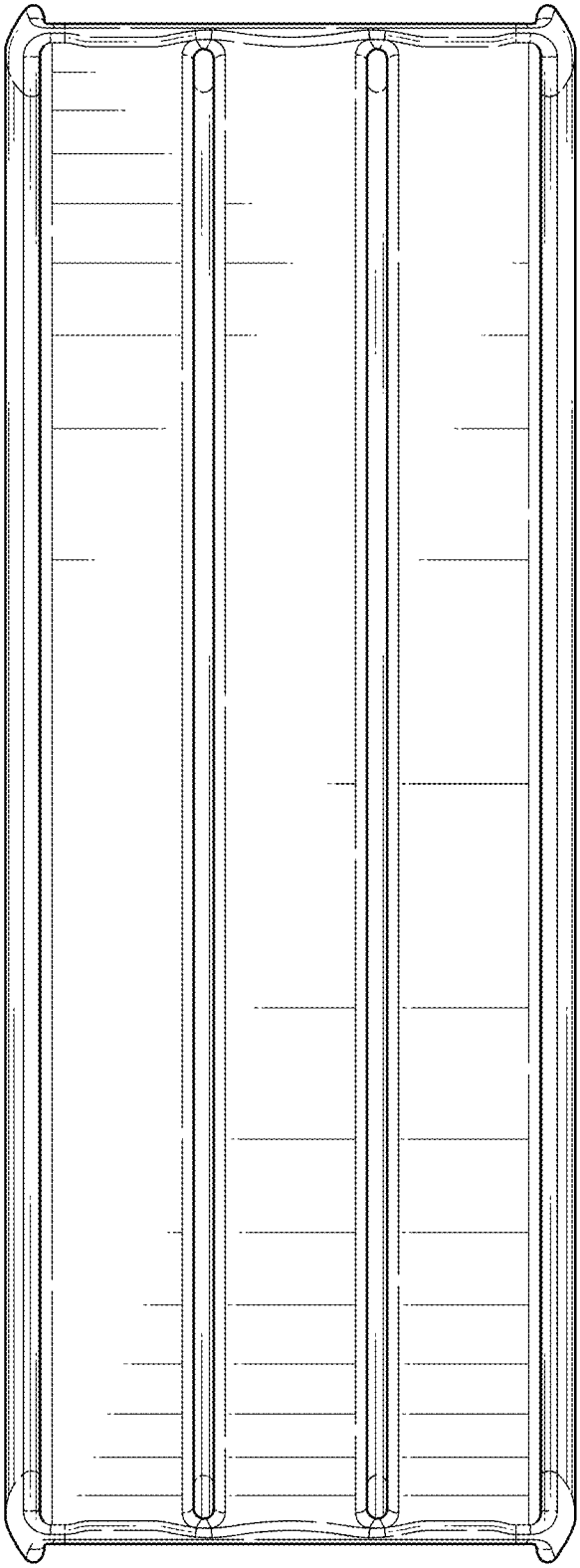
FIG. 111 is a bottom plan view of the bridge toy of FIG. 105.

FIG. 105 is a perspective view of a bridge toy of a sensory table kit. FIGS. 106-111 show further views of the bridge toy of FIG. 105. The bridge toy may be used for imaginary play, helping characters go from one bin to another for example or crossing over a portion of water within an otherwise sand-filled bin.

Figure 113:
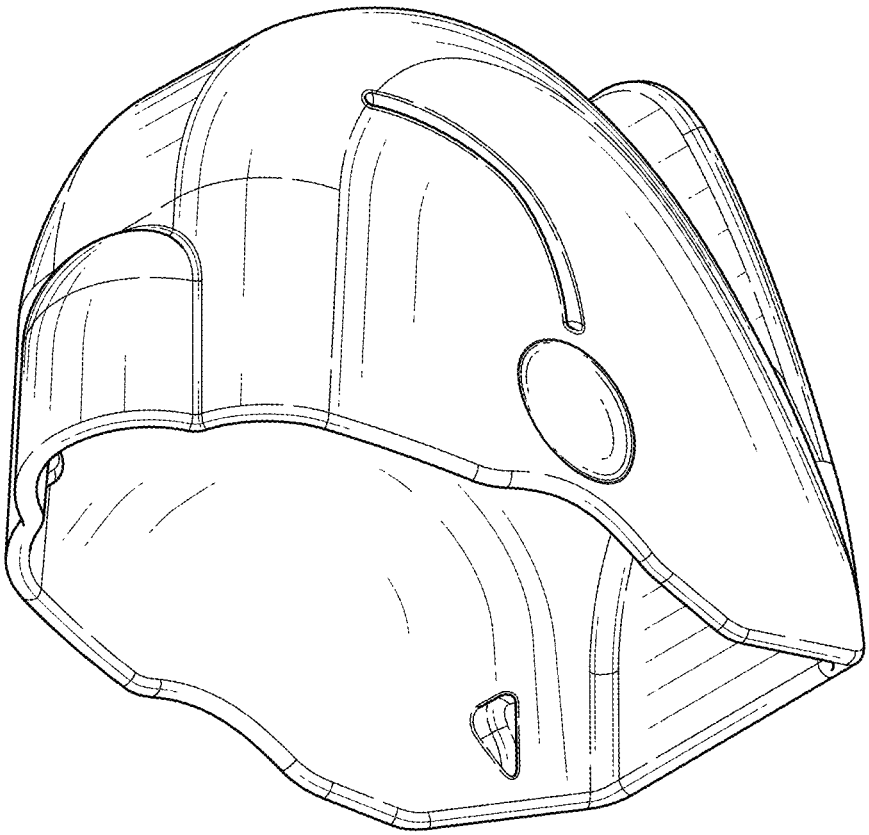
FIG. 113 is a bottom perspective view of the bunny scoop of FIG. 112.
Figure 114:
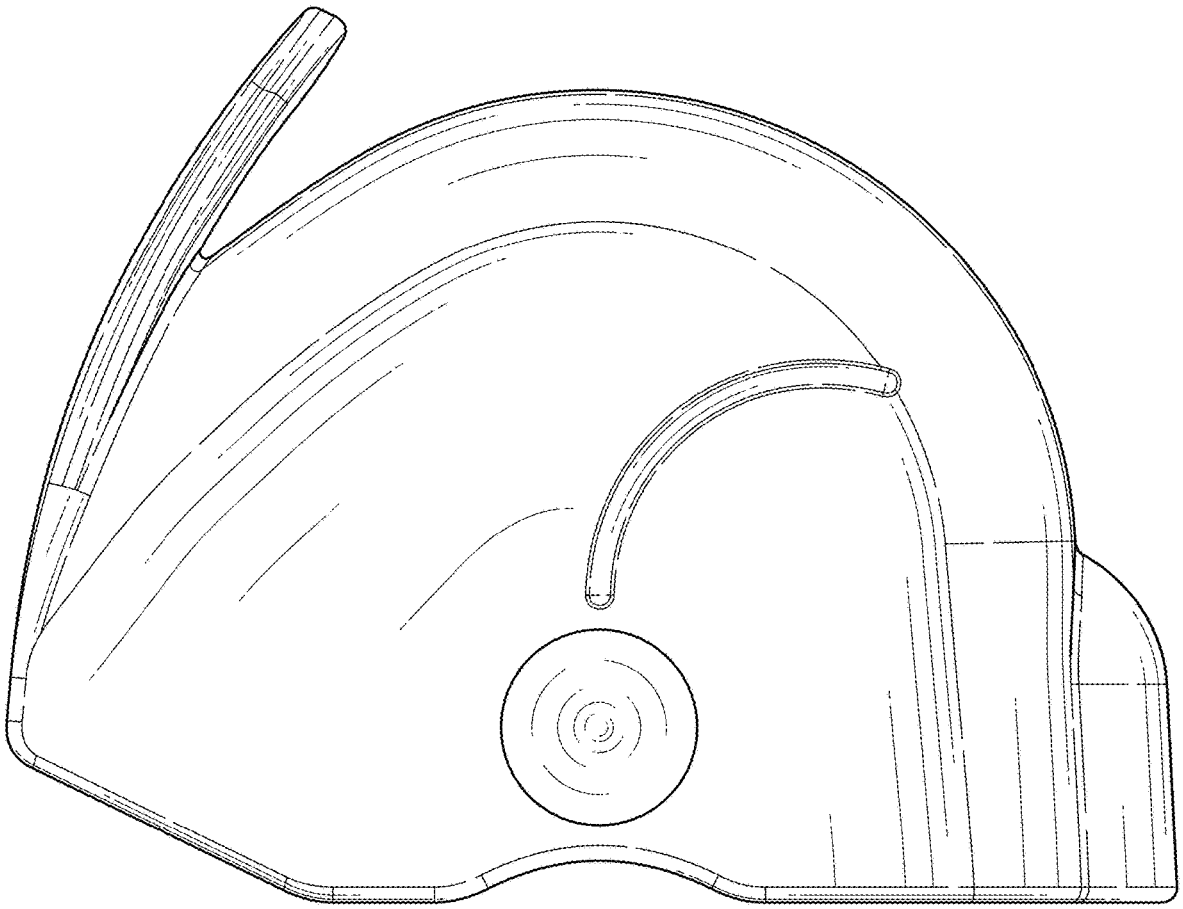
FIG. 114 is a front elevational view of the bunny scoop of FIG. 112.
Figure 115:
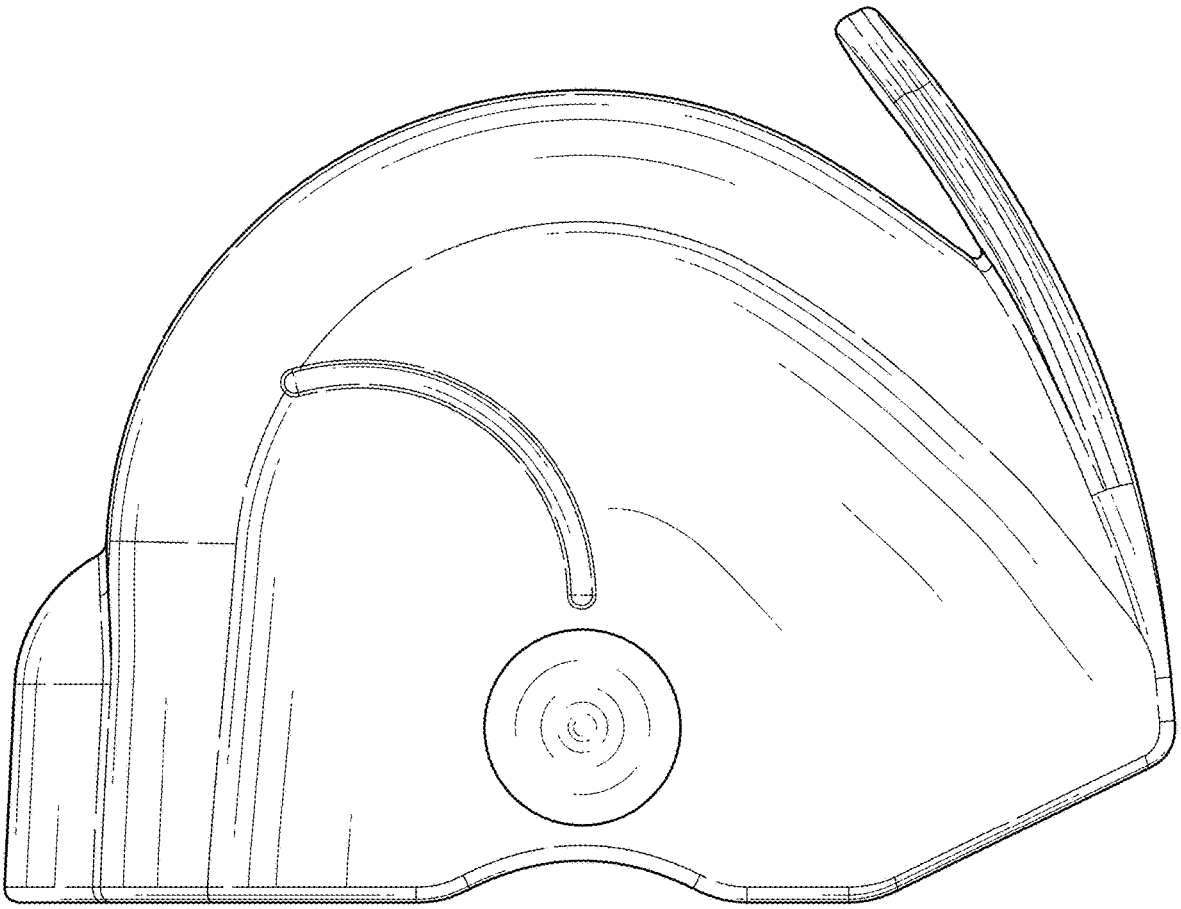
FIG. 115 is a rear elevational view of the bunny scoop of FIG. 112.
Figure 116:
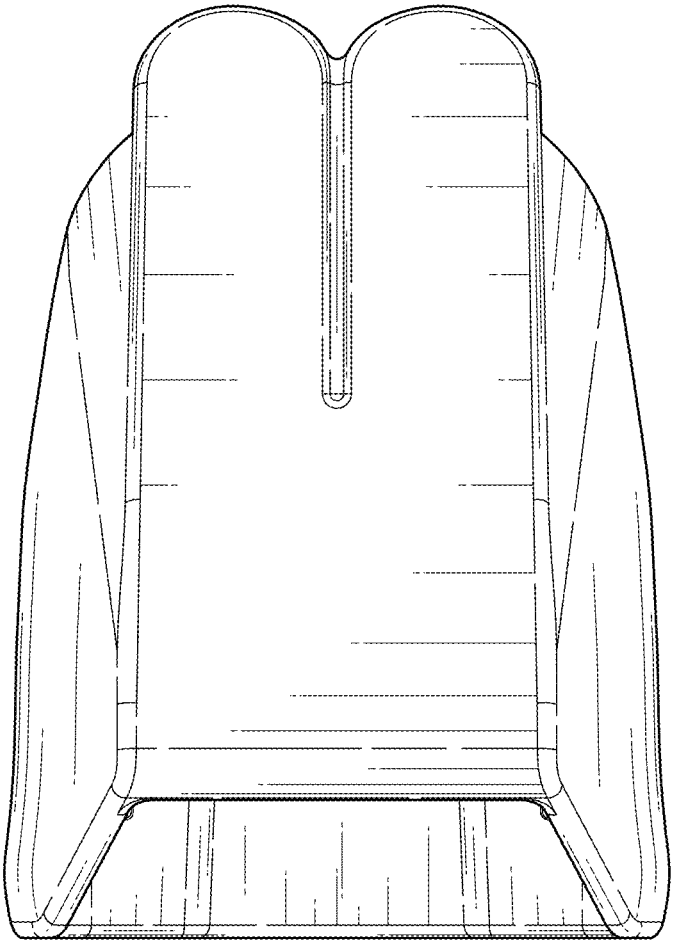
FIG. 116 is a left elevational view of the bunny scoop of FIG. 112.
Figure 117:
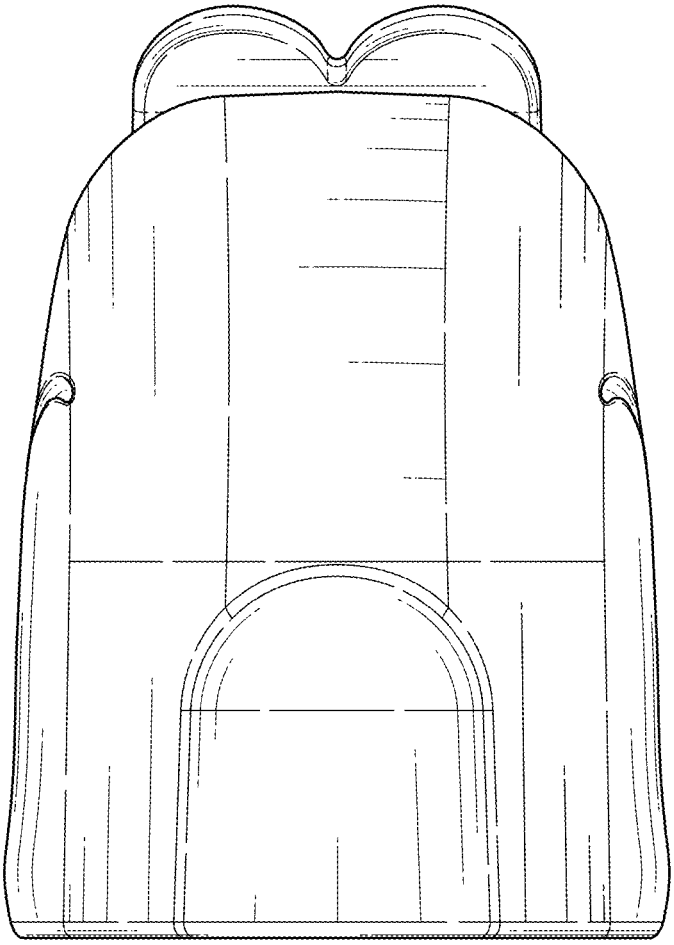
FIG. 117 is a right elevational view of the bunny scoop of FIG. 112.
Figure 118:
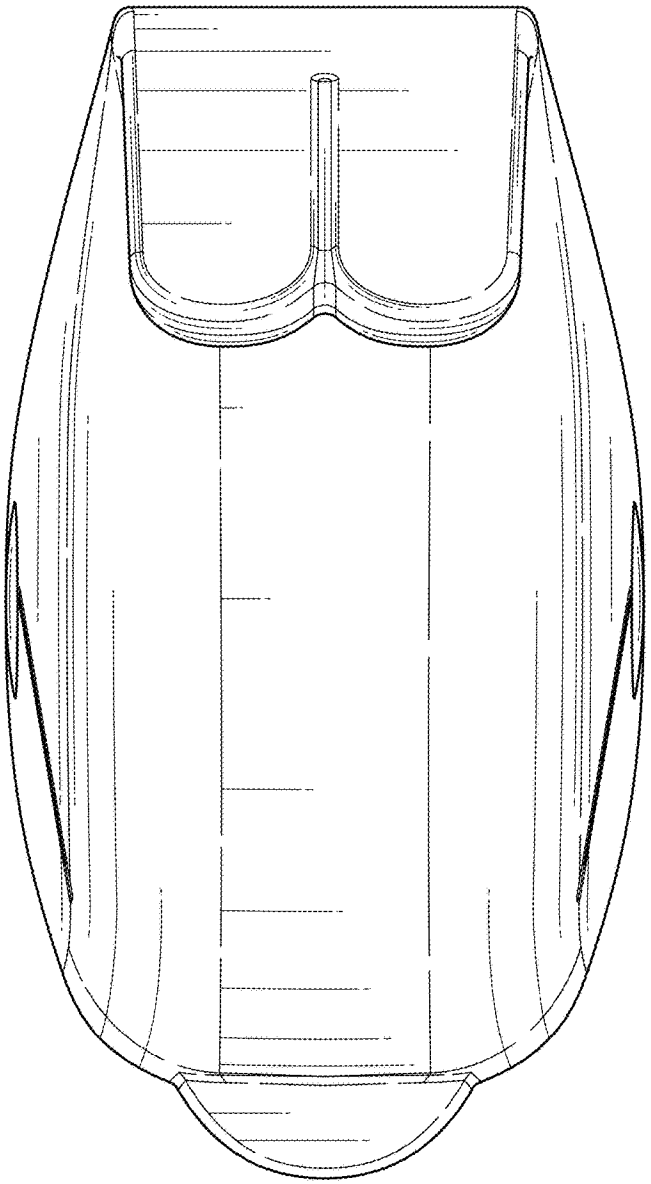
FIG. 118 is a top plan view of the bunny scoop of FIG. 112.
Figure 119:
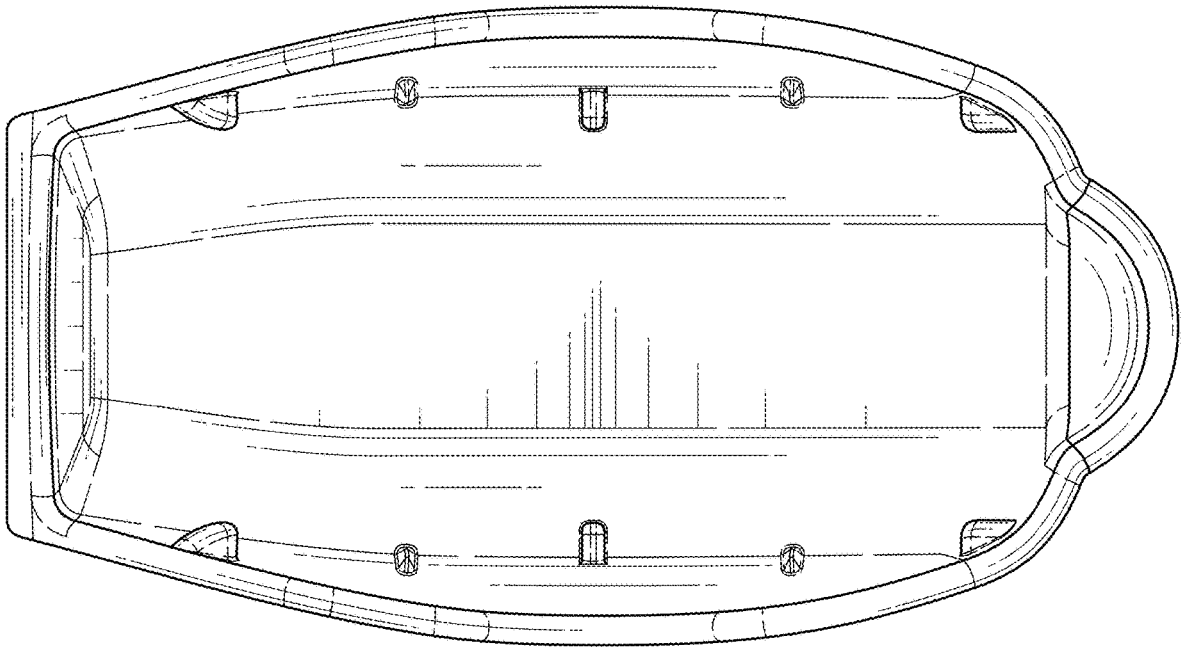
Figure 121:
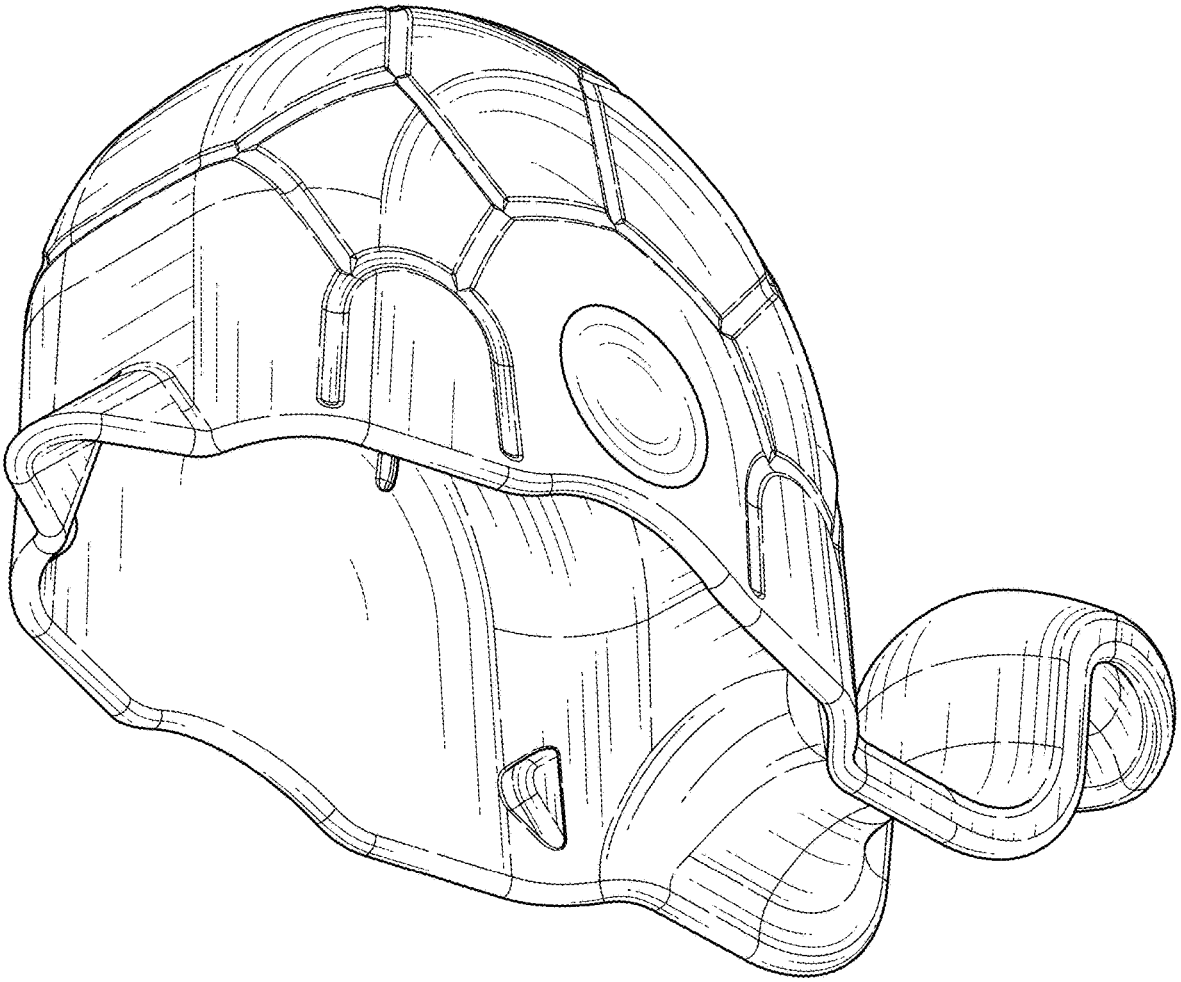
Figure 122:
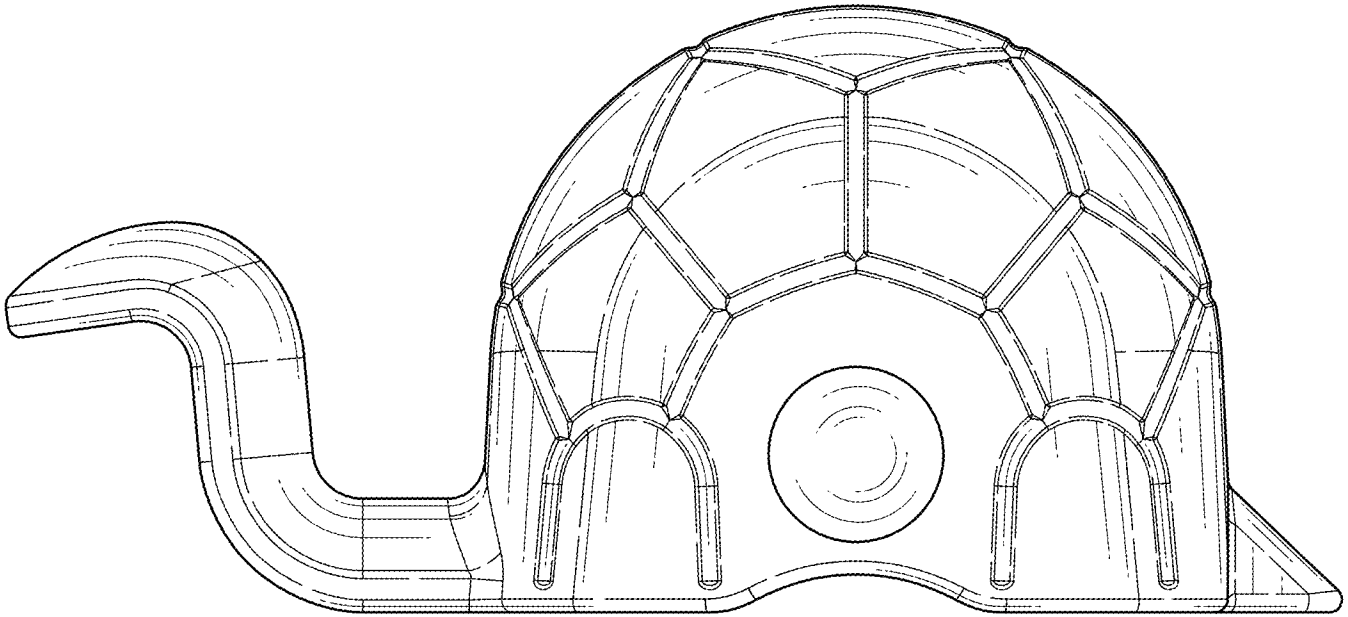
Figure 123:
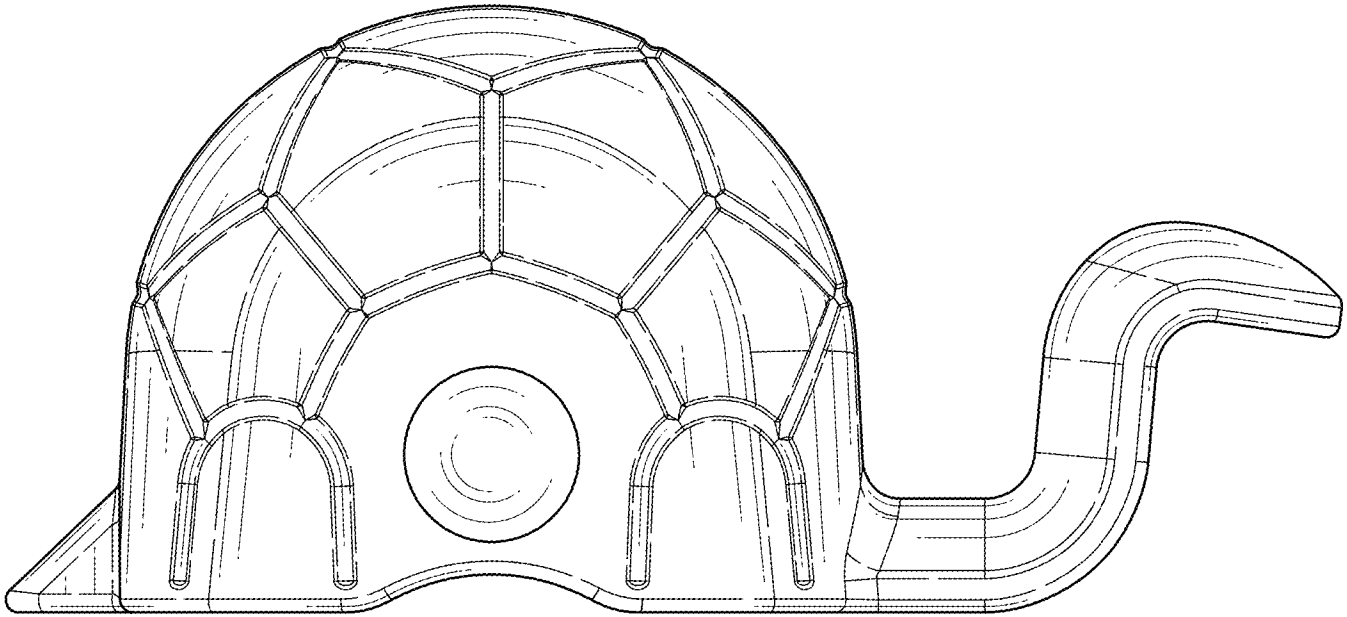
Figure 124:
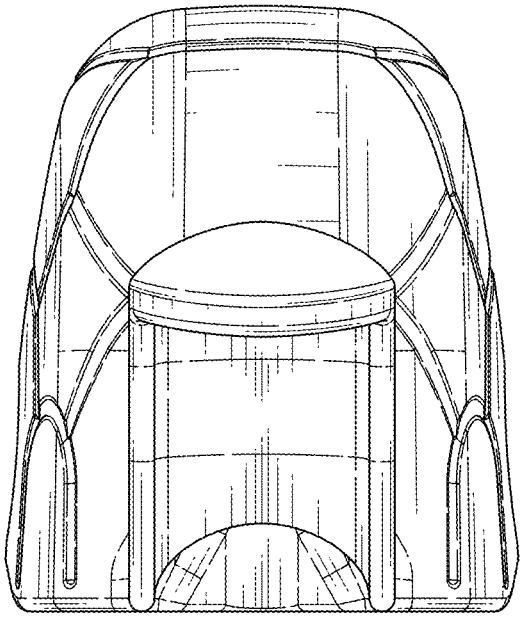
Figure 125:
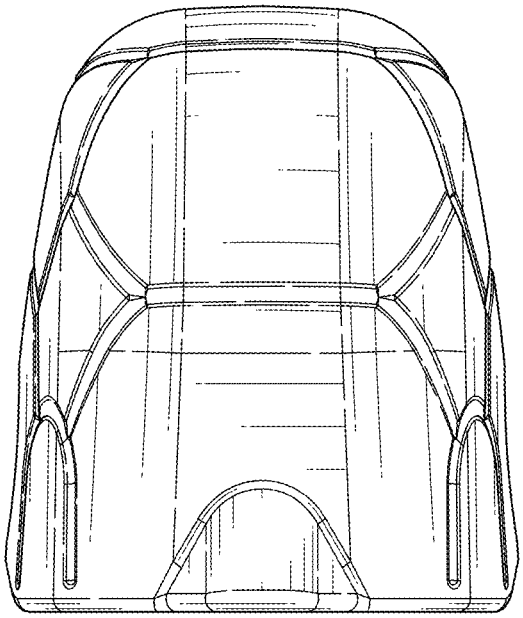
Figure 126:
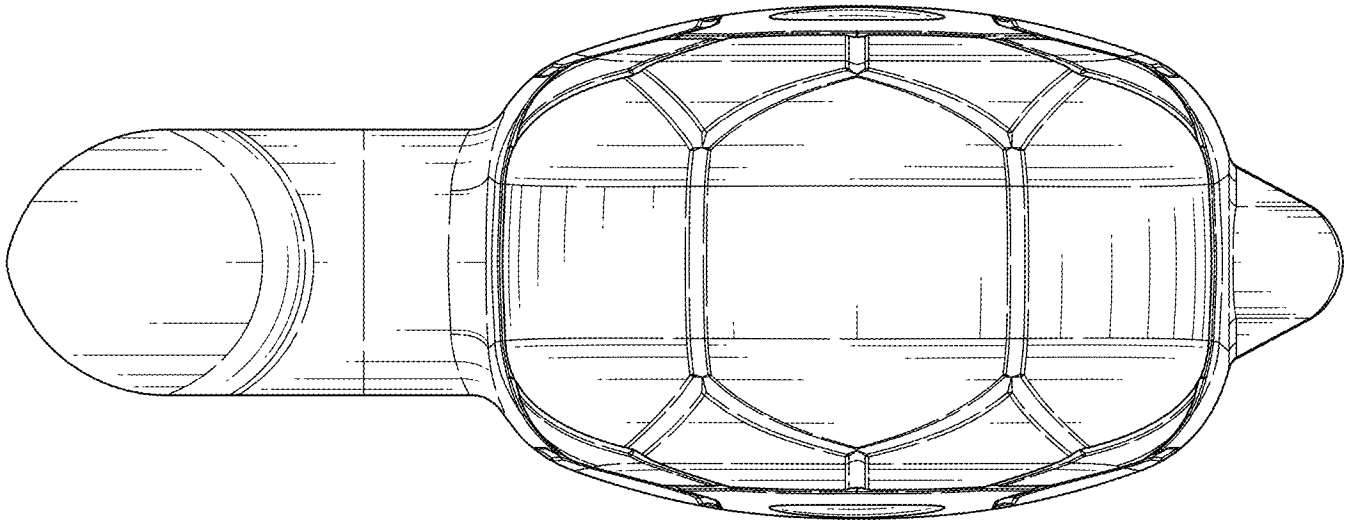
Figure 127:
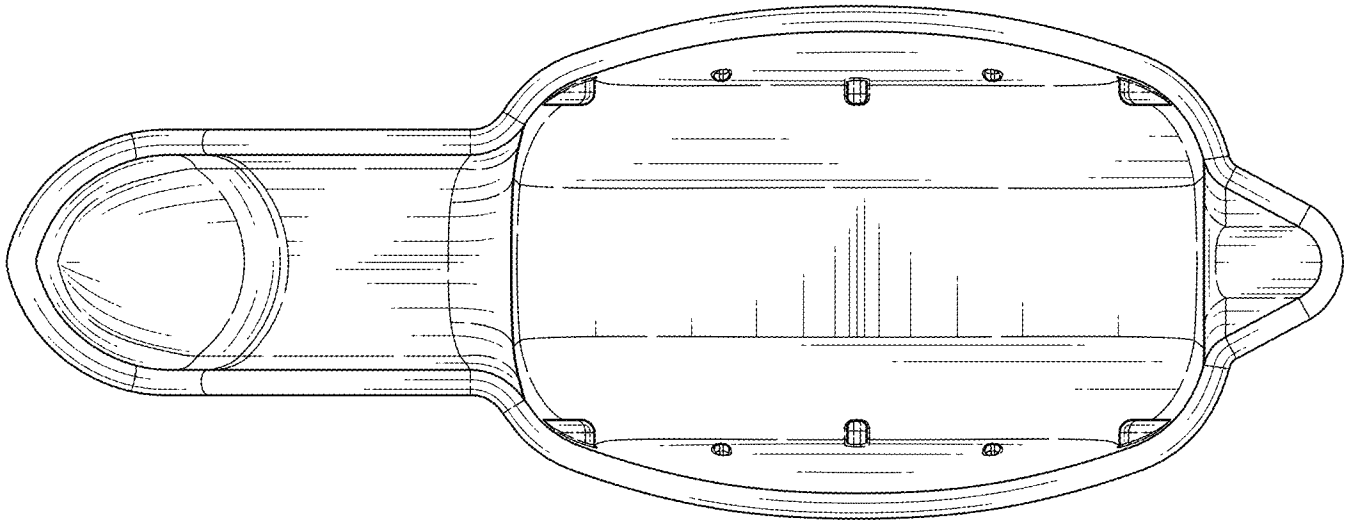
Figure 129:
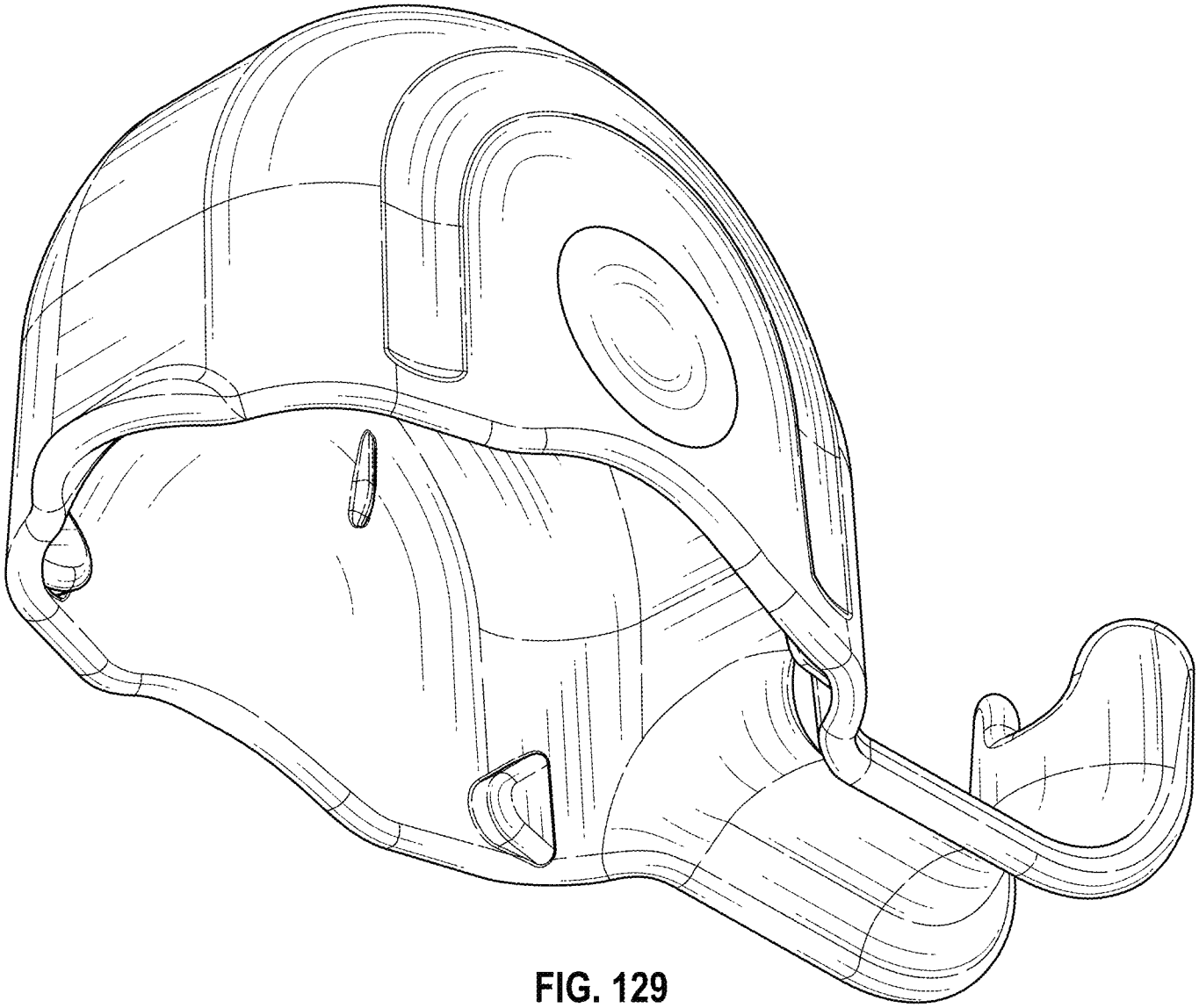
Figure 130:
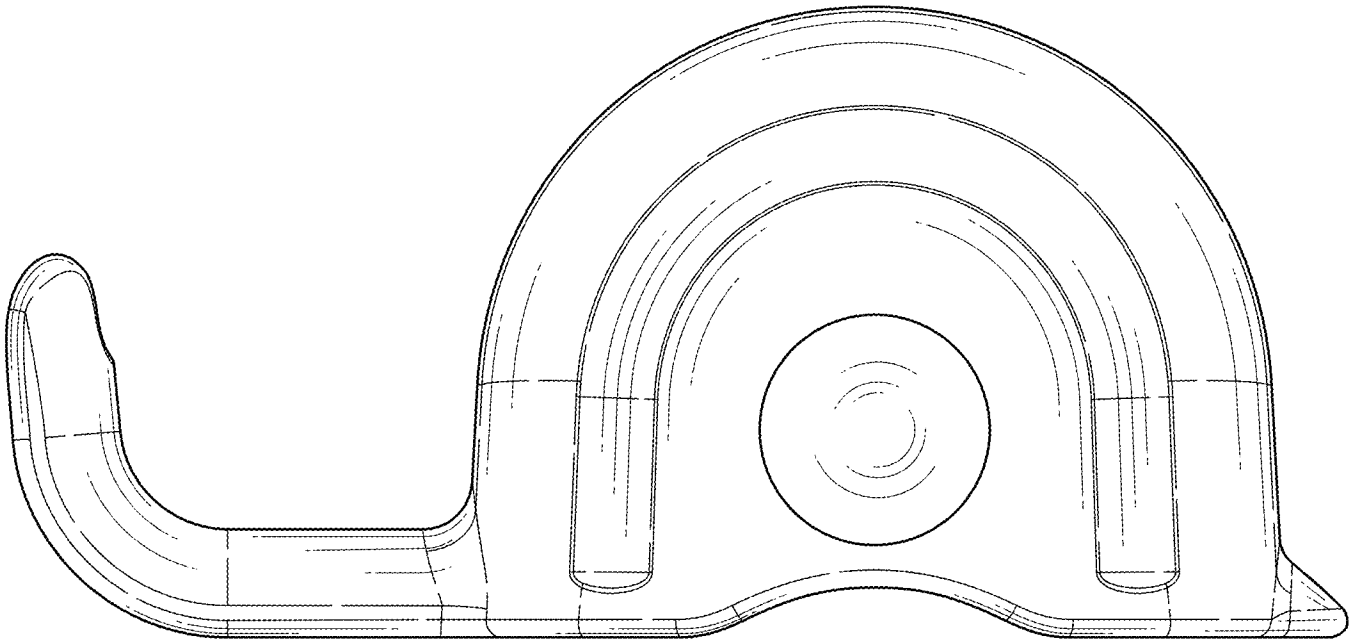

FIG. 112 is a top perspective view of a bunny scoop of a sensory table kit. FIG. 113 is a bottom perspective view of the bunny scoop of FIG. 112. FIGS. 114-119 show further views of the bunny scoop of FIG. 112. FIG. 120 is a top perspective view of a turtle scoop of a sensory table kit. FIG. 121 is a bottom perspective view of the turtle scoop of FIG. 120. FIGS. 122-127 show further views of the turtle scoop of FIG. 120. FIG. 128 is a top perspective view of a snail scoop of a sensory table kit. FIG. 129 is a bottom perspective view of the snail scoop of FIG. 128. FIGS. 130-135 show further views of the snail scoop of FIG. 128. The scoops may be used to manipulate or move mediums in the bins such as dirt, water, sand, etc. The scoops may further be stackable/nestable in one another such as shown in FIG. 154. The different scoops may further combine with the rollers (e.g., as shown with the bunny scoop and large roller in FIG. 155), so that a user may roll the roller over a medium such as sand or dirt to make a print by simply translating the scoop across the medium while the roller is inside the scoop.

FIG. 136 is a top perspective view of a lid of a sensory table kit. FIG. 137 is a bottom perspective view of the lid of FIG. 136. FIGS. 138-143 show further views of the lid of FIG. 136. FIG. 144 is a top perspective view of a bin of a sensory table kit. FIG. 145 is a bottom perspective view of the bin of FIG. 144. FIGS. 146-151 show further views of the bin of FIG. 144. The bottom side of the lids, for example as shown in FIGS. 25, 31, 137, and 143, may have posts that can accept or interference fit with various construction or building block style toys. In this way, the lids may be placed with the pegs facing up (e.g., upside down or opposite to the orientation of the lids in FIGS. 1-8, 24-31, 36-39) so that a user may build with the construction or building blocks upon the lids of the table. FIG. 152 is a top perspective view of a lid of a sensory table kit. FIG. 153 is a bottom perspective view of the lid of FIG. 152. The lid of FIGS. 152 and 153 may be, for example, made out of wood and used as an alternative to the lid of FIGS. 144-151, which may be made out of another material such as molded plastic.

As described herein, FIG. 154 is a perspective view of the bunny scoop of FIG. 112, the turtle scoop of FIG. 120, and the snail scoop of FIG. 128 stacking together. As described herein, FIG. 155 is perspective view of the bunny scoop of FIG. 112 and the large roller of FIG. 70 stacking together. As described herein, FIG. 156 is a perspective view of the small roller of FIG. 56, the medium roller of FIG. 63, the large roller of FIG. 70, and the mushroom cap strainer of FIG. 48 stacking together.

FIG. 157 is a partial top perspective view of a sensory table having inserts for positioning between a sensory table ledge and a lid. In the alternative embodiment example of FIG. 157, removable inserts 202 may be placed onto posts 204 while the bins are not inserted so that the lid has a surface to sit on that aligns the lid with a top surface of the table. If the bins are inserted, the inserts 202 may be removed and lips or upper surfaces of the bins may be designed such that a lid sitting on top of the bins is generally flush with the table top to create a table mode as described herein. That is, in the embodiment of FIG. 157, the posts 204 may not passthrough bins, and therefore either the bins or the inserts 202 may be used to connect to posts 204 and provide support for the lids to form a table top. FIG. 158 is a partial top perspective view of a bin without passthrough openings fitting onto posts of a sensory table. This shows a closeup of how, in this embodiment, the posts 204 do not passthrough the bin but rather stays in an opening that is only on the underside of a lip of the bin.

FIG. 159 is a top perspective view of a bin nesting within a sensory table ledge. FIG. 160 is a top perspective view of the bin of FIG. 159. In FIGS. 158 and 159, there are not posts, but rather additional features 210 formed on a ledge of the sensory table that interact with an outside edge of the bins. The features 210 can help secure the bin in place but can also support a lid whether or not the bin is present. In other words, the features 210 function similarly to the posts 120 described herein, but the features 210 achieve the functions without passing through an opening in the bin. Rather, a cutout 212 in the bin aligns with the features 210 of the table to secure the bin but also provide support for any lid present.

FIG. 161 is a top perspective view of a bin with multiple passthrough openings in each corner of the bin for multiple posts of a sensory table. FIG. 162 is a top perspective view of the bin of FIG. 161. FIGS. 161 and 162 show posts that are differently shaped and configured to the posts 120 described herein, but function in a similar manner.

Accordingly, various embodiments are described herein that allow lids for a sensory table to be in place to form a smooth, contiguous table top whether or not bins of the sensory table are in place within the sensory table.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A table comprising:

a tabletop surface having an opening, wherein the opening is configured to removably receive a bin;

a ledge within the opening, wherein the ledge is configured to support a lip of the bin while the bin is within the opening; and a plurality of posts connected to the ledge and within the opening, wherein each of the plurality of posts are configured to fit into a respective opening in the lip of the bin to hold the bin in place within the opening, wherein, while the bin is placed within the opening, a top surface of each of the plurality of posts is exposed and configured to support a lid.

2. The table of claim 1, wherein while the lid is placed to rest upon the plurality of posts, a top surface of the lid is aligned with the tabletop surface irrespective of whether the bin is placed within the opening.

3. The table of claim 1, wherein while the lid is placed to rest upon the plurality of posts, the lid covers the opening.

4. The table of claim 1, wherein while the lid is placed to rest upon the plurality of posts, the lid and the tabletop surface together form a generally flat tabletop.

5. The table of claim 1, wherein the tabletop surface comprises a perimeter around outside edges of the table.

6. The table of claim 1, wherein the ledge within the opening has a top surface of the ledge that is lower than the tabletop surface.

7. The table of claim 1, wherein while the bin is placed within the opening, a top surface of each of the plurality of posts is approximately level with a top surface of the lip of the bin.

8. The table of claim 1, wherein the opening is a first opening, the bin is a first bin, and the tabletop surface further comprises a second opening configured to removably receive a second bin.

9. The table of claim 8, wherein the lid is configured to cover both of the first opening and the second opening.

10. The table of claim 8, wherein the lid is first lid configured to cover the first opening, and further wherein a second lid is configured to cover the second opening.

11. The table of claim 8, wherein the lip is a first lip, the ledge is within the first opening and the second opening, and the ledge is further configured to support a second lip of the second bin to hold the second bin within the second opening.

12. The table of claim 8, wherein the lip is a first lip, the ledge is a first ledge, and the table further comprises a second ledge configured to support a second lip of the second bin to hold the second bin within the second opening.

13. The table of claim 1, wherein the plurality of posts extend upward from a top surface of the ledge toward the tabletop surface without reaching the tabletop surface.

14. A sensory table kit comprising:

a table comprising:

a tabletop surface with an opening;

a ledge within the opening; and a plurality of posts connected to the ledge and within the opening;

a bin comprising a lip around an outside edge of the bin; and a lid, wherein:

the opening in the tabletop surface is configured to removably receive the bin;

the ledge is configured to support the lip of the bin while the bin is within the opening;

each of the plurality of posts are configured to fit into a respective opening in the lip of the bin to hold the bin in place within the opening;

while the bin is placed within the opening, a top surface of each of the plurality of posts is exposed and configured to support the lid; and while the lid is placed to rest upon the plurality of posts, a top surface of the lid is generally aligned with the tabletop surface irrespective of whether the bin is placed within the opening.

15. The sensory table kit of claim 14, wherein the bin further comprises an opening near each of four corners of the lip.

16. The sensory table kit of claim 15, wherein plurality of posts comprises at least four posts to correspond to the opening near each of the four corners of the lip.

17. The sensory table kit of claim 14, wherein a bottom surface of the lid is configured to rest on the plurality of posts while the bin is placed within the opening and while the bin is removed from the opening.

18. The sensory table kit of claim 14, wherein while the lid is placed within the opening and rests upon the plurality of posts, the opening in the tabletop surface further comprises a cutout in which the lid is not configured to fill, wherein the cutout is configured to receive a user's finger to access a bottom edge of the lid and lift the lid out of the opening.

19. A sensory table kit comprising:

a table comprising:

a tabletop surface with a tabletop opening;

a ledge within the opening, the ledge further forming a first bin opening and a second bin opening;

a first set of posts connected to the ledge, adjacent to the first bin opening, and located within the tabletop opening; and a second set of posts connected to the ledge, adjacent to the second bin opening, and located within the tabletop opening;

a first bin comprising a first lip around a first outside edge of the first bin;

a second bin comprising a second lip around a second outside edge of the second bin;

a first lid;

a second lid, wherein:

the tabletop opening and the first bin opening together are configured to removably receive the first bin;

the tabletop opening and the second bin opening together are configured to removably receive the second bin;

the ledge is configured to support the first lip of the first bin while the first bin is within the tabletop opening and the first bin opening;

the ledge is configured to support the second lip of the second bin while the second bin is within the tabletop opening and the second bin opening;

the first set of posts are configured to fit into first respective lip openings of the first lip of the first bin to hold the first bin in place within the tabletop opening and the first bin opening;

the second set of posts are configured to fit into second respective lip openings of the second lip of second first bin to hold the second bin in place within the tabletop opening and the second bin opening;

the first of posts are further configured to support the first lid;

the second of posts are further configured to support the second lid; and while the first lid is placed to rest upon the first set of posts and the second lid is placed to rest upon the second set of posts, a first top surface of the first lid, a second top surface of the second lid, and the tabletop surface together generally form a level tabletop of the sensory table kit.

20. A table comprising:

a tabletop surface having an opening, wherein the opening is configured to removably receive a bin; and a post within the opening, wherein the post is configured to fit into a corresponding opening in a lip of the bin to hold the bin in place within the opening, wherein, while the bin is placed within the opening, a top surface of the of post is exposed and configured to support a lid.

* * * * *